US008574086B2

(12) United States Patent
O'Neill

(10) Patent No.: US 8,574,086 B2
(45) Date of Patent: Nov. 5, 2013

(54) ELECTRIC FIRES

(75) Inventor: Noel O'Neill, Mell (IE)

(73) Assignee: Basic Holdings, Dublin (IE)

( * ) Notice: Subject to any disclaimer, the term of this patent is extended or adjusted under 35 U.S.C. 154(b) by 188 days.

(21) Appl. No.: 13/167,042

(22) Filed: Jun. 23, 2011

(65) Prior Publication Data

US 2011/0250978 A1 Oct. 13, 2011

Related U.S. Application Data

(63) Continuation of application No. 12/282,033, filed as application No. PCT/EP2007/002207 on Mar. 13, 2007, now Pat. No. 7,967,690.

(30) Foreign Application Priority Data

Mar. 13, 2006 (GB) ..... 0605001.7
Nov. 24, 2006 (GB) ..... 0623434.8

(51) Int. Cl.
*A63J 5/02* (2006.01)
*A63J 5/00* (2006.01)

(52) U.S. Cl.
USPC ..... 472/65; 40/428

(58) Field of Classification Search
USPC ..... 472/59, 61, 63, 65; 40/428; 362/96, 362/101, 253
See application file for complete search history.

(56) References Cited

U.S. PATENT DOCUMENTS

| | | | | |
|---|---|---|---|---|
| 1,432,942 | A | 10/1922 | Zei et al. | 40/428 |
| 1,827,941 | A | 10/1931 | Gross | 40/428 |
| 3,395,476 | A | 8/1968 | Moss et al. | 40/428 |
| 3,742,189 | A | 6/1973 | Conroy et al. | 392/348 |
| 3,978,598 | A | 9/1976 | Rose et al. | 40/428 |
| 4,002,333 | A * | 1/1977 | Gotoh | 472/65 |
| 4,641,445 | A | 2/1987 | Rossi | 40/410 |
| 4,965,707 | A | 10/1990 | Butterfield | 362/96 |
| 5,152,457 | A | 10/1992 | Burwell et al. | 239/102.2 |
| 5,354,515 | A | 10/1994 | Ushimaru | 261/72.1 |
| 5,572,817 | A | 11/1996 | Chien | 40/544 |
| 5,612,266 | A | 3/1997 | Delvaux et al. | 501/123 |
| 5,642,580 | A | 7/1997 | Hess et al. | 40/428 |
| 6,053,165 | A | 4/2000 | Butler et al. | 126/512 |
| 6,312,137 | B1 | 11/2001 | Hsieh | 362/96 |
| 6,551,726 | B1 | 4/2003 | Burrows | 428/690 |

(Continued)

FOREIGN PATENT DOCUMENTS

| | | | |
|---|---|---|---|
| CA | 2321716 | 9/1999 | F24C 3/00 |
| DE | 4142320 | 7/1992 | B05B 17/06 |

(Continued)

OTHER PUBLICATIONS

Search Report for British Application No. GB 0403601.8 dated Jun. 29, 2004.

(Continued)

*Primary Examiner* — Kien Nguyen
(74) *Attorney, Agent, or Firm* — Kusner & Jaffe

(57) ABSTRACT

The disclosure relates to simulated flame effect fires which include an apertured bed, such as a simulated fuel bed, a vapour generating means such as an ultrasonic transducer and means for providing a rising current of air to carry the vapor through the apertured bed. Light sources are provided below the fuel bed to provide localized illumination.

20 Claims, 42 Drawing Sheets

(56) References Cited

U.S. PATENT DOCUMENTS

| | | | | |
|---|---|---|---|---|
| 6,554,681 | B1 * | 4/2003 | Tammera | 446/288 |
| 6,580,368 | B1 * | 6/2003 | Jacobs | 340/539.11 |
| 6,676,271 | B2 * | 1/2004 | Kohn et al. | 362/101 |
| 6,688,752 | B2 | 2/2004 | Moore | 362/234 |
| 6,988,820 | B2 | 1/2006 | Drufva | 362/559 |
| 2002/0152655 | A1 | 10/2002 | Merrill et al. | 40/428 |
| 2003/0041491 | A1 | 3/2003 | Mix | 40/428 |
| 2004/0257798 | A1 | 12/2004 | Hart et al. | 362/96 |
| 2005/0097792 | A1 | 5/2005 | Naden | 40/428 |
| 2006/0115386 | A1 | 6/2006 | Michaels et al. | 422/123 |

FOREIGN PATENT DOCUMENTS

| | | | |
|---|---|---|---|
| EP | 0170521 | 2/1986 | F24C 15/24 |
| EP | 0194157 | 9/1986 | F24C 3/00 |
| EP | 0516565 | 12/1992 | B05B 17/06 |
| EP | 0897514 | 6/2002 | F24C 7/00 |
| EP | 1236517 | 9/2002 | B05B 17/06 |
| FR | 2774601 | 8/1999 | A62C 39/00 |
| FR | 2846562 | 5/2004 | A62C 39/00 |
| GB | 108097 | 7/1917 | F24C 7/00 |
| GB | 417413 | 10/1934 | F24C 7/00 |
| GB | 2232481 | 12/1990 | F24C 15/06 |
| GB | 2242736 | 10/1991 | F24C 15/06 |
| GB | 2256040 | 11/1992 | F24C 7/00 |
| GB | 2388062 | 11/2003 | B05B 17/06 |
| GB | 2391933 | 2/2004 | F24C 7/00 |
| GB | 2395131 | 5/2004 | A61F 15/00 |
| GB | 2402206 | 12/2004 | A47J 37/00 |
| GB | 2418014 | 3/2006 | F24C 7/00 |
| JP | 56059142 | 5/1981 | F24F 6/12 |
| JP | 62049967 | 3/1987 | B05B 17/06 |
| JP | 04250864 | 9/1992 | B05B 17/06 |
| JP | 11162651 | 6/1999 | H05B 33/22 |
| WO | WO 97/41393 | 11/1997 | F24C 7/00 |
| WO | WO 99/45326 | 9/1999 | F24C 3/00 |
| WO | WO 01/57447 | 8/2001 | F24C 7/00 |
| WO | WO 02/099338 | 12/2002 | F24C 7/00 |
| WO | WO 03/063664 | 8/2003 | A47J 7/00 |
| WO | WO 2005/074999 | 8/2005 | A61L 9/12 |
| WO | WO 2006/027272 | 3/2006 | F24C 7/00 |
| WO | WO 2007/056119 | 5/2007 | G02B 6/00 |
| WO | WO 2007/104532 | 9/2007 | F24C 7/00 |
| WO | WO 2008/076326 | 6/2008 | F21S 13/12 |

OTHER PUBLICATIONS

International Search Report for PCT Application No. PCT/EP2005/001668 dated Jul. 5, 2005.

International Search Report for PCT Application No. PCT/EP2005/009776 dated Dec. 16, 2005.

International Search Report and Written Opinion for PCT Application No. PCT/EP2005/009774 dated Jan. 2, 2006.

International Search Report and Written Opinion for PCT Application No. PCT/EP2005/007179 dated Nov. 3, 2006.

Search Report for British Application No. GB 0403601.8 dated Oct. 5, 2007.

International Search Report for PCT Application No. PCT/EP2007/002207, dated Dec. 6, 2007.

British Search Report dated Mar. 1, 2007 for British Application No. GB 0623434.8.

British Search Report dated Jul. 6, 2007 for British Application No. GB 0704822.6.

British Search Report dated Sep. 9, 2008 for British Application No. GB 0704822.6.

Examination Report dated May 25, 2010 issued by the British Patent Office for related British Application No. GB 704822.6.

* cited by examiner

ELECTRIC FIRES

RELATED APPLICATIONS

The present application is a Continuation of U.S. application Ser. No. 12/282,033 (filed Sep. 8, 2008 now U.S. Pat. No. 7,967,690) which is a U.S. national phase application of international application no. PCT/EP2007/02207 (filed Mar. 13, 2007) which claims priority from GB 0605001.7 (filed Mar. 13, 2006) and GB 0623434.8 (filed Nov. 24, 2006), said applications fully incorporated herein by reference.

FIELD OF THE INVENTION

The present disclosure relates to simulated fires and in particular to apparatus for simulating the burning of solid fuel such as coal or logs. The apparatus may desirably, but not essentially include a heat source configured for space heating of a room. More especially, the disclosure relates to apparatus and methods for simulating flames produced by burning solid fuel and/or for simulating smoke as produced when burning solid fuel.

BACKGROUND OF THE INVENTION

Many apparatus for simulating the burning of solid fuel are known in the art. Examples can be seen in WO 02/099338 and WO97/41393 among many others. Typically prior art fire simulating apparatus include a simulated fuel arrangement which may be as simple as a plastic moulding shaped and coloured to resemble coals or logs resting on an ember bed. More complex arrangements include a separate ember bed, which may also be a shaped and coloured plastic moulding, and discrete pieces of simulated fuel which rest on the ember bed. Other arrangements provide simulated fuel pieces resting in a simulated grate. Commonly, the simulated fuel arrangement is illuminated from below by light of varying intensity thereby to attempt to simulate the glowing nature of a burning fire.

WO 03/063664 teaches a simulated fire which includes a plurality of fuel pieces resting on a lattice work support. Below the fuel pieces there is provided a water container which includes an ultrasonic transducer. The transducer is operative to provide clouds of water vapour. A fan heater is mounted above the simulated fuel and acts to draw the water vapour through gaps between the fuel pieces. The water vapour emerging through the fuel bed is intended to resemble smoke. The water vapour is heated by the fan heater, thereby losing any resemblance to smoke and is expelled from the apparatus. The fuel bed is illuminated from below by a light source which is preferably located in the water container. The light source may be coloured red or orange.

SUMMARY OF THE INVENTION

The present disclosure seeks to provide improved simulations of flames and smoke, and to provide improved methods and apparatus for producing simulated smoke. The disclosure further seeks to provide improved apparatus for simulating a real fire, which, in particular, seeks to provide and improved flame and/or smoke simulating effect.

According to a first aspect of the present disclosure there is provided a simulated fire effect apparatus comprising: an apertured bed; a container for operatively containing a body of liquid, the container including at least one wall having a through hole; an ultrasonic transducer device disposed externally of the container and having a transducing portion arranged operatively in fluid contacting relation with the liquid at said through hole.

According to a second aspect of the present disclosure there is provided a simulated fire effect apparatus comprising: an apertured bed; a vapour generating apparatus including a container adapted to contain a body of water, the apparatus having an output arranged to supply vapour to the underside of the apertured bed, an ultrasonic transducer having a transducing portion arranged operatively in liquid contacting relation with the liquid in the vessel, wherein the ultrasonic transducer is configured to operate at a frequency of at least about 1.7 MHz.

In one preferred embodiment of the second aspect, the ultrasonic transducer device is disposed externally of the container the transducing portion being arranged operatively in fluid contacting relation with the liquid at a through hole of the container.

According to preferred embodiments of the first and second aspects of the disclosure, the ultrasonic transducer is configured to operate at a frequency of about 2 MHz.

Preferably the ultrasonic transducer is configured to operate at a frequency in the range of from about 2.4 MHz to about 3 MHz.

In preferred embodiments of the first and second aspects of the disclosure the apparatus further comprises means for transferring vapour generated by the ultrasonic transducer to at least one location below the apertured bed.

Preferably the means for transferring vapour generated by the ultrasonic transducer to at least one location below the apertured bed comprises a fan configured to provide a flow of air into the container.

Preferably in these first and second aspects, the apparatus further comprises a vapour distributing component arranged substantially below the apertured bed, the vapour distributing component having upper and lower walls and including at least one aperture in said respective upper and lower walls.

Preferably respective apertures in the upper and lower walls are substantially vertically aligned.

Preferably the apparatus further comprises means located below the vapour distributing component for operatively providing an upward flow of air through the apertured bed.

In preferred embodiments the means for operatively providing an upward flow of air through the apertured bed comprises at least one light source.

Preferably the apparatus of these embodiments further comprises at least one light source arranged below the apertured bed.

In preferred constructions the ultrasonic transducer device comprises a transducer disc sealingly mounted in a supporting plate, the disc having a liquid contacting surface.

In preferred arrangements of these embodiments the ultrasonic transducer device is configured to operate at a frequency of at least 1.7 MHz, for example at a frequency of at least about 2 MHz and more particularly at a frequency in the range of from about 2.4 MHz to about 3 MHz.

According to a third aspect of the present disclosure there is provided a simulated fire effect apparatus comprising: an apertured bed; and a vapour generating apparatus including a vessel adapted to contain a body of liquid, the apparatus having an output arranged to supply vapour to the underside of the apertured bed, an ultrasonic transducer having a transducing portion arranged operatively in fluid contacting relation with the liquid in the vessel, a liquid supply reservoir operably in fluid communication with the vessel, and means for regulating flow of liquid from the reservoir to the vessel, thereby to provide a substantially constant volume of liquid in the vessel.

According to a fourth aspect of the present disclosure there is provided simulated fire effect apparatus comprising: an apertured bed; a vapour generating apparatus having a vapour output port configured to operatively to supply vapour to a location below the apertured bed; and at least one heat source arranged below the apertured bed and so disposed that heat from the at least one heat source induces a current of air upwardly from the apertured bed.

In preferred embodiments of this aspect of the disclosure the at least one heat source includes at least one heat-producing light source (that is, a light source which produces appreciable amounts of heat as well as light).

Preferably the apparatus of this embodiment further comprises means for transferring vapour generated by the vapour generating apparatus to at least one location below the apertured bed. Preferably said means for transferring vapour comprises a fan configured to provide a flow of air into the vapour generating apparatus.

In further preferred embodiments of this aspect of the disclosure the apparatus further comprises a vapour distributing component into which vapour from the vapour generating component is received, said vapour distributing component being arranged substantially below the apertured bed and having upper and lower walls and including at least one aperture in said respective upper and lower walls.

Preferably respective apertures in the upper and lower walls are substantially vertically aligned.

Preferably the at least one heat source is operatively arranged below the aperture, or respective apertures, of the lower wall.

In still further preferred embodiments of this aspect of the disclosure, the vapour generating apparatus includes a container adapted operatively to contain a body of liquid and an ultrasonic transducer device having a transducing portion arranged operatively in fluid contacting relation with the liquid.

Preferably the ultrasonic transducer device comprises a transducer disc sealingly mounted in a supporting plate, the disc having a liquid contacting surface.

In preferred arrangements of this aspect of the disclosure the ultrasonic transducer device is configured to operate at a frequency of at least 1.7 MHz, more preferably the ultrasonic transducer device is configured to operate at a frequency of at least about 2 MHz and especially the ultrasonic transducer device is configured to operate at a frequency in the range of from about 2.4 MHz to about 3 MHz.

According to a fifth aspect of the present disclosure there is provided a simulated fire effect apparatus comprising: an apertured bed; a vapour generating apparatus having at least one vapour output port; a vapour distribution chamber defined by at least one wall, the vapour distribution chamber further comprising at least one vapour inlet port in fluid communication with said vapour output port, at least one vapour outlet, at least one aperture arranged at a lower portion of said chamber and means arranged proximate said aperture for providing a rising current of air through the chamber.

In a preferred embodiment of this fifth aspect of the present disclosure the vapour distributing chamber is disposed directly below the apertured bed.

Preferably the means for providing a rising current of air includes a heating means.

Alternatively or additionally the means for providing a rising current of air may include a fan.

In other preferred embodiments of this aspect of the disclosure the means for providing a rising current of air is at least one heat-producing light source, which may be employed as an alternative to, or in addition to the above heat source or fan.

Preferably the light source or sources are the sole means of providing a rising current of air.

Preferably the chamber includes at least one vapour directing wall or baffle.

In preferred embodiments of this fifth aspect of the disclosure the apparatus further comprises means for transferring vapour generated by the vapour generating apparatus to the vapour distribution chamber.

Preferably said means comprises a fan configured to provide a flow of air into the vapour generating apparatus.

In further preferred embodiments of this aspect of the disclosure the vapour distributing component is arranged directly below the apertured bed, the vapour distributing component having upper and lower walls and including at least one aperture in said respective upper and lower walls, the at least one aperture in the upper walls defining said at least one vapour outlet.

In preferred arrangements of the apparatus according to this aspect of the disclosure, respective apertures in the upper and lower walls are substantially vertically aligned.

In further preferred arrangements the vapour generating apparatus includes a container adapted operatively to contain a body of liquid and an ultrasonic transducer device having a transducing portion arranged operatively in fluid contacting relation with the liquid.

Preferably wherein the ultrasonic transducer device comprises a transducer disc sealingly mounted in a supporting plate, the disc having a liquid contacting surface.

In preferred embodiments of this aspect of the disclosure, the ultrasonic transducer device is configured to operate at a frequency of at least 1.7 MHz, more preferably the ultrasonic transducer device is configured to operate at a frequency of at least about 2 MHz and more especially the ultrasonic transducer device is configured to operate at a frequency in the range of from about 2.4 MHz to about 3 MHz.

According to a sixth aspect of the disclosure there is provided a simulated fire effect apparatus comprising: an apertured bed; a container adapted to contain a body of liquid, the vessel providing a head space above the liquid and including a vapour outlet port; an ultrasonic transducer device having a transducing surface operatively in liquid contacting relation with the body of liquid and operable to produce a vapour in said head space; means for providing a flow of air along a path extending into the head space and out of the vapour outlet port, wherein the outlet port is so disposed that the air flow path exits the vessel below the apertured bed, and means for providing a current of air directed upwardly from the apertured bed.

In one preferred embodiment of this aspect of the disclosure the means for providing a flow of air comprises a fan configured to provide a flow of air into the container.

Preferably the apparatus of this aspect of the disclosure further comprises a vapour distributing component arranged substantially below the apertured bed into which vapour is received from the vapour outlet port.

In preferred configurations of this aspect the vapour distributing component comprises upper and lower walls and includes at least one aperture in said respective upper and lower walls.

Preferably the respective apertures in the upper and lower walls are substantially vertically aligned.

In preferred embodiments of this aspect, the means for providing a current of air directed upwardly from the apertured bed includes a heating means.

Alternatively or additionally the means for providing a current of air directed upwardly from the apertured bed may include a fan.

In preferred embodiments, the means for providing a current of air directed upwardly from the apertured bed is at least one heat-producing light source which may be employed in addition to, or more preferably, as an alternative to the above heat source or fan.

It is particularly preferred in this aspect of the disclosure that the light source or sources is/are the sole means of providing said rising current of air.

In further preferred embodiments of this aspect of the disclosure the ultrasonic transducer device is disposed externally of the container the transducing portion being arranged operatively in fluid contacting relation with the liquid at a through hole of the container.

Preferably the ultrasonic transducer device comprises a transducer disc sealingly mounted in a supporting plate, the disc having a liquid contacting surface.

In preferred embodiments, the ultrasonic transducer device is configured to operate at a frequency of at least 1.7 MHz, more preferably the ultrasonic transducer device is configured to operate at a frequency of at least about 2 MHz and more especially the ultrasonic transducer device is configured to operate at a frequency in the range of from about 2.4 MHz to about 3 MHz.

In further preferred embodiments of this aspect of the disclosure the apparatus further comprises a liquid supply reservoir which operatively communicates with the container to supply liquid to the container. Preferably the apparatus further comprises control means operative to control the flow of liquid from the reservoir to the container such that a substantially constant volume of liquid is maintained in the container.

According to a seventh aspect of the present disclosure there is provided a simulated fire effect apparatus comprising: an apertured bed; a container for operatively containing a body of liquid, an ultrasonic transducer device having a transducing portion arranged operatively in fluid contacting relation with the liquid, and means for transferring vapour generated by the ultrasonic transducer device from the container to a location below the apertured bed wherein the ultrasonic transducing device is disposed at a location not lower than the lowermost portion of the apertured bed.

In preferred embodiments of this seventh aspect, the means for transferring vapour includes a conduit extending from the container to a location below the apertured bed.

Preferably the conduit and the container are defined in part by a common wall.

According to an eighth aspect of the present disclosure there is provided a method of simulating a fire comprising providing an apertured bed, providing a container including a body of liquid and an ultrasonic transducer device in contact with said liquid; generating a vapour from the liquid with said ultrasonic transducer device and conveying said vapour to an underside region of said apertured bed;

providing a heat source below the apertured bed and generating an upward current of air through said apertured bed with said heat source.

Preferably the heat source comprises one or more heat producing light sources.

The term "apertured bed" in this specification is intended to mean and/or include a body, mass or assembly having gaps or apertures through which vapour produced by vapour generating means (such as an ultrasonic transducer) may pass, in particular when entrained in a rising current of air. The apertured bed may, for example, be a fuel bed (in particular. a simulated fuel bed) which comprises a plurality of discrete bodies arranged together to form a larger general mass, such as simulated coals or logs, real coals or logs, pebbles, small rocks or glass or resin or plastic pieces, the vapour being able to pass and around and between the individual bodies. When a plurality of smaller bodies is used, it may be appropriate to support them on a frame which also allows the passage of the vapour produced vapour generating means.

In alternative arrangements, the apertured bed may be in the form of one or more larger bodies each of which has one or more apertures which allow the passage of vapour. For example the apertured bed may comprise a single block of material having a plurality of passages extending from its under surface to its upper surface.

For achieving a flame simulation effect the apertured bed must include gaps or apertures which allow the transmission of light from light sources arranged below the apertured bed, so that vapour rising above the apertured bed is locally and specifically illuminated by light passing through those gaps or apertures.

BRIEF DESCRIPTION OF THE DRAWINGS

For a better understanding of the disclosure and to show how the same may be carried into effect, reference will be made, by way of example only, to the following drawings, in which.

DETAILED DESCRIPTION OF THE INVENTION

Figure 1:
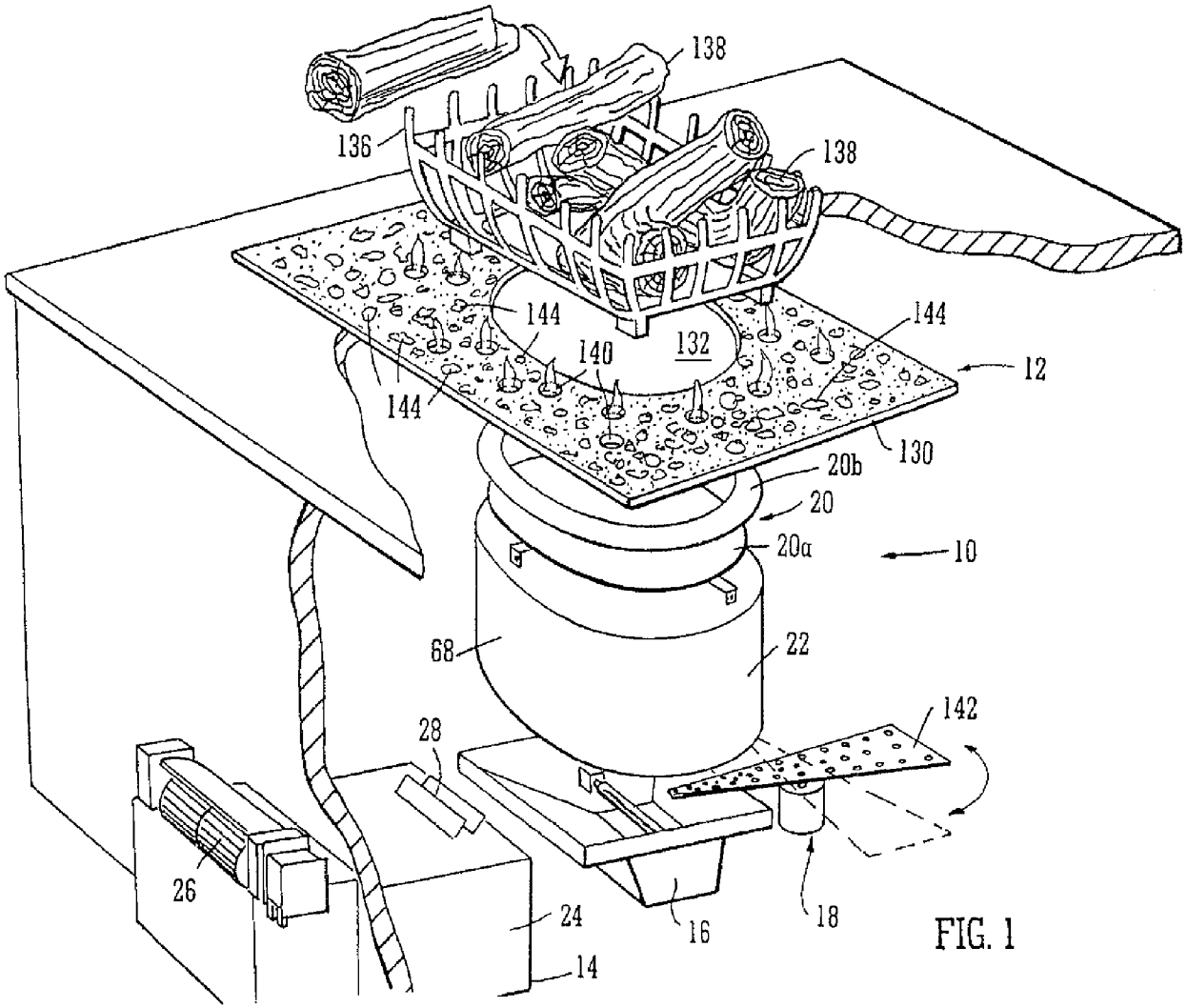
FIG. 1 is a schematic exploded view of an apparatus according to one embodiment of the present disclosure.

Referring now to the drawings and in particular to FIG. 1, in general terms the apparatus 10 of the present disclosure comprises in one embodiment a fuel bed indicated generically at 12, a vapour generator indicated generally at 14, at least one light source 16 and light modifying means 18, 20. Preferably the vapour is water vapour. A preferred liquid is water. Unless the context requires otherwise, references to water and water vapour herein include references to other suitable liquids and their respective vapours. A vapour guide 22 is provided to constrain the water vapour produced by the generator 14 to desired flow path. The apparatus 10 may comprise one or more water vapour generators 14. In use, the water vapour generator 14 produces water vapour within a substantially closed housing 24. A fan 26 provides a flow or air into the container 24 which entrains the water vapour. The water vapour exits the housing 24 through a suitable aperture, outlet or orifice 28. The water vapour is carried in the flow of air generated by fan 26 through the vapour guide 22 and ultimately through the fuel bed 12. The water vapour is carried above the fuel bed by the air flow to give the impression of smoke. Light source 16 illuminates the fuel bed 12 to give the impression of burning fuel. Filters 20 are provided to give the light appropriate colour. Filters may colour the light only locally, or over a wider area. Light modifying means 18 can take various forms but will generally interrupt the light from the light source to give perceived variations in the intensity of the light, to resemble the changes in intensity of burning which occur in a real fire.

Figure 2:
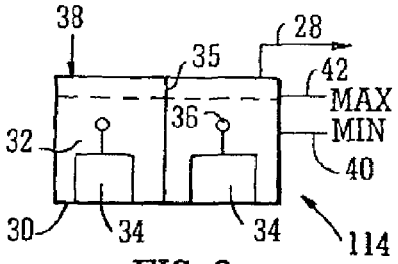
FIG. 2 shows schematically one typical arrangement of a water vapour generator according to the present disclosure.
Figure 3:
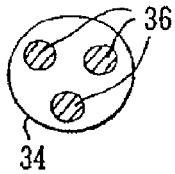
FIG. 3 shows a schematic plan view of one typical ultrasonic transducer of a water vapour generator according to the present disclosure.

FIG. 2 shows a generalised arrangement of one embodiment of a water vapour generator 114 for use in the apparatus according to the present disclosure. The generator 114 comprises a liquid-tight container 30 which in use contains a body of liquid 32 which is most preferably and conveniently water, and one or more ultrasonic transducers 34. Ultrasonic transducers 34 are known in the art and comprise one or more vibrating elements 36, typically in the form of discs, plates, paddles or like structures, which are in communication with the water 32 and act to transmit ultrasonic vibrations to the water. Operation of the transducers in the body of liquid causes cavitation and bubble formation resulting in the formation of clouds of vapour of the liquid. In some preferred arrangements, the container comprises a plurality of ultrasonic transducers 34 each of which may comprise a plurality of vibrating elements 36. One preferred arrangement has two ultrasonic transducers 34 each having three vibrating elements 36, as depicted in FIG. 3. In some preferred arrangements, a barrier or baffle 35 is provided between respective ultrasonic transducers 34, to prevent any interference between respective transducers 34.

The water vapour generator preferably includes an air inlet 38 and an outlet 28. A fan 26 is located proximate the inlet 38 and directs air into the container 30. The air flows out of the container 30 via one or more outlets 28. As the air flows through the container 30, above the surface of the body of water 32, the water vapour produced by the ultrasonic transducers 34 becomes entrained in the flow of air and is thus carried out of the container 30 through outlet 28.

Figure 16:
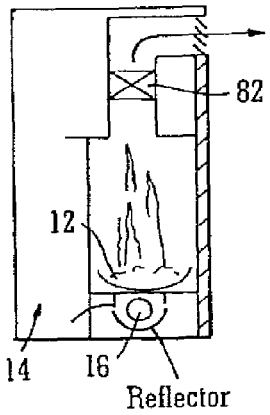
FIG. 16 is a schematic cross-section through one preferred apparatus according to an embodiment of the present disclosure.
Figure 17:
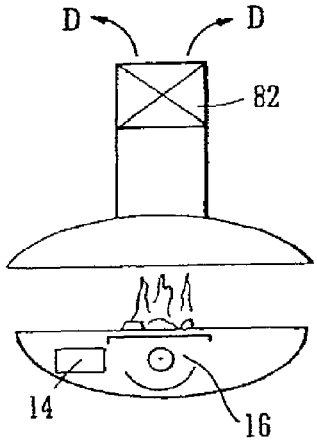
FIG. 17 is a schematic cross-section through a second preferred apparatus according to another preferred embodiment of the present disclosure.

Conventional vapour generators such as are used in fog misting units and domestic humidifiers tend to operate at a frequency of less than 2 MHz, typically about 1.7 MHz. At this frequency, the droplet size of the resultant vapour is relatively large, so that the droplets are effectively quite heavy and tend to fall downwardly quite quickly. This effect can be ameliorated by using a fan mounted above the simulated flame effect to provide an upward current of air in which the vapour is entrained. Examples of such arrangements are shown in FIGS. 16 and 17. However, there is still a tendency for the droplets to move out of the upward air flow and so to fall downwardly again. The inventor has found that by using a vapour generator of higher frequency, such as above 2 MHz and in particular in the range of from about 2.4 MHz to about 3 Mhz or higher, a finer vapour is produced with a smaller droplet size. Such a vapour has a much reduced tendency to fall downwardly, to the extent that the additional fan above the simulated flame effect can be dispensed with. In this case, a small current of warm rising air is sufficient to cause the entrained vapour to rise and the flame simulation is much enhanced. A suitable current of rising warm air can be generated by appropriate positioning of one or more light sources below the fuel bed, as is described in more detail below.

It is evident that as vapour is produced by the ultrasonic transducers 34 and carried out through the outlet 28, the quantity of water in the container reduces until ultimately insufficient water 32 remains in the container for the apparatus operate. For this reason, the container 30 may be provided with a minimum water level sensor 40 and preferably a maximum water level sensor 42. Suitable sensors are known in the art and may, for example, be optical sensors. The maximum level sensor 42 is intended to prevent over-filling of the container 30. The minimum level sensor 40 may act in various ways. For example, when the minimum water level is reached the minimum sensor 40 may output a signal causing the apparatus 10, or relevant parts thereof to shut down. For example the ultrasonic transducers 34 may be turned off, as may the fan 26. Additionally, the minimum sensor 40 may cause a warning signal to be made to a user, for example a visible warning such as a light and/or an audible signal such as a bleep. In other arrangements, the maximum and minimum sensors 40, 42 may co-operate with suitable control means automatically to regulate filling and re-filling of the container 30. In still further arrangements, essentially mechanical flow control means, which may be independent of any sensor such those described above, may be provided to regulate a flow of water into the container 30, for example from a reservoir.

Figure 5A:
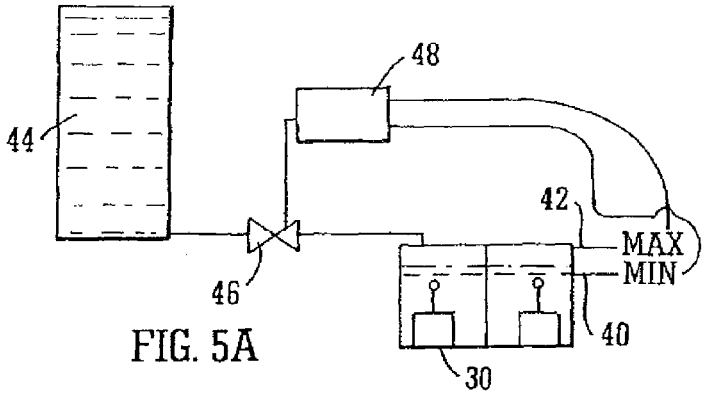
FIGS. 5A and 5B show schematically typical arrangements for the supply of water to a water vapour generator of the present disclosure.
Figure 5B:
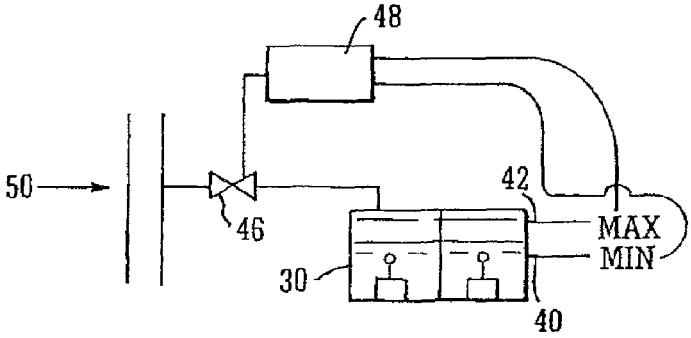

FIGS. 5A and 5B illustrate in general terms alternative methods and apparatus for replenishing the container 30. In the embodiment illustrated in FIG. 5A the apparatus 10 is provided with a high capacity storage tank 44 which will typically contain a minimum of 5 liters of liquid (preferably water). In the event that the minimum sensor 40 determines that the water level in the container 30 has reached its minimum, water is transferred from the tank 44 to the container 30. In a manual arrangement, the minimum level sensor 40 provides a user comprehensible output, such as a warning light or bleep. The user then opens a control valve 46 so that water is allowed to flow from the tank 44 to the container 30. When the container 30 is filled to the maximum desired level, maximum level sensor provides a user comprehensible output and the user closes the control valve 46. In an automatic arrangement the apparatus 10 is further provided with a control system 48 such as an electronic control system. When the minimum level sensor 40 detects that the minimum water level has been reached, it provides an output to control system 48. The control system in turn causes valve 46 to be opened so that the water level in the container 30 rises. When the maximum water level is detected by maximum water level sensor 42, the sensor 42 provides an output to control system 48 which then causes valve 46 to be closed. In a variation, the sensors 40, 42 valve 46 and the control system 48 act to keep the water level in the container substantially constant by permitting a substantially continuous controlled flow of water from tank 44 into container 30 which matches the rate of loss of water from the container 30 as vapour. For example, the valve 46 may be controlled to provide a "drip feed" of water into the container 30.

The arrangement in FIG. 5B is similar to that of FIG. 5A with the exception that the water tank 44 is not required. Instead the control valve 46 is connected directly to a mains water supply 50. A filter may be provided to filter the water from the mains water supply.

For optimum performance of the ultrasonic transducer(s) 34 for the production of vapour, it is advantageous to determine an optimum operating depth for the transducers 34 in the body of liquid 32 and to maintain the transducers at that depth largely irrespective of the quantity of liquid (water) in the container 30. The embodiments illustrated in FIGS. 4 and 7A, 7B and 7C are directed to this issue.

Figure 4:
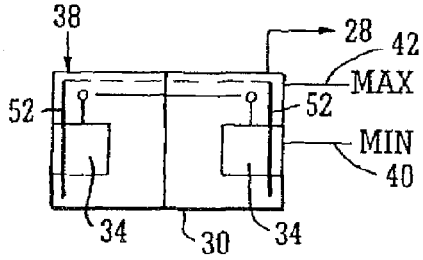
FIG. 4 shows another embodiment of a water vapour generator according to the present disclosure.

In the embodiment illustrated in FIG. 4, each transducer 34 is mounted on one or more guide rods or bars 52. The transducer 34 is free to slide along the length of the bars 52 and the bars 52 are arranged substantially vertically (with respect to the use configuration of the apparatus 10). The transducer 34 is sufficiently buoyant so that it floats below the surface of the water 32 at its optimum depth. As the water level rises and falls, the transducer 34 also rises and falls and so maintains its optimum depth. The transducer 34 is constrained from movement in the tank 30 other than up and down movement by its attachment to the guides 52. The transducer 34 may be permitted some rotational movement about the axis of the guides 52.

Figure 7A:
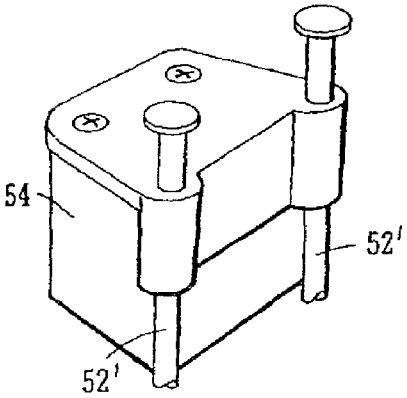
FIGS. 7A, 7B and 7C show schematically further embodiments of water vapour generators according to the present disclosure.
Figure 7B:
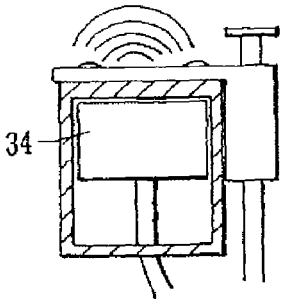
Figure 7C:
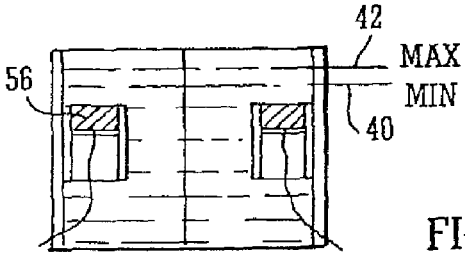

FIGS. 7A, 7B and 7C show a further variation of this arrangement in which the ultrasonic transducer 34 is mounted in a sealed container 54. The sealed container 54 is, in turn, mounted on guide rods or bars 52' and is free to slide along the bars 52'. The transducer 34 acts on a wall of sealed container 54 to transmit vibrations to the body of liquid 32. The sealed container 54 within which the transducer 34 is arranged may be inherently buoyant (e.g. by containing a volume of air) or may further include a float 56 internally or externally thereof. Again the buoyancy of the sealed container is selected so that the transducer or transducers 34 are maintained at an optimum depth in the body of liquid 32. Providing the transducers 34 in a sealed environment has the added advantage of preventing the build up of any residues on the transducer, such as lime scale which could impair the operation of the transducer.

Figure 6A:
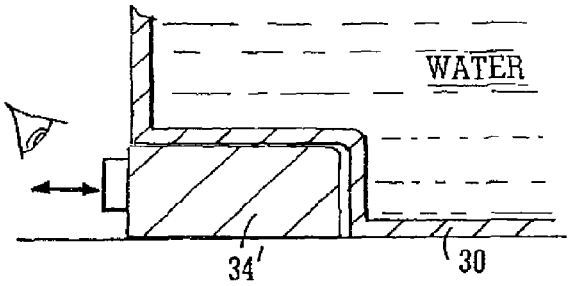
FIGS. 6A and 6B show schematically another embodiment of a water vapour generator according to the present disclosure.
Figure 6B:
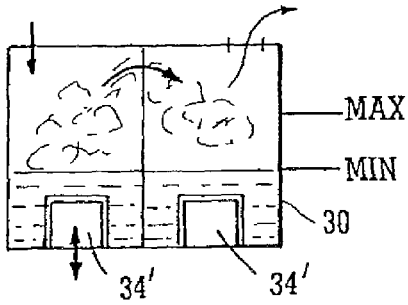

A further alternative arrangement of the transducer 34' is shown in FIGS. 6A and 6B. In this arrangement, the transducer 34' is mounted externally of the container 30 and acts through a wall of the container 30. In addition to avoiding the build up of any residues on the transducer 34', this arrangement also facilitates removal of the transducer 34' for servicing, repair or replacement, should such be necessary.

Figure 56:
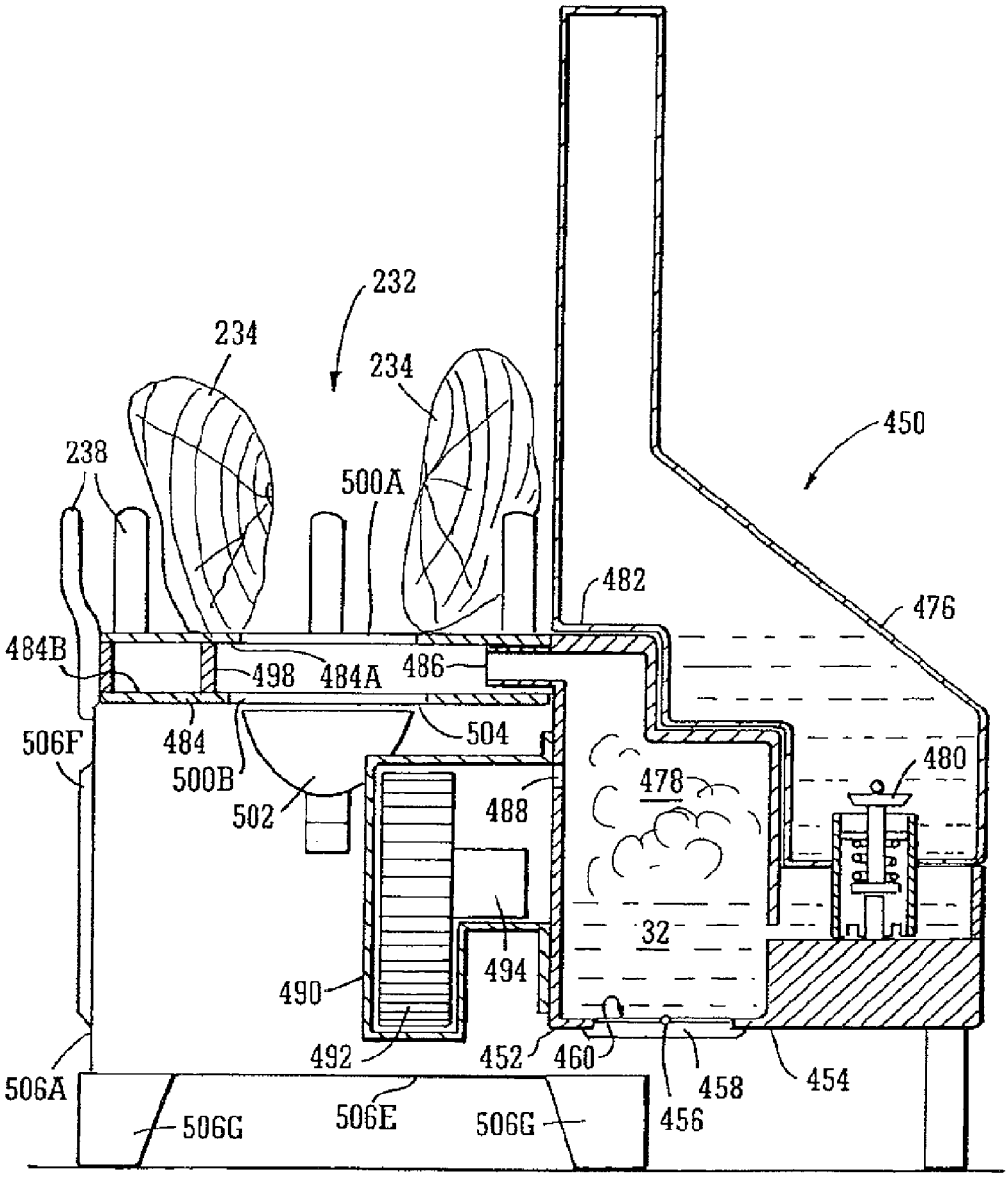
FIG. 56 is a schematic cross section through an apparatus according to another embodiment of the present disclosure.
Figure 57:
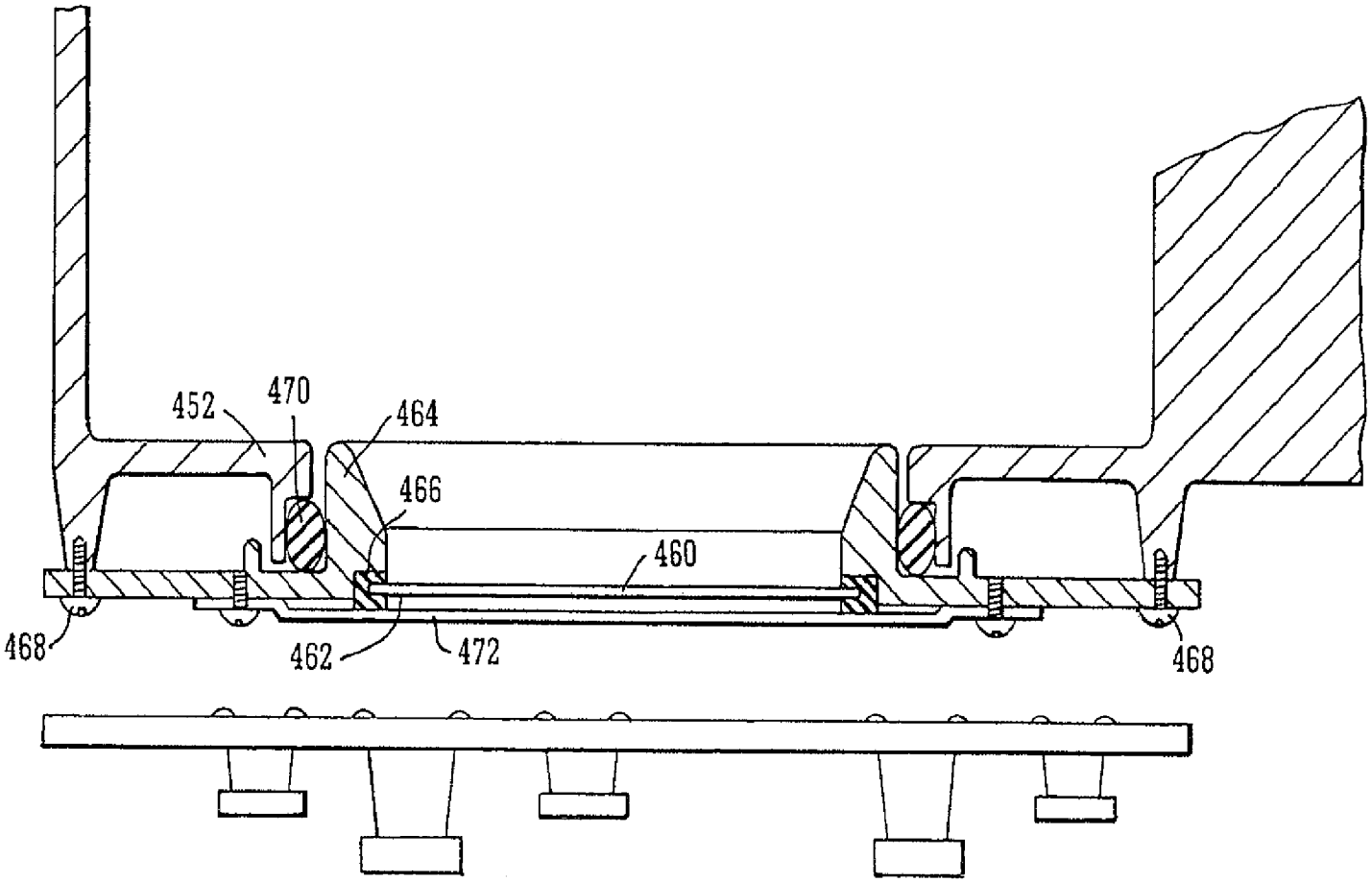
FIG. 57 shows a detail of the apparatus of FIG. 56

Another alternative arrangement of a transducer arrangement is illustrated in FIGS. 56 and 57. FIG. 56 shows an apparatus 450 including a container 452 which operatively contains liquid 32 to be vapourised. The apparatus of FIG. 56 will be described in detail below. It is noted here that the container 452 includes a lower surface 454 which defines at least one aperture 456. A transducer assembly 458 is sealably located in the or, respectively, each aperture 456 so that a transducing surface 460 thereof is exposed to the liquid 32 in the container 452. As may be seen in particular from FIG. 57, the transducer assembly 458 comprises a transducing surface 460 which is an upper surface of a transducer ultrasonic disc 462. Disc 462 is mounted in a supporting plate or casting 464 by way of a seal 466. The seal 466 is preferably formed from a resilient material and acts to prevent water egress from the container 452. The casting 464 is secured to the container 452 by suitable means such as screws 468 and a further seal 470 (such as an O-ring) preferably of resilient material is interposed between the casting 464 and the housing 452 to prevent liquid egress around the casting. A protective backing plate 472 covers the underside of disc 462. Electronic controlling circuitry is mounted on a sub-assembly 474 arranged beneath the transducer assembly 458. This construction (which is also applicable to vapour generators other than that shown in FIG. 56) is advantageous in providing for the easy removal of the transducer assembly for cleaning, repair or replacement and also for ease of mounting of the transducer assembly to the container 452 during manufacture.

Figure 8:
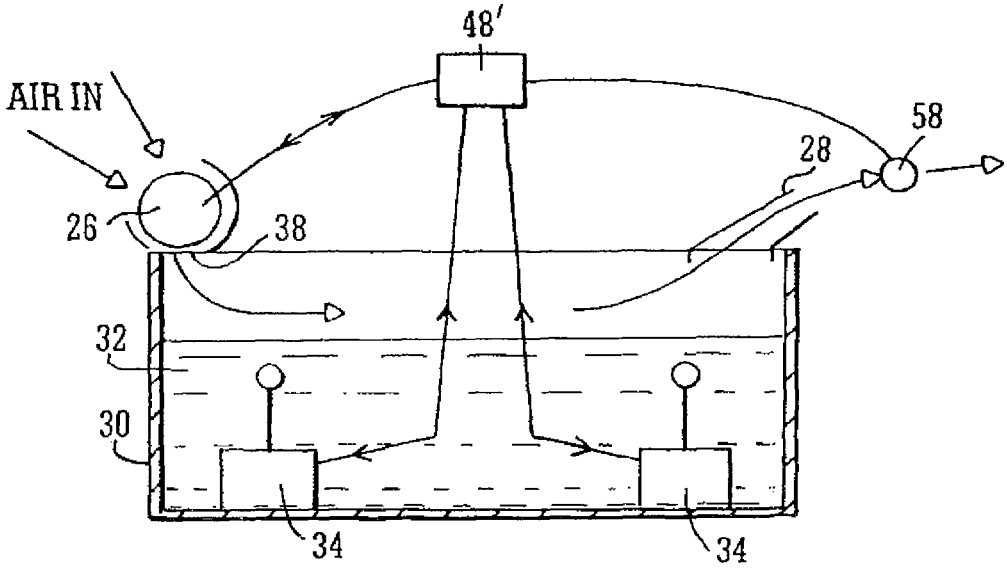
FIG. 8 shows schematically a still further embodiment of a water vapour generator according to the present disclosure.

FIG. 8 is further illustrative of the principles of operation already described above in relation to FIG. 2. Thus, container 30 includes a body of water or other liquid 32. Two ultrasonic transducers 34 are provided in the body of water 32. The container 30 has an inlet 38 and an outlet 28. Fan 26 causes air to flow into the container through inlet 38. Air and entrained vapour exit the container 30 through outlet 28. FIG. 8 illustrates a modification of the apparatus 10 in which the apparatus 10 is further provided with a sensor 58 which detects the presence, and preferably also the quantity of vapour emitted from the chamber 30. For example, the sensor 58 may be a moisture sensor of a type known in the art. The vapour sensor 58 provides an output to a control system 48' (which may also include the functionality of control system 48). The control system 48' is adapted to vary the speed of the fan 26 and/or the operation of the transducers 34 to vary the output of vapour. The speed of the fan 26, and consequently the flow speed of the air through the container 30 and subsequently through the remainder of the apparatus 10, determines the perceived density of the vapour which correlates at least partly to its perceived opacity. For example, the quantity of vapour and thus opacity of the vapour tends to increase if the fan speed increases. Thus the control system is programmed, such as by a suitable algorithm, to determine the speed of the fan in accordance with the quantity of output of the vapour and also a desired appearance of the burning simulated fuel.

Figure 9:
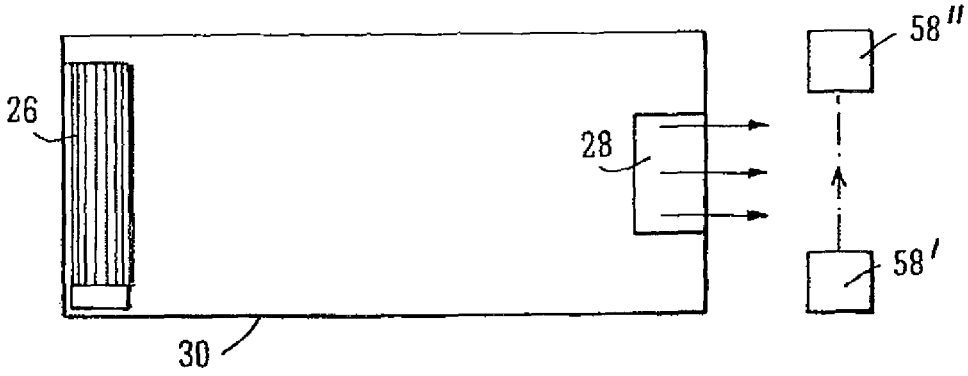
FIG. 9 shows one variation of the embodiment of FIG. 8.

FIG. 9 is a schematic plan view of the arrangement shown in FIG. 8. In the embodiment illustrated, the sensor 58 is an optical sensor in which unit 58' provides a beam of light directed at receiver 58". Unit 58' may be a laser, for example. Receiver 58" provides an output to control system 48' dependent on the density of the vapour between unit 58' and receiver 58". The density of the vapour is related to the intensity of light received by the receiver 58" and the receiver 58" provides an output accordingly.

Figure 10:
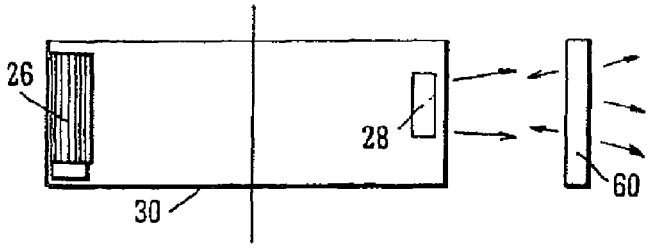
FIG. 10 shows another variation of the embodiment of FIG. 8.

FIG. 10 shows a further alternative arrangement in which the apparatus 10 is further provided with means for killing or rendering innocuous potentially infectious entities which may be present in the body of water 32 and hence in the vapour generated by transducers 34. In the illustrated embodiment, the said means comprise an emitter of ultraviolet light (a u. v. lamp) 60 which is positioned to irradiate the flow of vapour.

Further alternative constructions of the vapour generator are described below in relation to FIGS. 39, 42, 43, 44, 56 and 57.

Figure 11B:
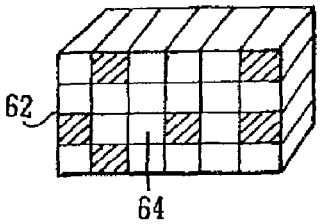
FIG. 11B shows schematically one example of the construction of a vapour guide arrangement.
Figure 11A:
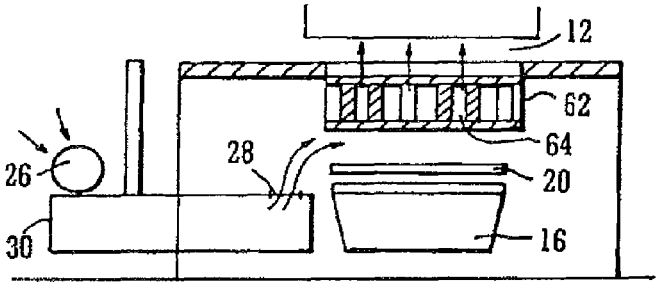
FIG. 11A shows schematically an arrangement of a water vapour generator, light source and simulated fuel according to one embodiment of the disclosure and including a vapour guide arrangement.

FIG. 11 illustrates an arrangement of the apparatus according to an embodiment of the present disclosure in which means are provided to direct the flow of vapour, or more particularly, portions of the flow of vapour, to localised regions of the fuel bed. In this embodiment intermediate the outlet 28 of the vapour generator (e.g. of container 30) there is provided a guide arrangement 62 which constrains the vapour to flow only to particular locations of the fuel bed 12. Thus the vapour emerges through the fuel bed only in distinct localised points or areas. This is advantageous in simulating the smoke production of a real solid fuel fire and may further provide advantages in the simulation of flames. In a particular construction the vapour guide arrangement 62 comprises a plurality of passageways, channels or conduits 64 each of which has a diameter or cross sectional area which is small in relation to the overall size of the fuel bed. Typically the passageways 64 have a maximum cross-sectional dimension of 20 mm or less and more particularly 15 mm or less. The passageways 64 may communicate with discrete apertures (if provided) in the fuel bed 12. The passageways may be formed in one or more unitary bodies 66 each of which includes a plurality of passageways 64 and may thus have an appearance approximately resembling a honeycomb, as shown in FIG. 11B. The vapour guide arrangement 62 is, in the embodiment illustrated in FIG. 11A mounted directly below the fuel bed 12 and directly above a light source 16 which illuminates the fuel bed 12 from below. Thus, the vapour guide arrangement is desirably made from a transparent, or at least translucent, material such as a transparent or translucent material such as a plastic. Although not specifically illustrated in FIG. 11A, means are most preferably provided to direct the vapour from the container outlet 28 to the input side of the vapour guide arrangement.

Figure 18:
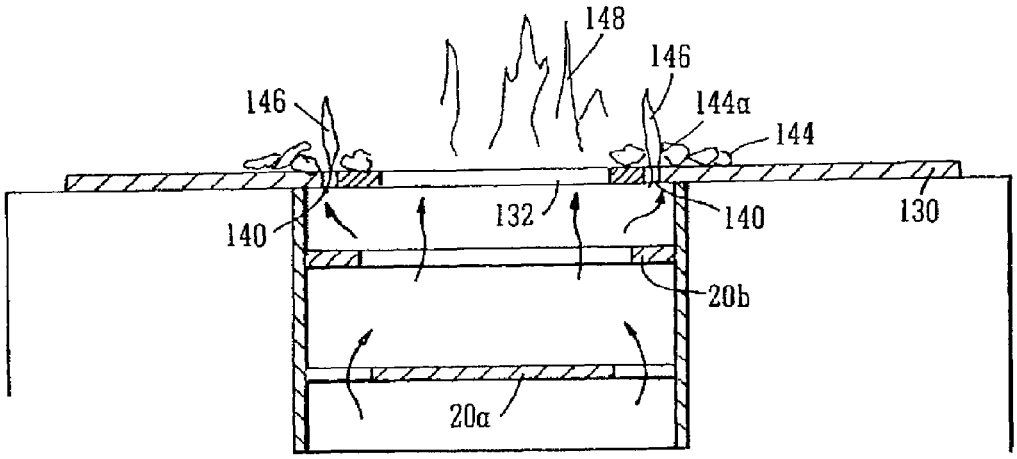
FIG. 18 is a schematic cross-section through a portion of an apparatus according to an embodiment of the present disclosure.
Figure 20:
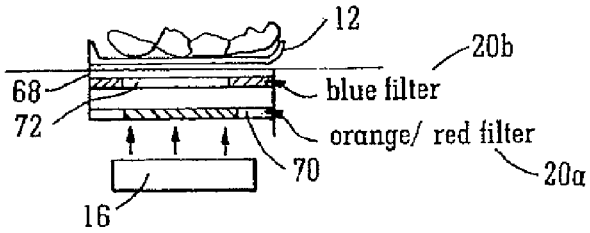
FIG. 20 illustrates an arrangement of the apparatus according to embodiments of the present disclosure for providing coloured light.

FIG. 20 illustrates an arrangement for colouring light directed to the fuel bed in one embodiment of the apparatus according to the present disclosure. Analogous arrangements are also illustrated in FIGS. 1 and 18. The apparatus 10 includes a vapour generator as described in one of the above embodiments and a fuel bed 12 which is typically as outlined in connection with FIG. 1. In order to give colour to the fuel bed, to provide the illusion of glowing embers, light from a light source 16 (or a plurality of light sources) directed to the underside of the fuel bed 12 is appropriately coloured, primarily in red, orange, blue and green colours, as are seen in a real solid fuel fire. The light from light source 16 may also be used in the simulation of flames, as will be described in more detail below. Typically, the light source 16 emits white or near-white light. Accordingly means are required to provide light of the appropriate colour. Such means are in the form of colour filters 20*a* and 20*b*. Additional filters of further colours may be provided if desired. In the embodiment illustrated in FIG. 20 filter 20*a* is orange or red and filter 20*b* is blue, but other colour combinations are within the scope of the present disclosure. The filters 20*a* and 20*b* are mounted and retained in a housing or cowl 68 which acts as a large tube or conduit and serves to direct the flow of vapour from the outlet 28 of the vapour generator 14 to the underside of the fuel bed 12. Orange/red filter 20*a* is of smaller size than the cross-sectional diameter of the cowl 68 so that a gap is defined between the internal face 70 of the wall of the cowl 68 and the side edge or edges (depending on its particular shape) of the filter 20*a*. Thus vapour generated by vapour generator 14 is able to pass freely between the edge of the filter 20*a* and the wall of the cowl 68. The filter 20*b* is constructed in the contrary manner so that it defines at least one hole at its centre but has a peripheral solid (vapour impermeable) portion which terminates close to internal face 70. Thus vapour is able to pass through the central hole(s) 72 of filter 20*b*. The result of this construction is that vapour is able to pass through the cowl 68 by passing through or around the filters 20*a*, 20*b* and so is able to reach the fuel bed 12 while at the same time different areas of the fuel bed 12 are illuminated with light of different colours. Specifically, outer areas of the fuel bed 12 are illuminated with predominantly blue light which has been transmitted by filter 20*b* and inner areas of the fuel bed 12 are illuminated predominantly with red/orange light which has been transmitted through filter 20*a*. Other colour combinations and specific arrangements may be provided. More than two filters may be used, and light may pass through more than one filter. Particular filters may be sized and positioned to locally colour particular areas of the fuel bed 12, provided only that through flow path is maintained for the vapour.

In an alternative construction, the filters may be positioned at a somewhat lower level, and the vapour may be directed to the underside of the fuel bed 12 immediately below the fuel bed 12 and above the filters 20. The requirement for the vapour to pass through or around the filters is thus obviated, but control of the distribution of the vapour beneath the fuel bed 12 may be hindered. A vapour distributing component of the type described in relation to FIGS. 43 to 46 may be provided to alleviate this potential problem.

Light source 16 may in principle be any conventional light source. However, light sources of a more intense or higher output are advantageous, for example ultra-bright light sources such as LEDs. Suitable light sources include incandescent lamps, halogen lamps, dichroic spot lamps, quartz lamps and the like. Infra-red lamps may be used to provide a source, or an additional source, of heat.

Figure 12:
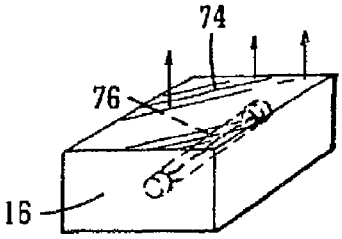
FIGS. 12 and 13 show typical constructions of light sources for use in the apparatus according to certain embodiments of the present disclosure.
Figure 13:
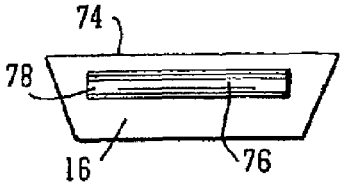

FIGS. 12 and 13 show typical constructions of light sources for use in some embodiments of the apparatus according to the present disclosure. The construction illustrated is particularly suited to halogen and quartz lamps. In these embodiments, the lamps are typically mounted in a housing including a front glass 74. Advantageously, the lamp glass 74 is coloured in a colour suitable for providing the required burning simulation of the fuel bed. Orange and red colours are most often suitable. The glass 74 may also be locally coloured in other colours, such as blues or greens. Alternatively, or additionally, the bulb 76 of the lamp may itself be suitably coloured, such as by painting the bulb with a suitable translucent coloured paint or varnish, or by providing the bulb with a coloured sleeve 78.

Coloured light may be alternatively or additionally provided by using a plurality of coloured light sources in a range of different colours. For example, the apparatus may comprise a plurality of red, yellow, orange, green and blue LEDs, or a plurality of individual light sources such as halogen lamps, each with an appropriately coloured filter.

Figure 14:
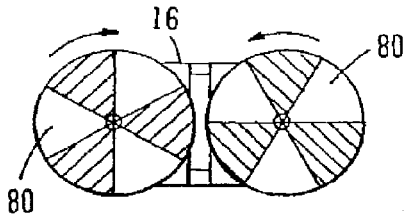
FIG. 14 shows an arrangement for providing light of varying colour or intensity.

In a yet further embodiment illustrated in FIG. 14, alternative means of providing coloured light incident on the underside of the fuel bed 12 are shown. In the arrangement of FIG. 14 a light source 16 emits substantially white light. Arranged above the light source is at least one disc 80. More than one disc 80 is preferred. The disc is configured so that at least a portion thereof is in the path of light from the light source 16 to the fuel bed 12. The disc or discs 80 are divided into different regions which modify the light incident upon them. The regions may simply be different colours, and some regions may be colourless. In other constructions, the some regions may be opaque or partially opaque. Regions may have irregular surfaces so that light incident on them is refracted in different ways. The or each disc 80 is mounted on a driver, such as an electric motor (not shown), which causes the discs 80 to rotate relative to the light source, so that different regions of the discs are presented to the light source in turn. A constantly and seemingly random variation of the intensity and colour of the light illuminating the fuel bed 12 from below can thus be achieved.

In embodiments of the disclosure, the vapour after passing through the fuel bed and serving to simulate smoke and flames of a real fire may simply be discharged to atmosphere. Water vapour is, of course, harmless in this respect. Embodiments of this general construction are shown schematically in FIGS. 16 and 17, the discharge being indicated by arrows D. Each apparatus in FIGS. 16 and 17 includes a fuel bed 12, a vapour generator 14 and one or more light sources 16 as described herein. It is of course desirable that the vapour is so dispersed as not to be apparent to the eye at the time of discharge. In particular embodiments it may be desirable and advantageous to include a second fan or blower 82 mounted towards the location of discharge, typically in an upper part of the apparatus. This second fan 82 ensures that the vapour (which is normally heavier than air) is carried upwardly from the fuel bed in a flow of air, in a manner which effectively simulates real smoke and/or may further effectively simulate flames. However, as will be discussed below, the inventor has found that a second fan may not be the most effective way of providing a rising smoke effect.

Figure 15A:
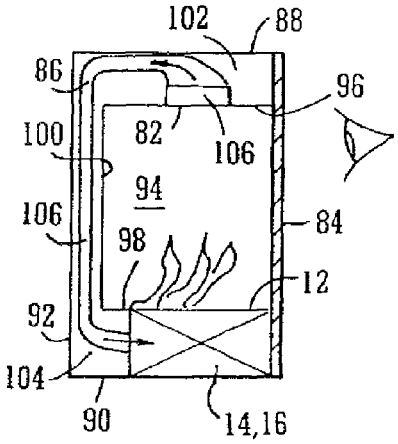
FIGS. 15A, 15B, 15C, 15D, 15E, 15F, 15G and 15H show schematically various arrangements for recycling the vapour produced in the apparatus according to the present disclosure.
Figure 15B:
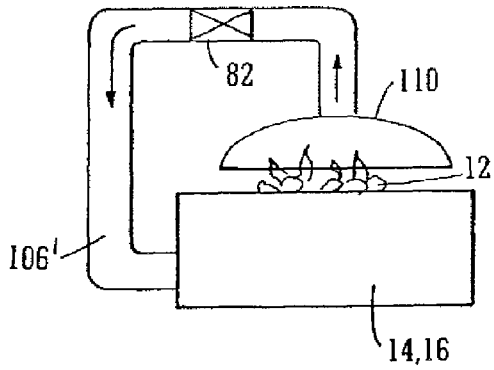
Figure 15C:
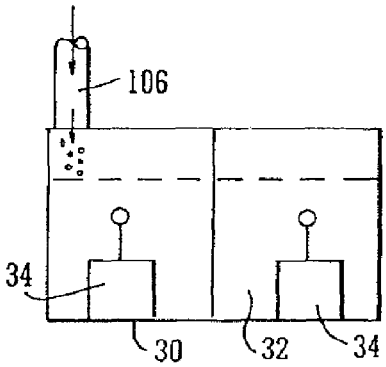

FIGS. 15A, 15B and 15C illustrate alternative arrangements in which the vapour produced by the vapour generator 14, 114 is recycled for further use. In principle, the recycling arrangements involve collection of the vapour, condensing of the vapour and return of the vapour to the body of liquid 32. The embodiment shown in FIG. 15A is a closed unit 86 including a front glass 84 through which the simulated fire is observed. The details of the vapour generator 14, light source 16 and fuel bed 12 are not shown and these may be as described in relation to other embodiments herein. The sealed unit 86 is further defined by top wall 88, bottom wall 90 and rear wall 92. Side walls completing the closed unit are not shown. The simulated combustion space 94 of the apparatus (in other words that portion in which the fire burns, at the foot of a chimney, for example) is defined by internal top wall 96, internal bottom wall 98 and internal rear wall 100 and optional internal side walls which are not illustrated. The internal top wall 96 is spaced apart from the external top wall 88 to define a space or void 102 therebetween. Similarly, the internal rear wall 100 is spaced apart from the external rear wall 86 so defining a void 104. Internal top wall includes an aperture or orifice 106 from which leads a tube, pipe or other conduit 108. A second fan 82 is most preferably disposed within the conduit. The conduit 106 returns vapour to the lower part of the apparatus, during which time the vapour will preferably condense back to liquid. The second end of the conduit 106 communicates with container 30 or the vapour generator (as in FIG. 15C), or with a storage tank such as tank 44.

FIG. 15B illustrates a further alternative embodiment in which the simulated fire apparatus does not comprise a closed unit. In a base part of the apparatus, there is provided a fuel bed 12, vapour generator 14 and like source 16 as described in connection with any of the other embodiments of the present disclosure. Above the fuel bed 12 there is disposed a dome-shaped cover 110. In some preferred embodiments, the cover 110 may be made from a colourless material such as a colourless plastic. In alternative forms, an opaque cover may be employed, for example selected to resemble a metal cover. An upper part of the cover communicates with the entry of a conduit 106'. An extractor fan 82 is desirably provided in the conduit 106'. The conduit 106' returns vapour to the lower part of the apparatus, during which time the vapour will preferably condense back to liquid. The second end of the conduit 106' communicates with container 30 or the vapour generator (as in FIG. 15C), or with a storage tank such as tank 44.

Figure 15D:
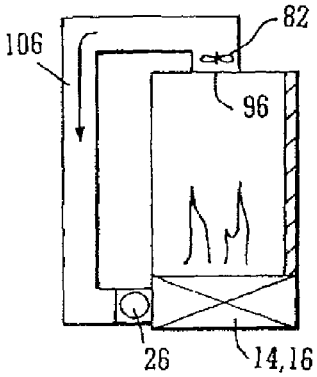
Figure 15E:
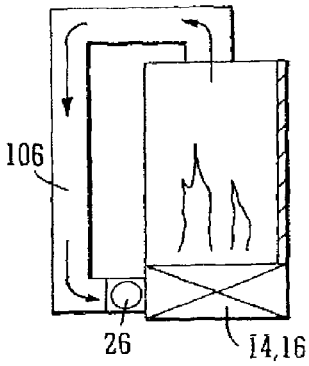
Figure 15F:
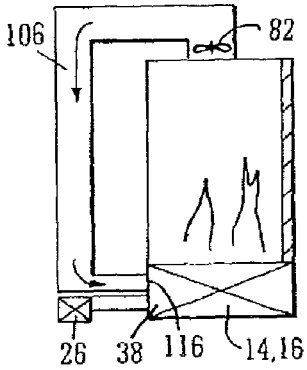

In further variations of the embodiment shown in FIG. 15A, FIGS. 15D, 15E and 15F show different locations where one or more fans may be located. In FIG. 15D the conduit 106 terminates at its lower end at the inlet of fan 26 which in turn communicates with the inlet 38 of the container 30. A second fan 82 is disposed at the end of the conduit proximate the aperture 106 of the internal upper wall 96. In FIG. 15E the second fan 82 is absent and the circulation of air and vapour is driven solely by fan 26. In FIG. 15F, second fan 82 is present, but the arrangement differs from that of FIG. 15D in that the fan 26 is separate from the conduit 106. That is, the inlet 38 of the container 30 is at a different location from the inlet 116 whereat the conduit 106 communicates with the container.

Figure 15G:
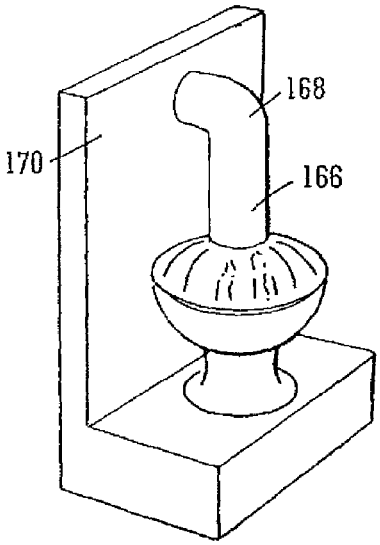
Figure 15H:
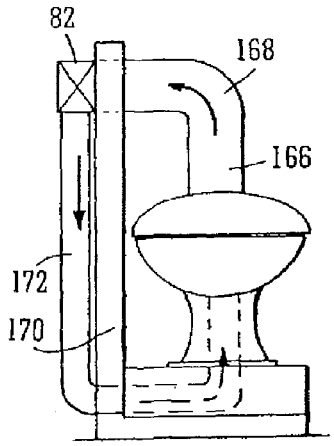

FIGS. 15G and 15H show a further variation wherein the apparatus is mounted against a wall, which is preferably a false (i.e. non-structural) wall. The upper portion of the apparatus is formed to resemble a metal chimney or stove pipe 166 which is angled at its top portion 168 and routed through the wall 170. Behind the wall 170, where it is not visible to a user, is a return conduit 172 which is routed back to the lower part of the apparatus. The stove pipe 166 and return conduit 172 thus provide a pathway for the recycling of vapour back to container 30 or storage tank 44, as appropriate. A fan 82 may preferably be provided in stove pipe 166 or return conduit 172 to assist in the transfer of vapour. The vapour condenses back to liquid along the return pathway.

Figure 21A:
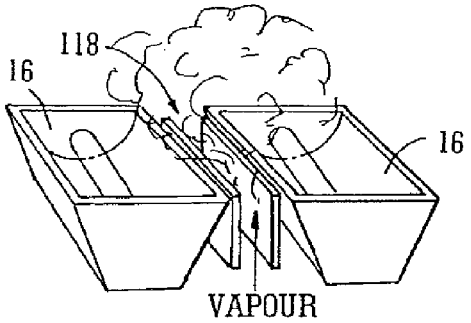
FIGS. 21A and 21B illustrate arrangements of one form of light source or sources and a typical vapour generator in embodiments of the apparatus according to the present disclosure.
Figure 21B:
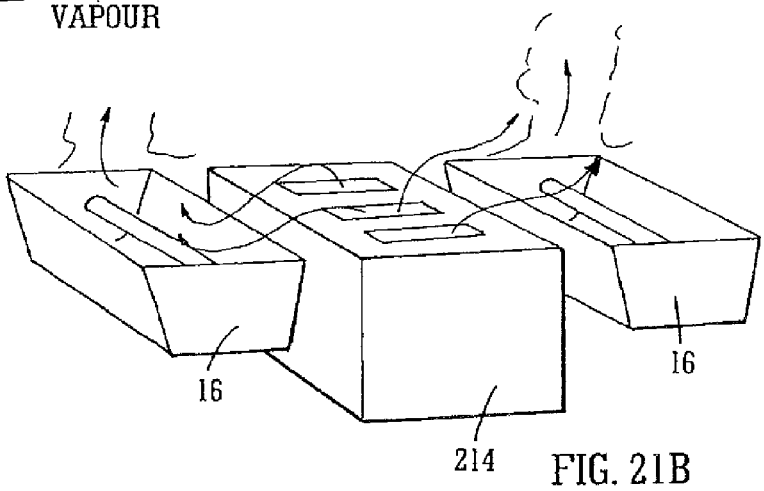

It is well known that many light sources produce large quantities of heat as well as light. In particular embodiments of the present disclosure, typical examples of which are illustrated in FIGS. 21A and 21B, this property is used to advantage. In the arrangement shown in FIG. 21B a vapour generator 214, the construction of which may be, for example, as described in relation to vapour generators 14, 114 is placed directly between a pair of light sources 16. Of course, more than two light sources 16 (such as halogen spot lights or the like) may be placed around the vapour generator 214. The heat emitted by the light sources 16 causes a rising air current which assists in carrying the vapour emitted by the generator 214 along an upward path, providing further realism in the simulation of a real solid fuel fire. The arrangement shown in FIG. 21A is similar in essence, except that the vapour generator is not located directly between the light sources 16. A transfer conduit 118 having an outlet 120 transfers the vapour from the outlet 28 of the container 30 to a point proximate a plurality of light sources 16 (or adjacent a single light source).

FIGS. 16 and 17 illustrate particular examples of the construction described above. In the embodiment illustrated in each of these two Figures, the apparatus is provided with a vapour generating apparatus 14 of the nature described herein located in a lower part of the fire, below a fuel bed 12. The vapour output of the vapour generator 14 is proximate a light source 16, or a plurality of light sources 16, as described in connection with FIGS. 21A and 21B. The heat emitted by the light source provides a rising air current which assists in carrying the vapour upwardly through the apparatus. An additional heat source may be provided beneath the fuel bed 12 if required. The fan 82 located at an upper part of each respective apparatus may if necessary further provide an upward flow of air in which the vapour is carried, but the heat generated by the light source or sources 16 is often sufficient. The air which has been warmed by the light source and, if present, an additional heat source, is emitted from the apparatus to the room and provides some space heating. In another alternative, the fan 82 may be replaced by, or may be a part of, a fan heater of conventional construction whereby heated air is emitted to the room in which the apparatus is located.

Figure 19A:
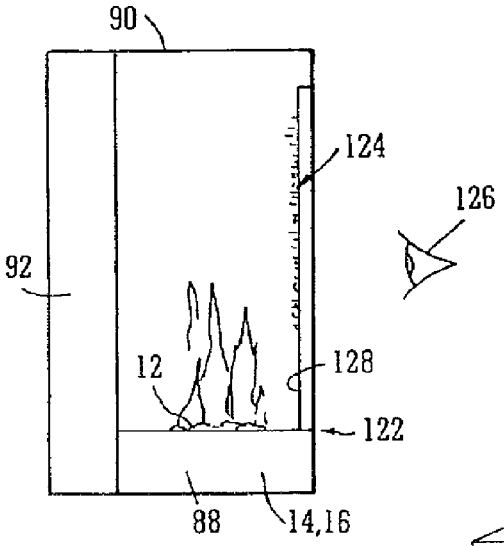
FIGS. 19A and 19B show further embodiments of the apparatus according to the present disclosure.
Figure 19B:
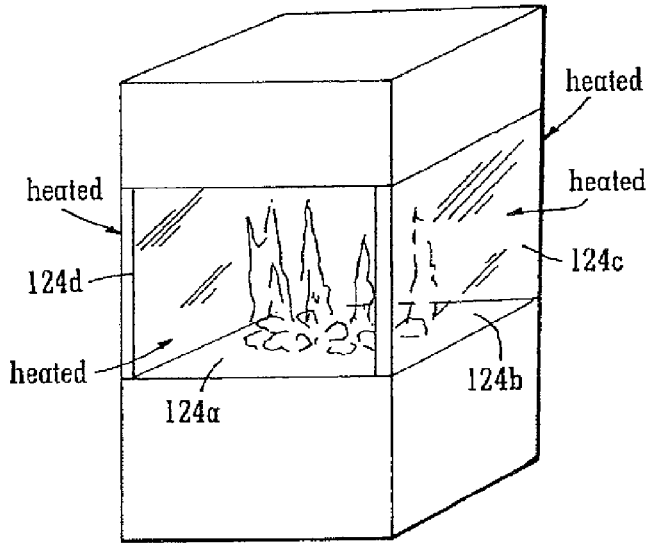

FIGS. 19A and 19B are illustrative of a further advantageous feature which may be included in apparatus according to the present disclosure. FIG. 19A shows a simulated fire apparatus suitable for locating in, for example, a fireplace at the foot of a chimney—a so-called "inset" fire. The apparatus includes top, bottom, and rear walls 90, 88, 92 as in the fire shown in FIG. 15A together with a vapour generator 14, light source 16 and fuel bed 12 of the types described herein. Side walls are also present but not shown. A front wall 122 is at least partially defined by a glass panel 124 through which a user 126 observes the simulated fuel bed. A potential problem in using vapour for the simulation of smoke is that the vapour may condense on the glass panel. Accordingly, this embodiment of the present disclosure uses a glass panel 124 which is heated to a temperature sufficient to deter or eliminate such condensation. In one variation, the glass panel 124 is provided with a substantially transparent thin film resistance heater. Such films are known in the art of heating. The heat source thereby resulting is of relatively low power but will also have the added advantage of providing low level space heating to the room in which the apparatus is located. In an alternative arrangement, the glass panel 124 is heated by providing a flow of warmed air across its internal surface 128. The flow of heated air may be generated by a fan heater located at the base of the apparatus and discharging warm air through apertures in the fuel bed close to the lowermost parts of the glass panel 124.

The arrangement in FIG. 19B is similar in principle, with the exception that the apparatus is designed to be either free-standing or to rest against a wall. The apparatus is provided with two or more glass panels. In the embodiment illustrated, four such glass panels 124*a*, 124*b*, 124*c* and 124*d* are provided. Each is heated as described above in connection with FIG. 19A.

As indicated above the vapour generator 14, 114 according to the present disclosure generates clouds of vapour which are transmitted by the means indicated through the fuel bed 12. The vapour rises above the fuel bed 12 and resembles the smoke of a real solid fuel fire. However, the simulation achieved by the apparatus of the present disclosure has further advantageous features. In particular, the apparatus of the present disclosure seeks to simulate flames by locally illuminating the vapour rising above the fuel bed 12. The illuminated vapour gives the impression of flames rising above the fuel bed 12. Particular reference is made in this respect in particular to FIGS. 1, 18 and 20.

As noted above, the vapour generator 14, 114 emits vapour from outlet 28, most preferably with the assistance of a fan 28. The vapour preferably exits proximate one or more light sources 16, the heat from which assists in providing a rising air flow on which the vapour is carried. The vapour is directed through a vapour guide 22 or cowl 68 (these terms may be synonymous) and through or around light filters 20*a*, and 20*b* (and others if required) before reaching the fuel bed. The path of the vapour may be further guided by a vapour guide the same as, or similar to vapour guide 62 in FIG. 11B. In the embodiment illustrated, red or orange light falls on the inner part of the fuel bed and blue light falls on outer portions of the fuel bed 12. The filters 20*a*, 20*b* and any additional filters may be arranged to give different areas of the fuel bed 12 different colours.

In the illustrated embodiment (see FIG. 1), the fuel bed 12 includes a substantially planar supporting plate 130 which is preferably at least locally translucent. Plate 130 may, for example be made from glass or translucent plastic. Thus light from the light source(s) 16 as coloured by the filters 20 is transmitted, at least in selected regions, through the plate 130. The plate 130 includes a large central aperture 132 above which rests a grate 136 containing simulated solid fuel pieces 138. Simulated logs are illustrated, but coals or other fuel could equally be employed.

The large aperture 132 in plate 130 is optional, provided that a suitable pathway is provided for the vapour, and the light from the light source. For example, for the simulation of other types of solid fuel fire the grate 136 and the large aperture may be absent, and a pile of simulated fuel pieces 138 may rest directly on the plate 130. Smaller vapour transmitting apertures are then provided beneath the fuel pieces 138. in other variations, simulated fuel may be replaced by other decorative or aesthetically pleasing articles such as stones (e.g. pebbles) or glass beads.

In a further alternative, the plate 130 may be replaced with a plastic moulding shaped and coloured to resemble an ember bed on which simulated fuel pieces 138 rest. The plastic moulding includes apertures for the transmission of vapour.

In any of the above constructions, the apertures (including the large aperture 132 if present) are so placed that vapour passing through the fuel bed 12 exits below and around the fuel pieces 138, thereby to resemble smoke and/or simulate the effect of flames. The apertures are positioned such that (in combination with other elements of the fuel bed) they are not visible to an observer.

Referring more especially to FIGS. 1 and 18, the inner or middle portion of the fuel bed is illuminated with red or orange light to provide the general glowing effect of a real burning fire. Outer regions are illuminated with blue light (as illustrated) or with other colours such as green, red or orange. The plate 130 (or, as the case may be, the plastic moulding) is provided with local apertures 140 through which vapour rises and through which light passes. Thus the vapour passing through the apertures 140 is locally and selectively illuminated by red, orange blue or green (or other suitable colour) light from light source(s) 16 and this provides the effect of flames locally rising from the fuel bed 12. Vapour emerging from below and around the fuel pieces 138 is similarly illuminated to give the appearance of flames.

In particular arrangements means 18 are provided for further modifying the light from light source(s) 16 to provide an intermittent illumination or flicker effect which is preferably random, or pseudo-random so that it is perceived by a user as being random. One embodiment of such a light modifying means 18 comprises one or more elements such as members 142 (FIG. 1) which are moved in the path of light from light source(s) 16. The members may be opaque, partially opaque or locally opaque. Conveniently the members are rotated about an axis such as by a motor. Other possible arrangements include a plurality of reflective elements arranged about a shaft which is caused to rotate about its axis. Alternatively, or additionally, where a plurality of light sources is provided, a control means may be used to vary the illumination provided by given light sources, that is by switching particular light sources on and off in sequence and/or by varying in sequence the intensity of the light emitted by particular light sources. The light modifying means thus enable the simulation of the changes in intensity of glowing and in the intensity and position of flame which occur in a real burning fire. With particular reference to the simulation of flames, where light passing through a given local aperture 140 is interrupted by means 18, the flame at that aperture will effectively disappear while the light is interrupted.

In a preferred arrangement of the fuel bed, pieces 144 of transparent or translucent material made, for example from resin, glass or plastic, are arranged around the apertures 140. The pieces 144 may be coloured, for example red, orange or blue. These pieces are illuminated by light from light source (s) passing through local regions of the plate 130 and/or apertures 144 and provide, preferably in conjunction with light modifying means 18, a glowing ember effect. Portions of the pieces 144 may be coated or otherwise coloured with darker and/or opaque material (e.g. paint) to enhance the ember effect. The greater the relative amount of the dark coating, the lesser is the glowing ember effect. In other words, pieces 144 with a greater degree of dark coating resemble fuel pieces at later stages of burning, that is, when the fuel pieces become burnt out. In preferred arrangements which provide a particularly good simulation the proportion of darker pieces (which may also include grey (gray) colouring to resemble ash) is increased in regions of the fuel bed 12 radially further away from the centre of the simulated fire, thereby to simulate cooler more burnt-out regions of the fire.

FIG. 18 shows in particular large aperture 132 arranged above red/orange filter 20*a* and smaller local apertures 140 arranged further away from the centre of the simulated fire and above the blue filter 20*b*. Glass or resin pieces 144 coloured orange are arranged close to the apertures 140 and pieces 144*a* coloured dark or black and grey to resemble pieces of substantially burnt fuel are arranged directly at the apertures 140. Vapour passing through apertures 140 is coloured predominantly blue and thus resembles the small blue flames 146 often seen at the margins of a burning fuel bed. Greater quantities of vapour pass though central aperture 132 and are coloured predominantly red or orange, providing a simulation of the primary flames 148 of a burning fire.

Figure 22A:
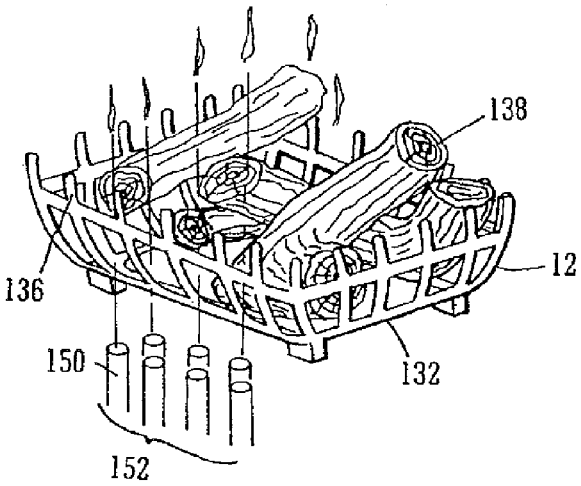
FIG. 22A shows a further alternative arrangement of a fuel bed in a simulated fire apparatus according to the present disclosure.
Figure 22B:
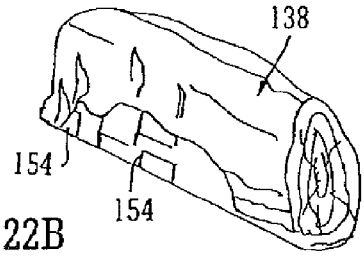
FIG. 22B shows one embodiment of a fuel piece or element suitable for use in embodiments of the present disclosure.

FIG. 22 illustrates an alternative or additional technique for illuminating the fuel bed 12, and in particular for illuminating vapour rising from the fuel bed 12 to give the impression of flames. In the embodiment illustrated in FIG. 22 one or more lasers 150 or banks of lasers 152 (such as laser diodes) is/are arranged beneath the fuel bed 12. The lasers 150 are arranged to direct a laser beam upwardly through the fuel bed. A respective laser beam may be aligned with a respective local aperture 140, or at least one bank of lasers 152 may be aligned with the large central aperture 132 beneath the fuel pieces 138 in the grate 136. The lasers emit a particularly intense and localised light beam which is effective in simulating flames and also in simulating rising sparks which intermittently appear. These effects can be seen when the laser beam falls on vapour rising through an aperture 132, 140 in the fuel bed 12. In preferred configurations, portions 154 of the sides and undersides of the fuel pieces 138 can be treated with light reflecting material (such as reflective foils or varnishes). The laser beams are directed to such portions whereby the sparking and glowing effects of the fuel pieces 138 are enhanced. The lasers 150, 152 are preferably controlled individually or in groups by a suitable electronic controller such that the lasers operate in a random, pseudo-random or other pre-set pattern. The lasers 150, 152 may be used in addition to the light sources 16 as described above.

Figure 23:
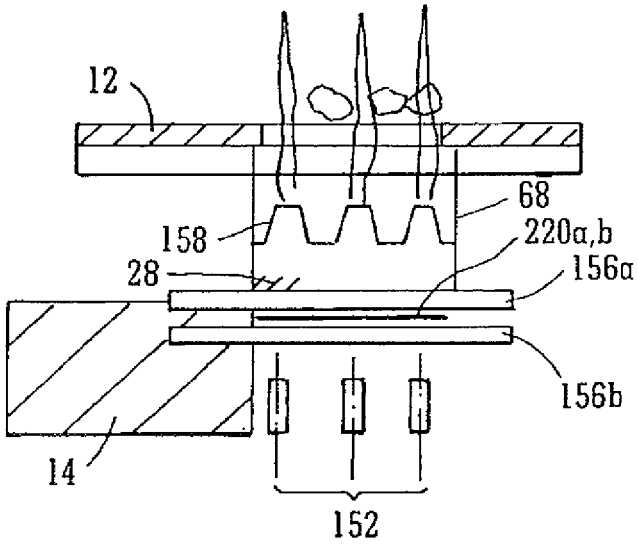
FIG. 23 shows schematically a further alternative construction of an apparatus of an embodiment of the present disclosure.
Figure 24:
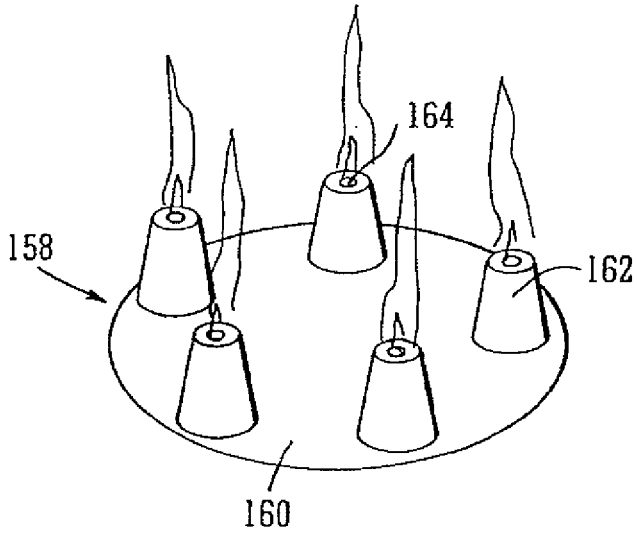
FIG. 24 shows further detail of a fuel bed component for use in the construction of FIG. 23.

FIGS. 23 and 24 illustrate a further alternative fuel bed for an apparatus according to the present disclosure which also makes use of lasers. In this arrangement a cowl 68 is arranged below fuel bed 12. A pair of translucent plates 156*a*, 156*b* made, for example, from glass or transparent or translucent plastic is arranged at the foot of the cowl 68. Blue and red/orange light filters 220*b*, 220*a* are sandwiched between the plates 156*a*, 156*b*. In an alternative configuration, a single plate 156 may be used, the plate being coloured blue and red/orange as appropriate, or having blue and red/orange filters arranged in close proximity thereto. The output 28 of the vapour generator 14 is arranged at a lower part of the cowl 68, above the plate(s) 156, so that the vapour enters the cowl 68 and rises to and through the fuel bed 12. One or more individual lasers 150 or one or banks of lasers 152 is arranged beneath the plate(s) 156. A vapour guiding element 158 is arranged within the cowl 68. The vapour guiding element 158 is preferably substantially sealingly engaged with the walls of the cowl 68, so that the vapour is constrained to pass only through pathways defined by apertures in the element 158. The element includes a planar, or at least approximately planar, base portion 160 from which depend upwardly directed formations 162 which in the illustrated embodiment are approximately frusto-conical. Other formation shapes can also be appropriate. An aperture 164 is provided at the upper face of the formations 162. Thus vapour rising through the cowl 68 is constrained to pass only through the apertures 164. The vapour thus rises through the fuel bed 12 in defined locations which are selected to correspond with desired locations of the fuel bed 12 for the emission of simulated smoke and/or simulation of flames, typically at lower side portions of fuel pieces 138.

It will be readily appreciated that the embodiments shown in FIGS. 22, 23 and 24 provide useful simulations of burning solid fuel in the absence a smoke simulation, as provided by vapour generator 14. Nevertheless a significantly enhanced effect is achieved by using the vapour generator 14 to allow a smoke and flame effect.

Figure 25:
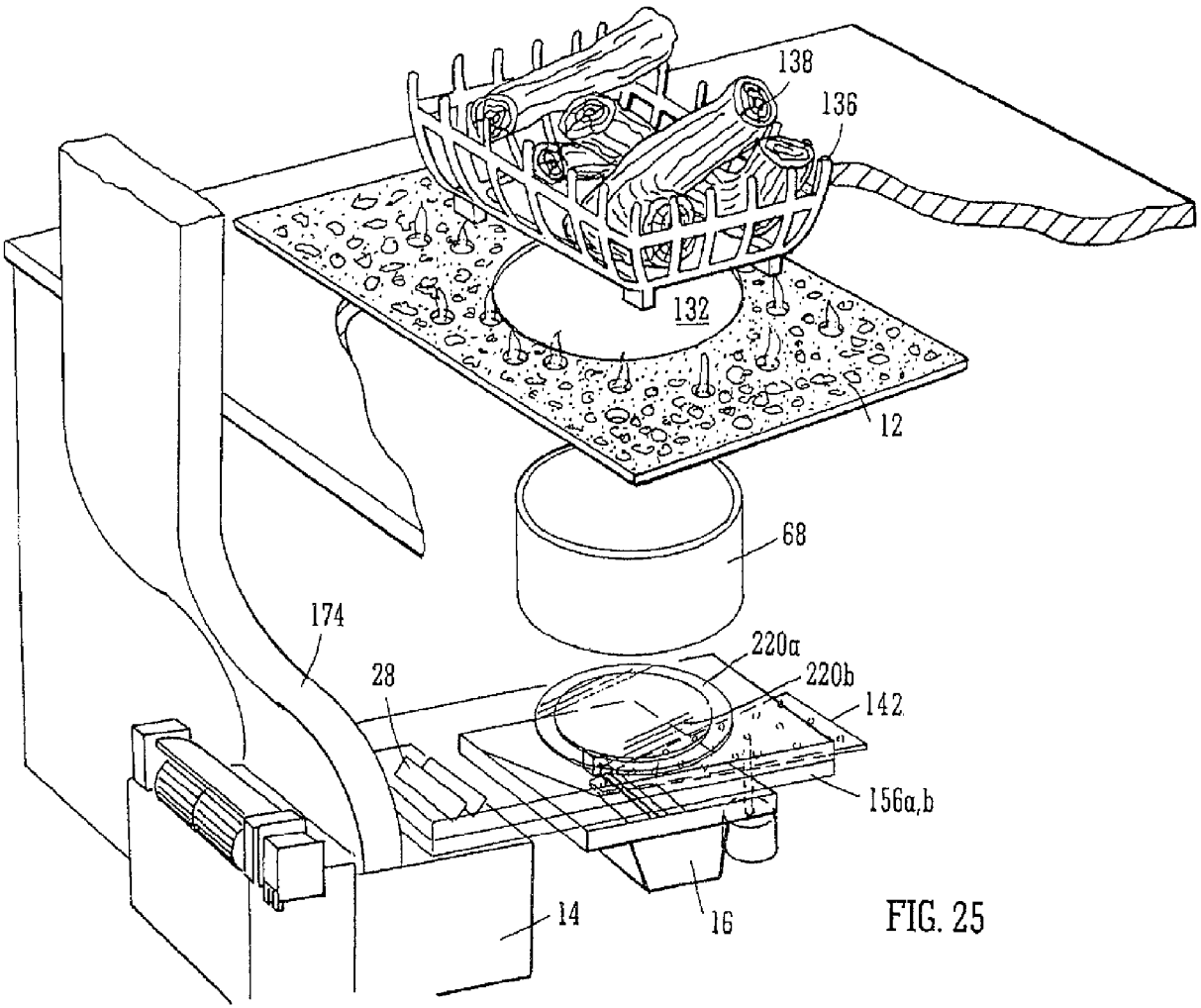
FIG. 25 shows a further alternative construction, similar to that of FIG. 23.

FIG. 25 illustrates an arrangement similar to that of FIG. 23. In this arrangement, lasers 150, 152 are not used (but could be included if desired). The apparatus includes a light source 16 (or a plurality of light sources), a vapour generator 14 having an outlet 28 proximate the light source 16 and including a fan 26 for urging air through the vapour generator 14. A pair of transparent plates 156*a, b* which sandwich coloured (blue and orange/red) filters 220*a, b* as described in connection with FIG. 23 are arranged above light source(s) 16. Plates 156*a* and 156*b* may be replaced by a single plate 156 as described above. A cowl 68 is provided, extending between the plate 156*a* and the underside of the fuel bed 12. Outlet 28 of the vapour generator 14 opens into a lower part of the cowl 68 above the plate 156*a*, so that the vapour is constrained to pass only through the cowl 68 to the fuel bed 12. In the embodiment of FIG. 25 a grate 136 containing fuel pieces 138 is shown mounted above an aperture 132 in a translucent supporting plate 130. Other configurations of the fuel bed 12 may alternatively be used. A light modifying means 18 as described above is also preferably incorporated, most especially between the plate 156*b* and the light source 16. Optional pipe or conduit 174 indicates a vapour recirculation path back to container 30 of the vapour generator 14, or to a tank 44.

Figure 26:
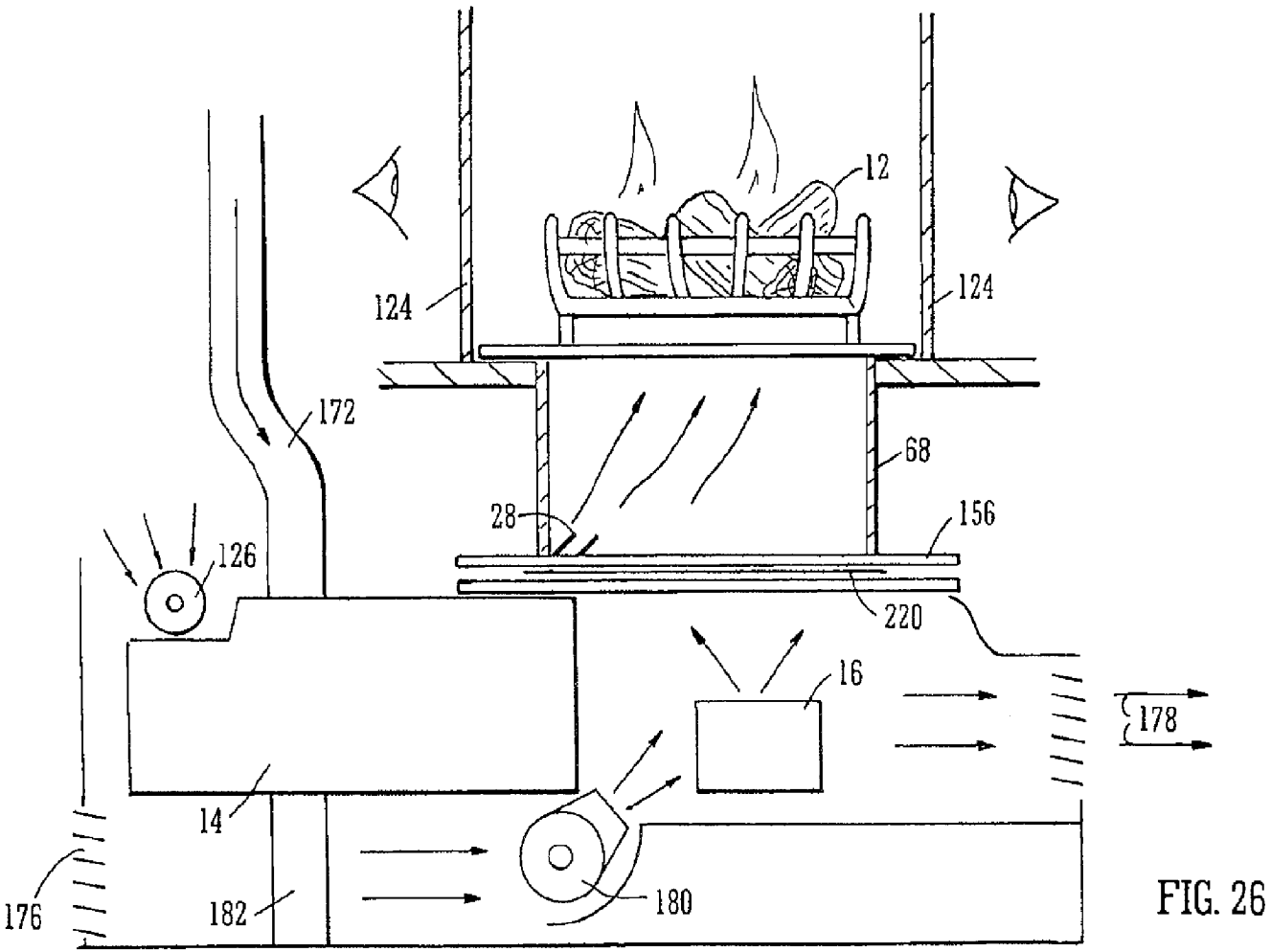
FIG. 26 shows a further variation of the apparatus according to embodiments of the present disclosure wherein an output of warmed air for space heating is provided.

The embodiment illustrated in FIG. 26 is similar to that of FIG. 25 but includes enhanced means for providing a warm air output for space heating. The principles of the heating arrangement shown in FIG. 25 are also applicable to other embodiments. In FIG. 26 a light source is arranged below transparent or translucent panels 156*a, b* which sandwich filters 220*a,b* as previously described. A cowl 68 is provided between the plate 156*a* and the underside of the fuel bed 12. A vapour generator 14 has an outlet 28 arranged at a lower part of the cowl 68 so that vapour is emitted into the cowl and rises through the fuel bed 12. A fan 26 urges air to flow through the vapour generator 14 and thence through the cowl 68. The apparatus of FIG. 26 further includes an air inlet 176 and an air outlet 178 with an air flow path therebetween. A fan 180 is arranged operatively to draw air in to the apparatus through inlet 176 and to expel air from outlet 178. The air flow path is so constructed or configured that the light source 16 lies in the air flow path. As noted above, the light source 16, which may in some embodiments be a 1000 W light source, produces significant amounts of heat. By directing air over the light source, the light source is cooled and warm air is vented to the room for space heating. The arrangement shown in FIG. 26 may also include one or more heated glass panels 124 which in addition to avoiding vapour condensation on the internal surface thereof provide useful space heating. An optional return conduit 172 for recycling of vapour may also be provided. In a further variation, an air filter 182 may also be provided, preferably close to inlet 176.

Figure 27:
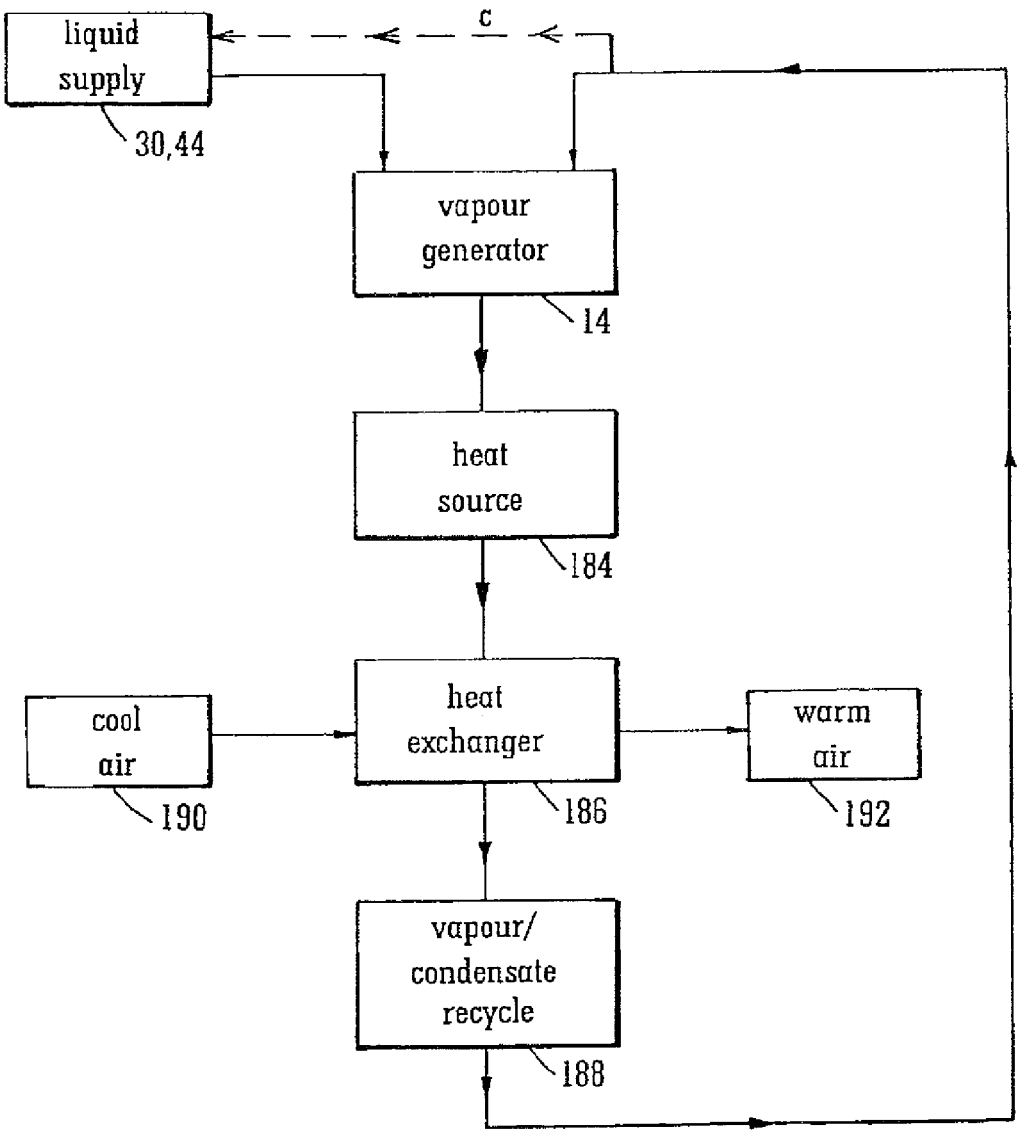
FIG. 27 is a flow chart illustrating the principles of a heat exchange system for an apparatus according to embodiments of the present disclosure.
Figure 28:
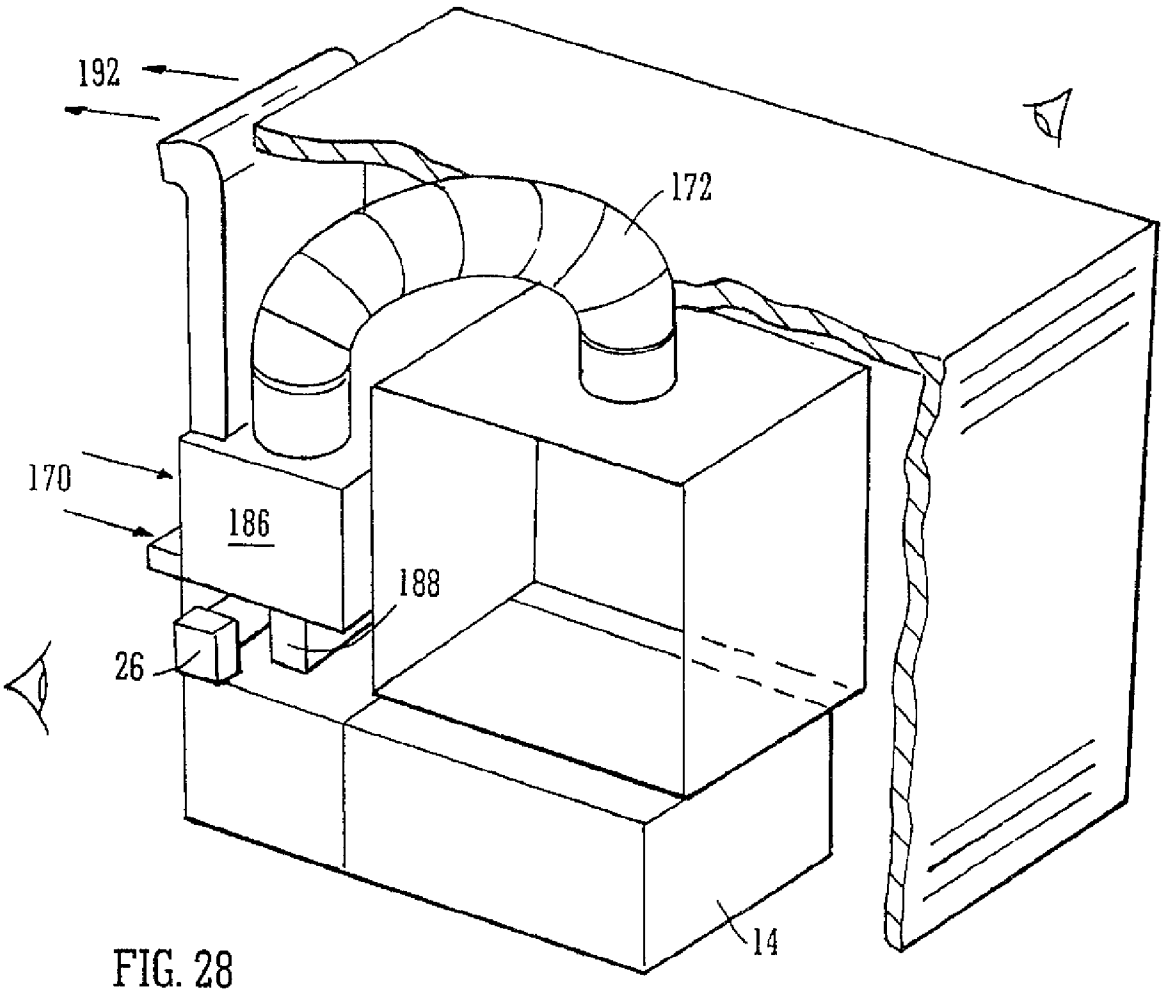
FIG. 28 is a schematic illustration of an apparatus according to embodiments of the present disclosure including a heat exchanger.

For increased efficiency of the apparatus according to the present disclosure, a heat exchange system may be provided to extract heat from the vapour, and from air in which the vapour is entrained, after the vapour has passed through the user-viewable portion of the apparatus. Reference is made in this respect to FIGS. 27 and 28, and initially in particular to FIG. 27. In this apparatus, a vapour generator 14 as described herein is provided. The vapour emitted by the vapour generator acquires heat from a heat source 184, and/or the vapour is allowed to mix with air which has been heated by a heat source 184. A suitable heat source is a light source 16 such as one or more halogen or quartz bulbs. After passing through fuel bed 12, the warmed air with the entrained vapour is captured as described above in relation to vapour recycling steps and transmitted (with the possible assistance of a fan) through a suitable conduit to a heat exchanger 186. In the heat exchanger, heat is extracted from the air and entrained vapour and the vapour is condensed. Condensate is returned to the vapour generator 14, or to a liquid supply for the vapour generator (indicated by arrow C in ghost lines). Cool air 190 from the space (room) to be heated is drawn into the apparatus, such as by a fan and passed through the heat exchanger 186. Heat from the warmed air and vapour which has passed through the fuel bed is extracted to the cool air so that the air is warmed, and the warm air 192 is expelled into the room for space heating. Further details of a specific embodiment can be seen in FIG. 28 in which components are given the same reference numbers as for FIG. 27.

Figure 29:
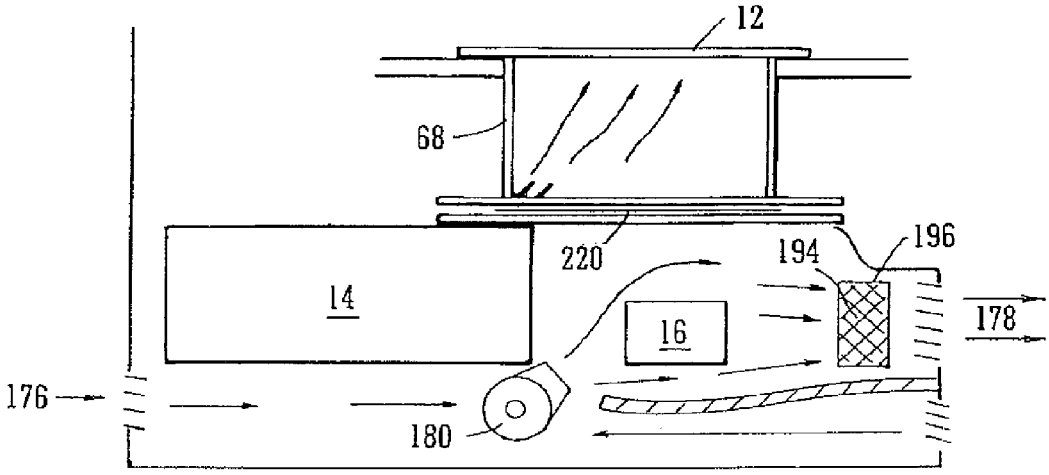
FIG. 29 is a schematic illustration of a simulated fire according to embodiments of the present disclosure for use with a "wet" heating system.

FIG. 29 shows a variation of a simulated fire apparatus according to the present disclosure which includes a space heating arrangement of the so-called "hydronic" type. Hydronic heaters employ heated water, most usually as a part of a "wet" central heating system in which water is heated by a boiler or stove and piped to radiators dispersed around a building. In the apparatus of this embodiment, one or more pipes having a flow of heated water pass through the apparatus of the disclosure. A heat exchange arrangement (heat exchanger) is provided within the housing of the apparatus. The heater exchanger may be a portion of the or each pipe which is provided with an increased surface area, such as by having fins or the like 196. A flow of air from an air inlet into the housing 176 to an air outlet 178 is provided by a fan 180. The air flow path between the inlet 176 and outlet 178 is configured so that the air flows over the heat exchanger 194 and so is heated by the heat exchanger 194. Warmed air is thus expelled from the apparatus through outlet 178 for space heating. In an advantageous arrangement, one or more light sources 16 are also arranged in the air flow path so that, as described in connection with FIG. 26, the flow of air provides a cooling effect for the light sources and also boosts the heat output by the warm air for space heating.

Figure 30A:
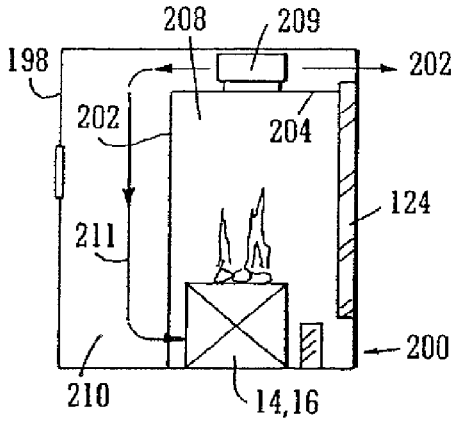
FIGS. 30A and 30B are schematic illustrations of simulated fires according to embodiments of the present disclosure including further means for recycling vapour.

FIG. 30A shows a further variation of a simulated fire according to the present disclosure including means for recycling vapour produced by the vapour generator. In the illustrated embodiment, the apparatus comprises a housing having an air inlet 200 and an air outlet 202. The apparatus comprises a vapour generator 14, fan 26, light source 16 and fuel bed 12 in any of the forms previously described. The housing includes a front glass panel through which the fuel bed may be observed. The glass panel is preferably a heated panel 124. The housing 198 includes internal dividing walls 204, 206 so that it is internally divided into separate regions, that is, a first region 208 containing fuel bed 12 and observable by the user and a second region 210 which is not observable by the user. This aspect of the construction is broadly the same as that illustrated in FIG. 15A. Thus vapour generated by vapour generator 14 is fed to the fuel bed 12 and rises above the fuel bed 12 to simulate smoke and flames. The vapour may be carried upwardly in a current of warmed air from the light source 16. A fan 82 may desirably be provided at an upper portion of the apparatus, to draw the vapour, and the air in which the vapour is entrained, upwards and into void above wall 204. The apparatus further comprises a condenser 2090 conveniently arranged in the void 210. The condenser 209 acts to cool the vapour and condense it back to liquid. The condensed liquid is then transferred back to container 30 of vapour generator or to a storage tank 44 along a suitable flow path 211, which is conveniently a pipe of relatively small diameter.

Figure 30B:
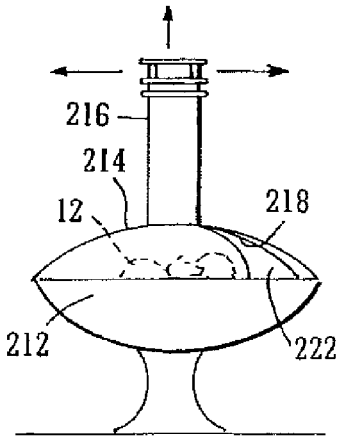

FIG. 30B shows a variation applied to a free standing stove or hearth, which may, for example be positioned in a room spaced away from a wall. The apparatus comprises a base 212 which includes functional components such as the vapour generator 14, light source 16, fan 26, filters 20, 220 etc., and which supports the fuel bed 12. A dome-shaped cover 214 is provided above the fuel bed, the purpose of which is largely aesthetic, but also serves to prevent or minimise the escape of vapour and allows the direction of movement of the vapour to be controlled so that it is primarily upward. A simulated chimney 216 extends upwardly from the cover 214. The cover 214 may desirably, but not essentially be transparent. The chimney 216 is preferably opaque and coloured to resemble metal (e.g. iron). A fan for drawing the vapour upwards and a condenser are disposed in the chimney 216. A flow path for condensed liquid is provided down the interior of the chimney 216. In a particularly advantageous feature, the cover 214 is provided with an access door 218, such as for re-arrangement of the fuel bed or maintenance of the components in the base 212. The door frame or trim 222 is configured or adapted to provide a flow path for condensed liquid returning to the vapour generator 14, such that the flow path is not readily observed by a user.

Figure 31:
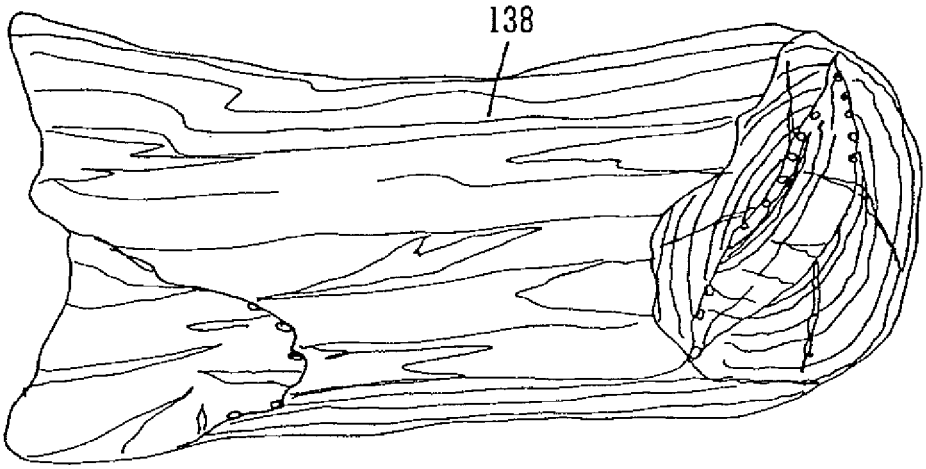
FIG. 31 is a representation of a typical simulated log for a fuel bed of the apparatus according to the present disclosure.

As described, the fuel bed 12 of the embodiment depicted is provided with a plurality of simulated logs 138 resting in a grate 136. However, the disclosure is equally applicable to a fuel bed 12 comprising other solid fuels such as coal, peat or the like. In the illustrated embodiment the logs 138 are laid together, preferably in a predetermined arrangement to closely resemble logs of a solid fuel fire. Various materials may be used for the manufacture of the logs 138, generally as known in the art. For example, techniques are known in the art for producing mouldings from polyurethane or similar foam materials or from coloured or colourless resinous materials. The moulds are constructed to produce logs 138 of the desired shape and the resulting log shapes are painted or otherwise coloured to resemble real logs. The logs 138 may desirably at least partially translucent, or translucent in particular regions, to enhance the impression of glowing, burning logs when illuminated from below. The logs 138 of the disclosure are shaped to resemble a natural set of logs on a real fire as shown in FIG. 31. Preferably, of course, the shapes of the respectively logs are carefully determined so that they sit together securely in a predetermined arrangement which offers the most realistic impression.

Figure 32:
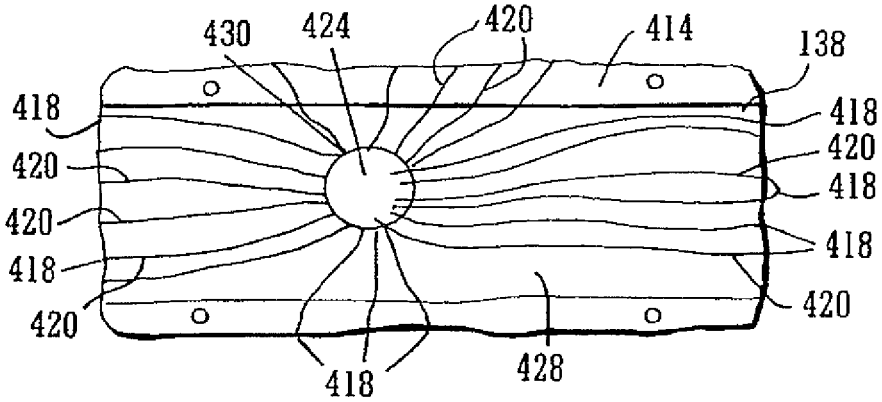
FIG. 32 is a plan view of an inner face of one part of an embodiment of a simulated log having a two-part construction for a fuel bed of the apparatus according the present disclosure.
Figure 33:
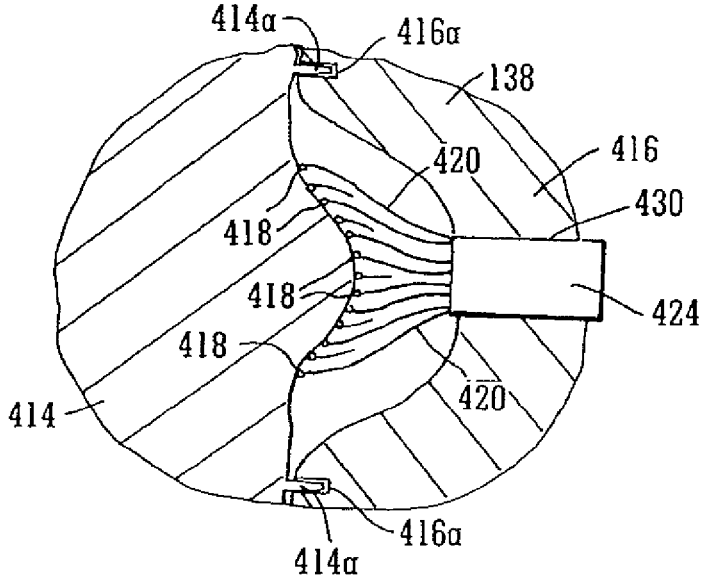
FIG. 33 is a cross-section through the embodiment of a simulated log having a two-part construction for a fuel bed of the apparatus according to the present disclosure.

In preferred embodiments of the disclosure at least some logs 138 of the disclosure are formed in two parts, such as an upper part and a lower part or a front part and a rear part. One part 414 of a log 12 is shown in FIG. 32 and front and rear parts 414, 416 are shown together in FIG. 33. The respective parts 414, 416 are joined together in use so that the log 138 appears to be a single entity, that is, so that the join between the respective parts is not readily apparent to a user. The parts 414, 416 may be joined together by any suitable means. In the illustrated example (FIG. 33) co-operating formations are formed on the respective parts 414, 416. Part 414 includes a number of projections 414*a* and part 416 includes corresponding recesses 416*a* which receive the projections 414*a*. In an alternative arrangement, the parts 414, 416 may be adhered together.

Figure 37:
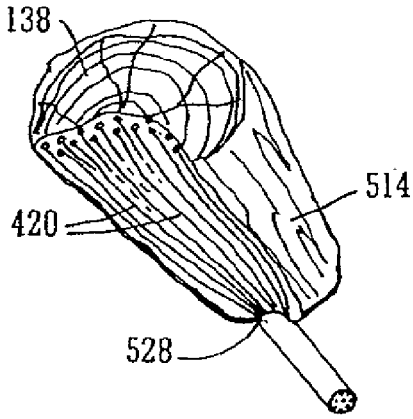
FIG. 37 is a representation of a second embodiment of a simulated log having a unitary construction for use in the fuel bed of the apparatus according to the present disclosure.

In an alternative embodiment of the disclosure, at least some logs 138 are unitary elements, i.e. they are formed in one-part. A log having a unitary body part 514 is depicted in FIG. 37.

The logs preferably employ fibre optics to further provide an enhanced simulation of a real fire. Ends 418 of the fibre optics 420 are exposed at the surface of the assembled logs 138 so that the ends 418, and the light emitted from the ends 418, may be viewed directly by a user. The unitary or two-part construction of the logs 138 enables this arrangement to be achieved.

Figure 34:
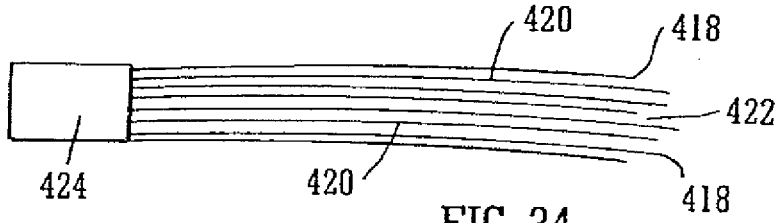
FIG. 34 depicts a typical initial arrangement of a group of fibre optic cables for use in the present disclosure.

Referring to FIG. 34, the fibre optics 420 are arranged into a group or bunch 422 and are gathered together at one end 424 by any suitably permanent means, such as binding with a resin or other curable material. As will be described in more detail below, the end 424 is arranged in use near to a light source 426. The optic fibres 420 are, of course, flexible.

Figure 36:
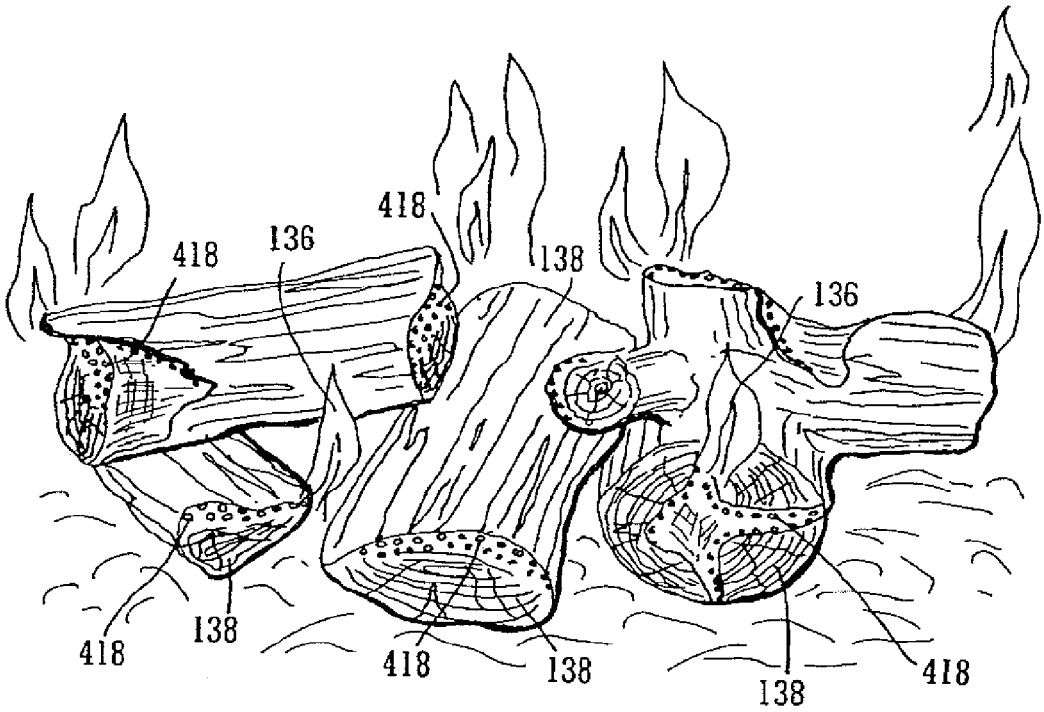
FIG. 36 depicts an arrangement of a group of simulated logs forming a fuel bed of the apparatus according to the present disclosure.

When the logs 138 comprise a two-part construction, the fibres are arranged over an internal surface 428 of the log part 414, 416 (i.e. on a surface which is not visible when the log 138 is assembled from parts 414, 416) so that they extend to chosen points at or near the outer surface of the part 414, 416. See FIGS. 32 and 33. The log 138 assembled from the parts 414, 416 may have a hollow interior and the optic fibres 420 may be disposed along any selected routeing within that interior. Thus the fibres 420 terminate at or near the outer surface of the log 138 and, during manufacture may be trimmed to the appropriate length if necessary. If necessary, the optic fibres 420 are secured in their desired locations by any suitable means such as adhesive, stapling, pinning, taping with adhesive tape and so on. On assembly of parts 414, 416 to form a log 138, the optic fibres 420 are "sandwiched" between the respective parts 414. Thus the optic fibres 420 are not themselves visible to a user, although their ends 418 are just sufficiently exposed at the junction between the parts 414, 416 to enable light emitted from them to be directly perceived by a user and, if desired to illuminate the smoke rising through the fuel bed to provide the illusion of flames, as shown in FIG. 36. The parts 414, 416 may be constructed so that the log 138 has a complex external shape including cavities and protrusions, in order to better resemble a real log. The optic fibres 420 may be arranged so that their ends are relatively isolated, or several ends 418 may be grouped together to provide local regions of greater light intensity, such as in said cavities or at said protrusions. Where the fibres 420 terminate at ends 418 within a cavity of the log 138 the optic fibres 420 may extend beyond the surface of the log 138 (i.e. the surface of the part 414 or 416). Bearing in mind that the log 138 is arranged in use in a specific orientation only the very ends of the fibres may nevertheless be visible to a user.

Figure 35:
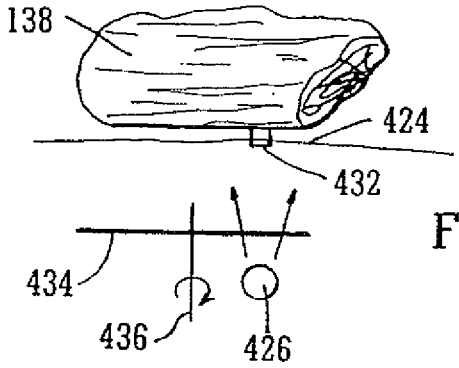
FIG. 35 depicts a typical arrangement of a simulated log on an ember bed for the apparatus according to the present disclosure.

One side of one of the parts 414, 416 which is not visible to the user when the part 414, 416 is placed on the fuel bed is provided with an aperture 430 through which the fibre optics 420 pass. Conveniently, the end 424 of the bunch 422 of fibre optics 420 may be mounted in the aperture 430. As may be seen from FIG. 35, the end 424 of the optic fibre bunch 422 may also pass through a corresponding aperture in an ember bed (if provided). The apertures and the end 424 may be sized to be a friction fit with one another so that they serve to locate the assembled log 138 in its desired location on the fuel bed.

If the logs 138 comprise a unitary construction, then the optic fibres are alternatively arranged over an internal surface 528 (i.e. on a surface which is not visible when the log 138 is mounted for use) so that they extend to chosen points at or near the outer surface of the body 514. The optic fibres 420 may be disposed along any selected routing along the internal surface. The optic fibres 420 terminate at or near the outer surface of the log 138 and, during manufacture they may be trimmed to the appropriate length if necessary. If required, the optic fibres may be secured to their desired locations by any suitable means such as adhesive, stapling, pinning, tapeing with adhesive tape and so on. On assembly of the fuel bed, the logs 138 are mounted and orientated such that the optic fibres 420 are not visible to a user, although their respective ends 418 are just sufficiently exposed at the edge portion or outer surface of the body 514 to enable light emitted from them to be directly perceived by a user, and if desired to illuminate the smoke rising through the fuel bed to provide the illusion of flames. The optic fibres 420 are arranged on the internal surface 528 so that their ends are relatively isolated, or several ends 418 may be grouped together to provide local regions of greater light intensity, such as at cavities or protrusions.

The end 424 of the bunch 422 of optic fibres 420 is arranged in juxtaposition with a light source 426. When the light source is illuminated, light is emitted from the ends 418 of the optic fibres and may be perceived by a user. Most preferably, means are provided for varying the colour and intensity of the light received by the optic fibres 420 over time. Where the light source is a simple source of white or near white light, such as a standard incandescent bulb or halogen bulb, a filter 434 may be disposed between the light source 426 and the end 424 of the optic fibres 420. In the illustrated example, the filter is a translucent disc which includes portions of different colours such as orange, yellow, red green and blue (which are typical colours which may be perceived in a real fire) which are exposed to the light source 426 in sequence. The disc is rotated about its axis 436 by suitable drive means (not shown) which may be an electric motor, for example. In an alternative arrangement, the light source 426 may be mounted within a translucent cylinder which has differently coloured portions. Rotation of the cylinder about its axis causes the differently coloured portions to pass between the light source and the end 424 of the optic fibres 420. In this way, the colour of the light falling on the end 424 of the optic fibres 420 is varied and, consequently the colour of the light emitted by the ends 418 of the optic fibres is varied. The disc 434 or cylinder may include regions which are opaque and/or which are more or less transmissive of light, so that the intensity of the light falling on the end 424 of the optic fibres 420, and emitted form ends 18, is varied.

Mechanical means may also be used for varying the intensity of the light from a light source incident on the end 424. As is well known in the art, so called "spinners" may be mounted above an incandescent light bulb. The spinners are apertured discs which rotate freely about their axis. Heat rising from the light source causes the spinner to rotate. In other arrangements a shaft having a number of approximately radial strips of material depending therefrom may be mounted between the light source 426 and the end 424, with the shaft being rotated about its axis by suitable means such as a motor.

In an alternative arrangement, the end 424 of the bunch 422 of optic fibres 420 may be disposed near an LED (light emitting diode) or a group of LEDs. So-called ultra bright LEDs are also especially suitable in this respect. Where a group of LEDs is provided, the group may preferably include LEDs of different colours. The LEDs may preferably be illuminated under the control of an electronic control means to that variation in the intensity and colour of light falling on the end 424 of the optic fibres 420 is achieved.

The light source 426 need not necessarily be arranged immediately adjacent the end 424. It may be convenient, for example, to use one or more mirrors to direct light from a light source to the end 424 of the bunch 422 of optic fibres 420.

In order to provide further variation in the colour and/or intensity of the light perceived at the ends 418 of the optic fibres 420 a given log 138 may be provided with more than one bunch 422 of optic fibres 420. Each bunch 422 may be provided with its own light source 426 and light intensity and colour varying arrangement.

Although the disclosure has been described above in relation to a log 138 having a unitary body 514 or two independent parts 414, 416 other constructions which achieve the same or a similar result are not excluded. For example, the ember bed may be shaped and coloured locally to resemble a first (normally lower) part of a log, with an second (upper) part 414 or 416 then being formed independently and mounted directly on the ember bed to form a log 138. In this case, the optic fibres 420 are sandwiched between the part 414 or 416 and the ember bed. Also, the parts 414, 416 forming a log 138 need not be of equal size. For example, an upper part 414 of a log may form the majority of the log with a lower part 416 serving only to form an underside an end portions of the log. Also, the logs of the disclosure are not confined to only two parts. An upper part 414 may form the majority of a log 138, having for example an outer surface extending between points at the front and rear of the log which a user perceives as resting on the ember bed with two or more parts 416 forming only end faces of the log 138. The optic fibres 420 are still, nevertheless still generally sandwiched between the parts 414 and 416. Any region of a part 414 416 which is not visible to a user in normal use need not be shaped and coloured to resemble a log. For example, the underside of a part 416 may have a plain undecorated surface or may be shaped to conform with an underlying log or with the ember bed.

The use of fibre optics to provide an enhanced simulation of a real fire is equally applicable to the simulation of other solid fuels such as coal, peat and the like.

Figure 38:
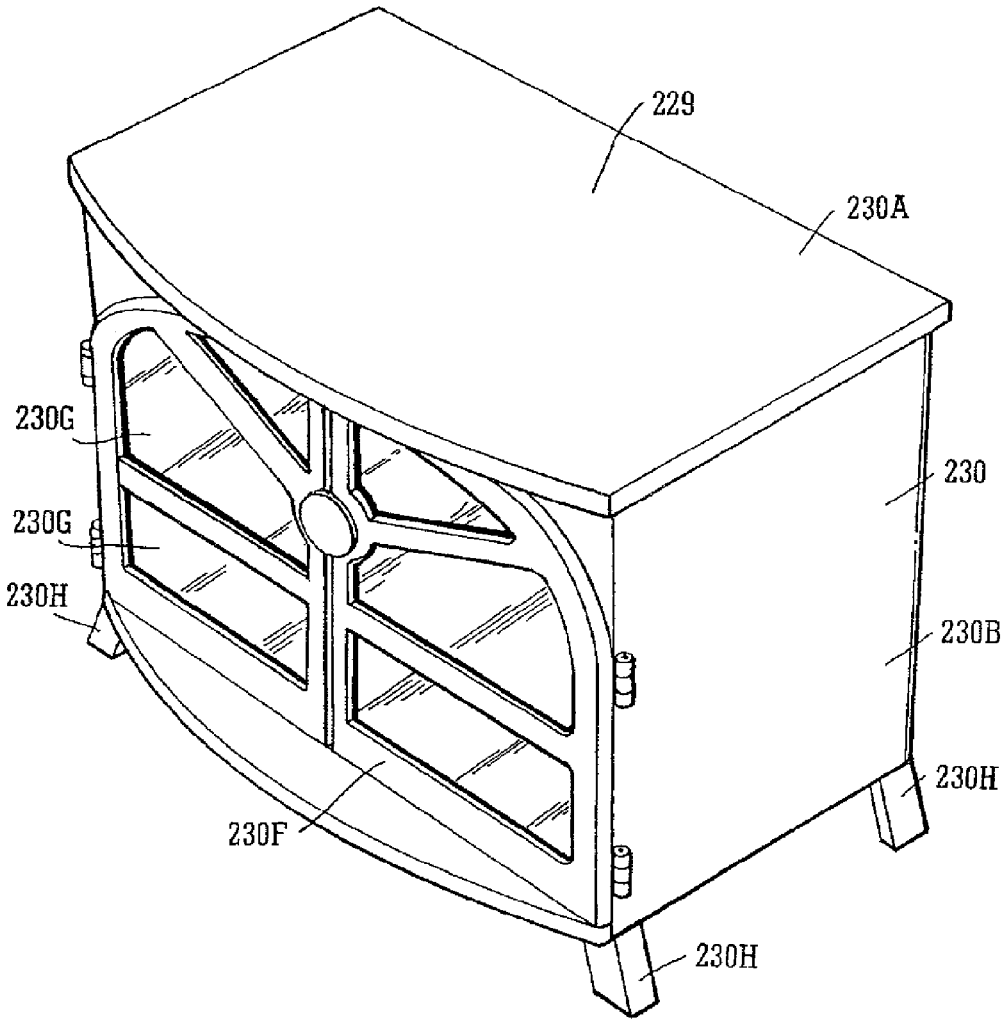
FIG. 38 shows an external view of a typical simulated stove in which an apparatus of the present disclosure may be incorporated.

FIG. 38 shows a typical example of a simulated flame effect fire in the form of a traditional stove 229. The stove has an external casing 230 which includes a top wall 230A, side walls 230B and 230C, rear wall 230D, floor 230E and front wall 230F. Front wall 230F is styled to resemble the doors of a stove with "glazed" panels 230G through which the simulated fire can be seen. The panels 230G may be made from glass, transparent plastic or the like. The housing 230 may be made from an suitable material such as metal, plastic, wood, particleboard, fibreboard and the like and is suitably coloured (typically black) to resemble, for example, a cast iron heating stove. The housing 230 is supported by legs 230H so that the floor 230E is spaced from the surface (i.e. the floor of a room) on which the stove 229 is placed.

Figure 39:
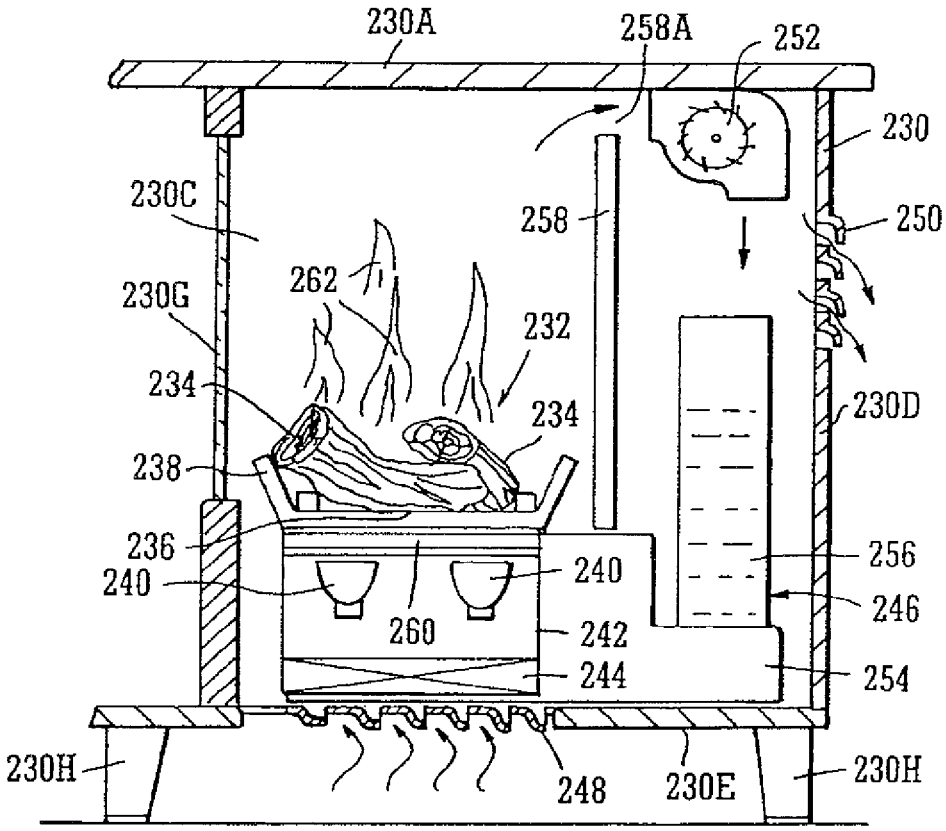
FIG. 39 is a schematic cross-sectional view of the stove of FIG. 38 showing the main components of a flame effect generator according to one embodiment of the present disclosure.

FIG. 39 shows, by way of example, components of a flame effect generator arranged within stove 229. The flame effect generator of the type illustrated may, of course, be mounted or arranged in other types of simulated flame effect fire, such as "inset" fires intended for location in a fireplace.

The flame effect generator includes a simulated fuel bed 232 which in the illustrated example comprises a plurality of simulated logs 234 resting on a simulated ember bed 236 and supported by a simulated grate 238. The fuel bed 232 may alternatively be formed with other sorts of simulated fuel such as simulated coal. In other arrangements, different materials can be employed to achieve a different effect. For example, for a more contemporary effect, the fuel bed may consist primarily of stones such as pebbles, or glass beads, plastic or resin beads or the like. The fuel bed 232 is arranged in a position in which it is visible to a user of the stove 229 through glazed panels 230G. The fuel bed 232 is mounted above a lighting and vapour generating assembly and, together with lower portion of front wall 230F conceals the latter from a user's view.

The lighting and vapour generating assembly comprises at least one light source 240 (and preferably more than one light source, for example from 2 to 8 light sources, especially 3 to 6 light sources and in particular 4 light sources), at least one air flow guide 242, an optional fan 244 and a vapour generator 246. Vapour generator 246 comprises a vapour generating unit 254 and a liquid reservoir 256. The floor 230 of the housing 230 is provided with air inlet louvres 248 and rear wall 230D is provided with air outlet louvres 250. A fan 252 may be provided to circulate air within the housing 230. An opaque panel 258 is arranged behind the fuel bed 232 to screen components such as reservoir 256 from the user's view. An air flow gap 258A is provided between the top margin of the panel 258 and the top wall 230A. The panel 258 may, for example, have a black front surface or may be provided with a surface pattern or the like, such as a representation of fire bricks. Immediately below fuel bed 232 is located a vapour distributing component 260, which will be described in more detail below.

In summary, the operation of the flame effect generator is as follows. Water is supplied from reservoir 256 to vapour generating unit 254. Water vapour is expelled, preferably directly, from vapour generating unit 254 to the vapour distributing component 260. Air enters the housing 230 through louvres 248, optionally with the assistance of fan 244 and rises past light sources 240 to the vapour distributing component 260. Light sources 240 generate significant amounts of heat as well as light and the heat generated provides a rising air flow. The rising air flow carries the water vapour through the fuel bed 232 so that the vapour rises above the fuel bed 232. The vapour is locally illuminated by light sources 240 and gives a realistic simulation of flames 262. Air and vapour circulate through housing 230, optionally with the assistance of fan 252. The air flow with entrained water vapour exits the housing 230 through louvres 250. Alternatively, the water vapour may be recycled for continued use.

Figure 40:
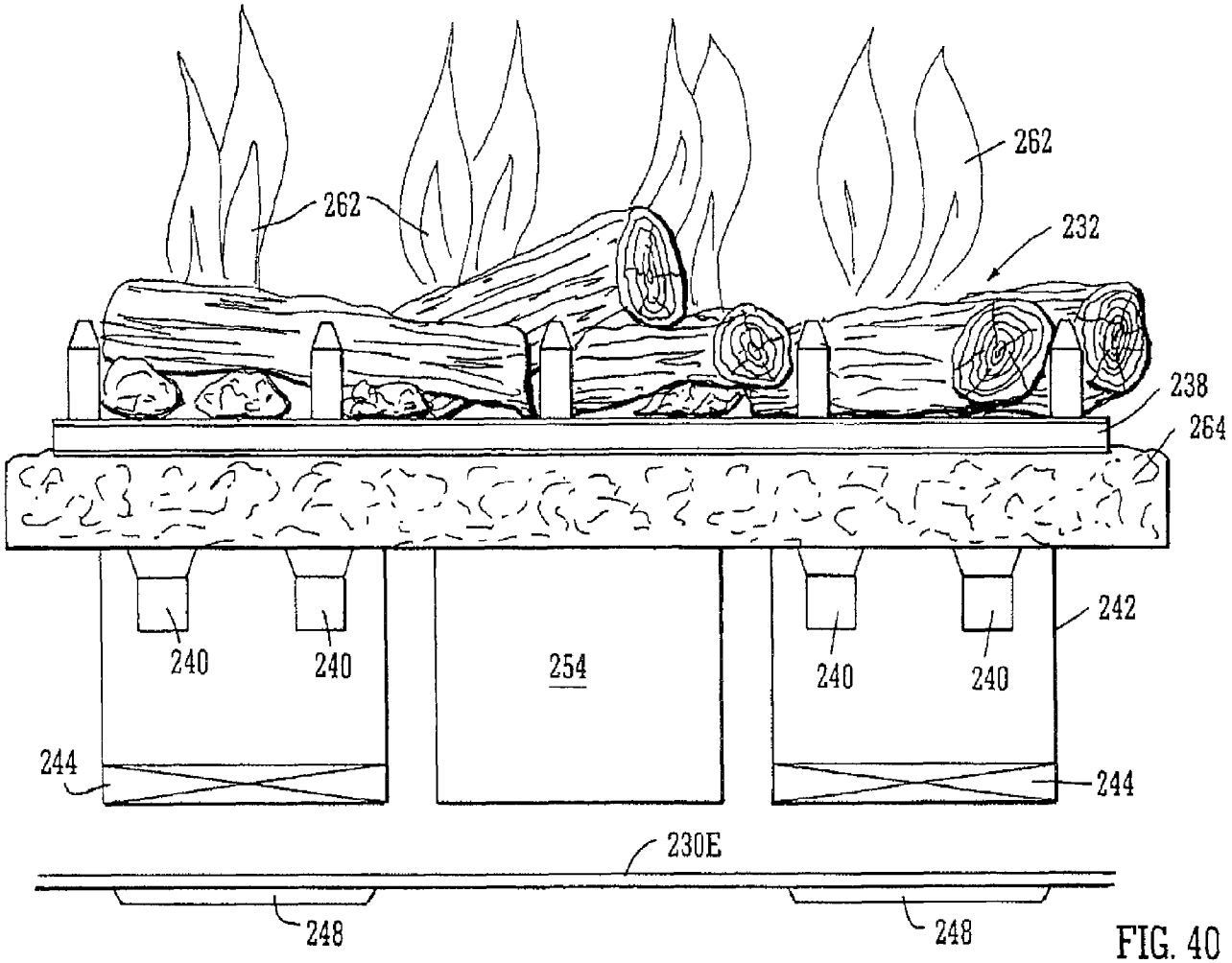
FIG. 40 is a schematic front view of the flame effect generator of FIG. 39.

FIG. 40 is a front view of the flame effect generator and shows the fuel bed 232 mounted on grate 238 above vapour generator 246. As can be seen from FIGS. 40 and 41 two air flow guides 242 are provided, arranged on either side of the vapour generating unit 254. The air flow guides 242 are disposed below the fuel bed and each surrounds two light sources 240. Other numbers of light sources may be provided. Preferred light sources are halogen bulbs of 25 W to 50 W output, typically about 35 W. The light source 240 may preferably be provided with a coloured filter, such as a coloured paint, varnish, lacquer or film applied directly to the light source, or a separate coloured translucent component, by which the light produced by the light source is coloured. Flame-like colours are, of course, preferred and typical colours are red, orange, blue and possibly green. Different light sources 240 may be provided with different colours. Each light source typically provides a relatively narrow beam of light, so that areas of the fuel bed 232 are locally illuminated, or are at least locally relatively more intensely illuminated, and so that light passes locally through gaps in the fuel bed.

Figure 41:
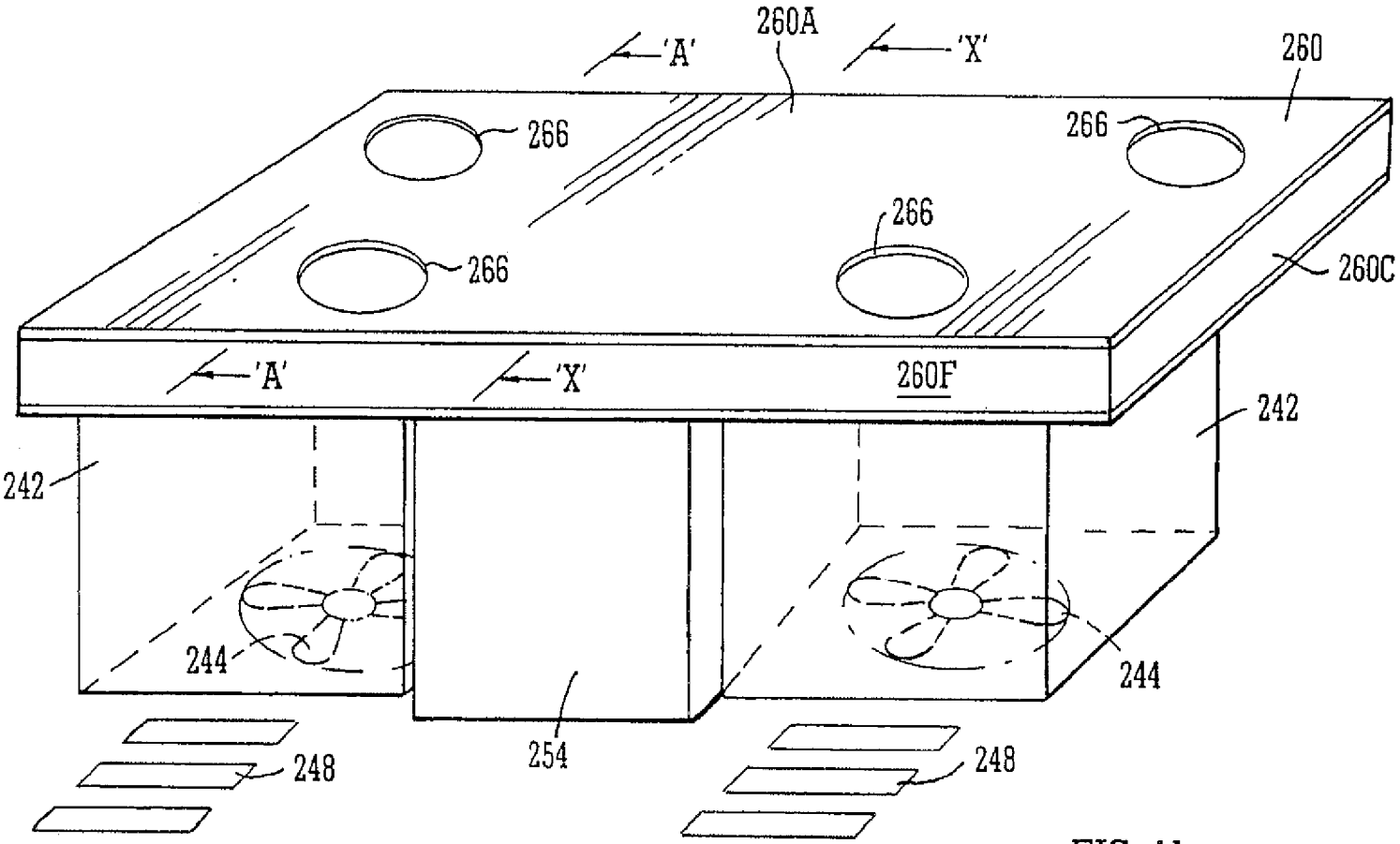
FIG. 41 is a schematic isometric view of the flame effect generator of FIG. 40 with certain components removed.

FIGS. 40 and 41 show that the air intake louvres 248 are, preferably, aligned with the open lower faces of the respective air flow guides 242. Air intake louvres may comprise, or may be provided with, light baffles to prevent light from the light sources from passing out of the housing 230 through the louvres 248. FIG. 40 also indicates that fuel bed 232 may be extended, or have an additional zone 264 which lies in use over and/or around marginal portions of the vapour distributing component 260, whereby the vapour distributing component 260 is shielded from a user's view. Zone 264 may, for example, be constructed to resemble a region of ash such as may occur at the margins of a real fire. In alternative constructions, the fuel bed 232 may be formed integrally with the vapour distributing component 260. A fan 244 is optionally contained in each air flow guide 242. The fans 244 may not be necessary where there is a sufficient upward flow of air, such as when the air is sufficiently heated by light sources 240. In preferred variations, fans 244 are not included. Each light source 240 is aligned with a flow through passage 266 defined in the vapour distributing component 260.

Figure 42B:
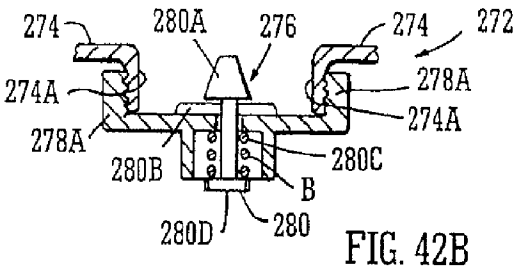
FIG. 42B is a detail of a connection arrangement according to an embodiment of the present disclosure.
Figure 42A:
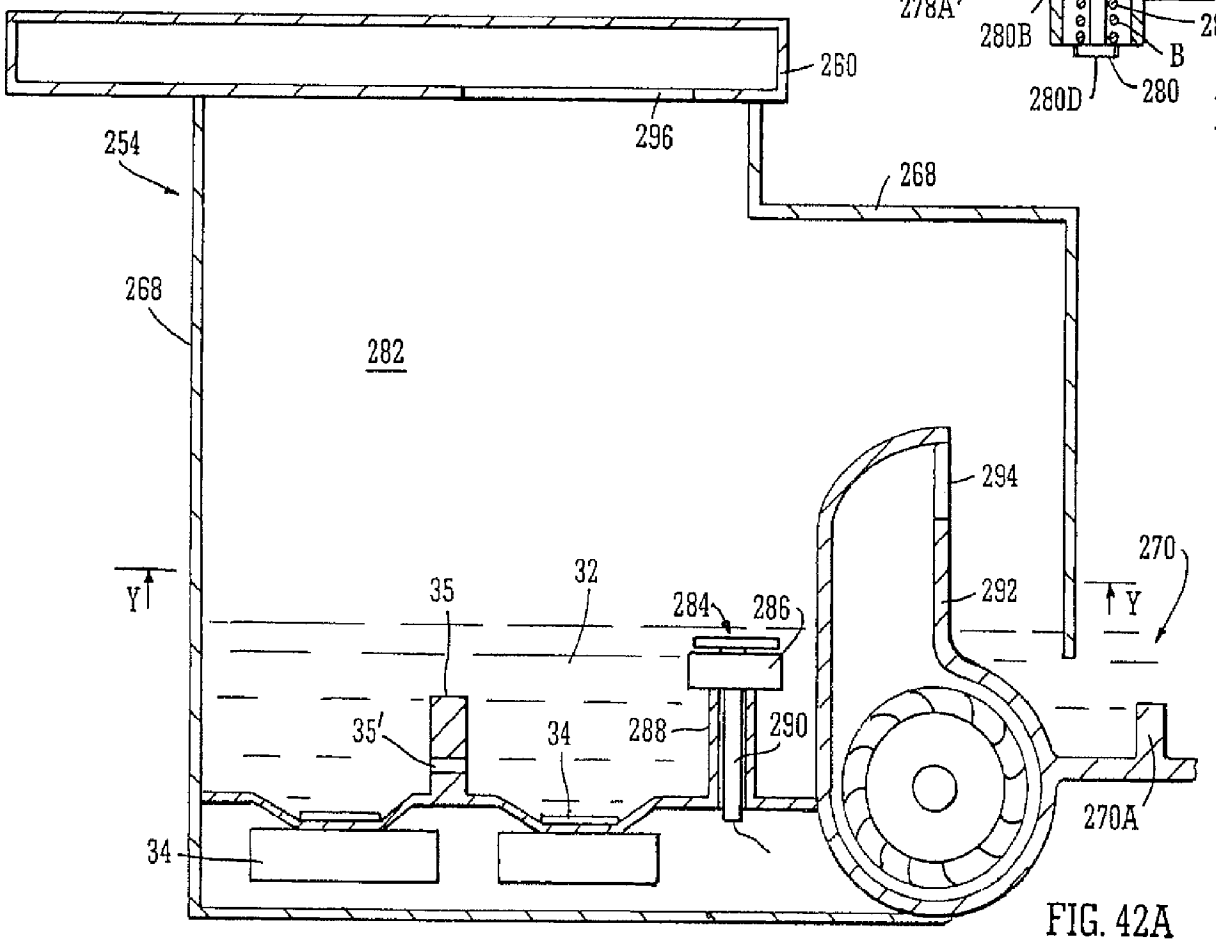
FIG. 42A is a schematic cross section along line X-X of FIG. 41.

FIG. 42A shows in more detail the construction of one preferred form of vapour generating unit 254. The unit 254 comprises a housing 268 made from a suitable material, typically plastic, in which the various components of the vapour generating unit 254 are disposed or mounted. Vapour generating unit 254 is operationally connected to a reservoir 256 (not shown in FIG. 42A) by means of a connecting portion 270 of the housing 268. Reservoir 256 is removable for refilling with water (or other suitable liquid). FIG. 42B shows a detail of a suitable connection 272 between the reservoir 256 and the housing 268 of vapour generating unit 254. Reservoir 256 has walls 274 portions 274A of which define an outlet opening 276. Outwardly facing portions of wall portions 274A are provided with a screw thread. A cap 278 is provided with correspondingly threaded wall portions 278A by which the cap 278 is attachable to the reservoir 256 to close opening 276. Cap 278 has a valve 280 which comprises a linearly moveable valve member 280A which is biased towards valve seat 280B by a biasing means 280C such as a spring. In the closed position in which the valve member 280A is urged against valve seat 280B, the valve 280 is closed and liquid cannot pass through it. However, valve member 280A includes a lower end portion 280D configured to contact an upstanding portion 270A of housing 268 when the reservoir 256 and the housing 268 are brought together. Thus, when the reservoir 256 is connected to the housing 268, formation 270A forces the valve member 280A upwardly against the action of the spring 280C. Valve member 280A thus moves away from valve seat 280B and liquid can flow out of the reservoir 256 around the valve member 280A and into the housing 268 of the vapour generating unit 254. Valve 280 is configured to provide a substantially, or at least approximately, constant volume of liquid in the vapour generating unit. Preferably the depth of water in the vapour generating unit is maintained within about +/−10 mm of the desired depth.

Housing 268 further includes one or more (preferably at least two) ultrasonic transducers 34 (or 34') generally of the type described hereinabove. The transducers 34 are separated by a barrier or baffle 35 provided between respective ultrasonic transducers 34, to prevent any interference between respective transducers 34. Channels or ports 35' extend between the respective sides of the baffle and allow a through flow of liquid 32. Transducers are located in a body of water or other suitable liquid 32 supplied from reservoir 256. When operational, the transducers 34 generate vapour (preferably water vapour) in the housing in the space 282 defined above the liquid 32. Operation of the vapour generator unit 254 causes the liquid 32 to be consumed and the body of liquid 32 in the housing 268 is replenished from the reservoir until such time as the reservoir 256 is empty. At that stage the level of liquid 32 in the housing 269 will fall. A control switch 284 is provided to turn off the ultrasonic transducers 34 when the liquid 32 falls below a predetermined level. Any suitable control switch may be used. In the example illustrated in FIG. 42A, the switch 284 comprises a float 286 which rises and falls on a column 288 in accordance with the liquid level. The float 286 carries a magnet which opens a reed switch 290 when the liquid falls below the predetermined level, so that the transducers 34 are turned off.

Housing 268 further includes a fan or blower 292 which draws air into the housing 268. Air is expelled from the fan 292 through outlet 294. It is noted that outlet 294 is directed away from transducers 34. Thus the air current is deflected by the adjacent wall of the housing 268 into the body of the housing. This achieves a suitably gentle air current for carrying the generated vapour out of the vapour generator.

Figure 43:
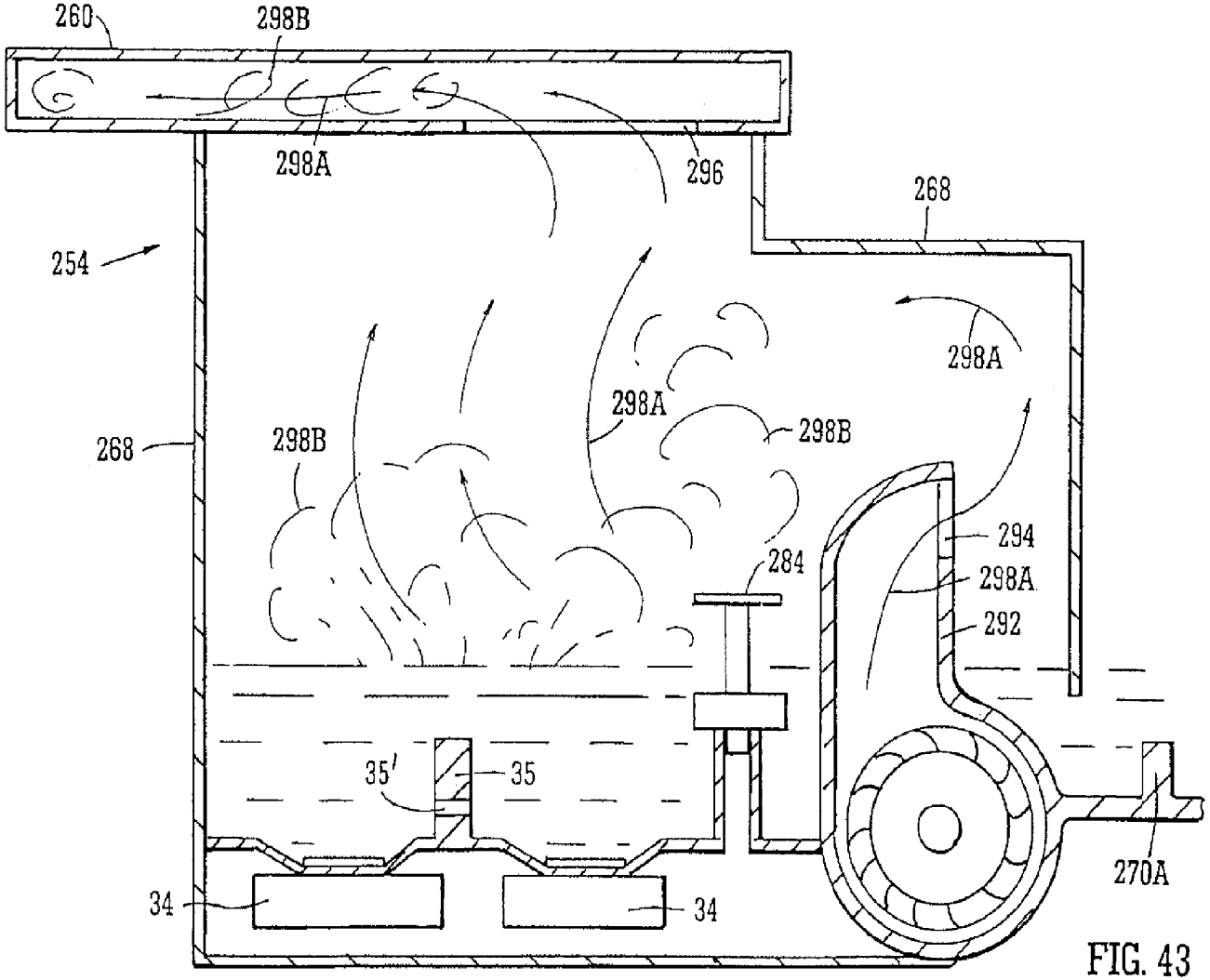
FIG. 43 is similar to FIG. 42A and includes details of the air flow within the flame effect generator.
Figure 44:
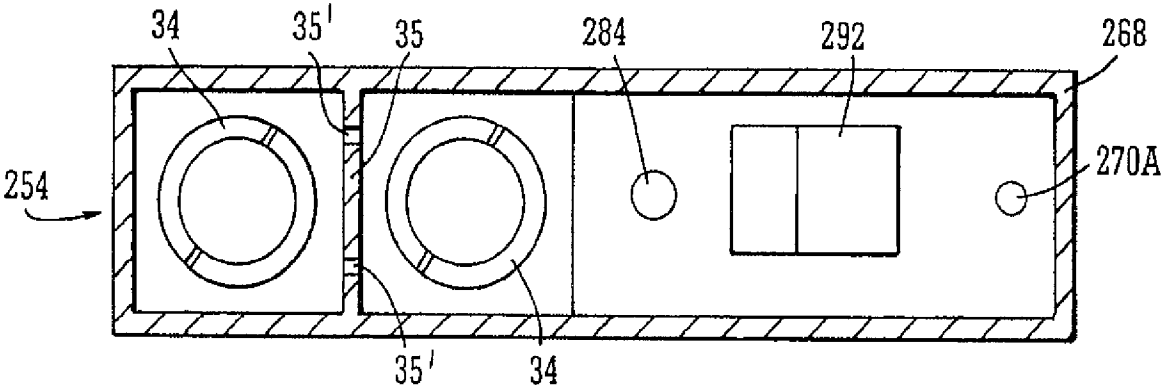
FIG. 44 is a schematic cross section along the line Y-Y of FIG. 42A.

The upper part of housing 268 is closed by vapour distributing component 260 which may be integral with housing 268 or may be separable therefrom. Air and vapour are carried into the vapour distributing component 260 through inlet 296 and exit the vapour distributing component 260 through flow through passages 266. The flow paths of the air and vapour in housing 268 are illustrated in FIG. 43. Air flow is indicated by arrows 298A and vapour by swirls 298B.

Figure 45:
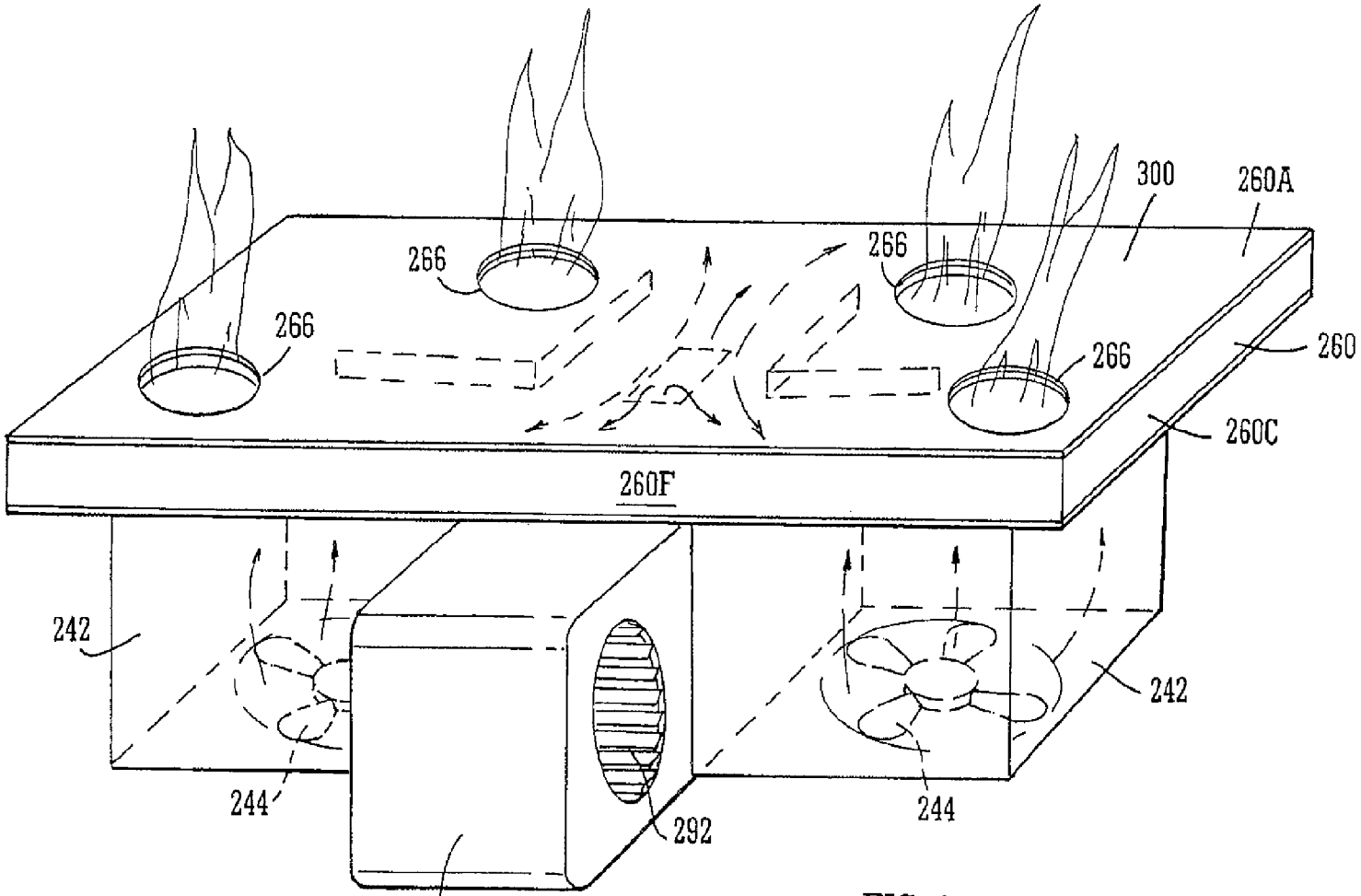
FIG. 45 is a schematic rear isometric view of the flame effect generator of FIGS. 41 to 44.
Figure 46:
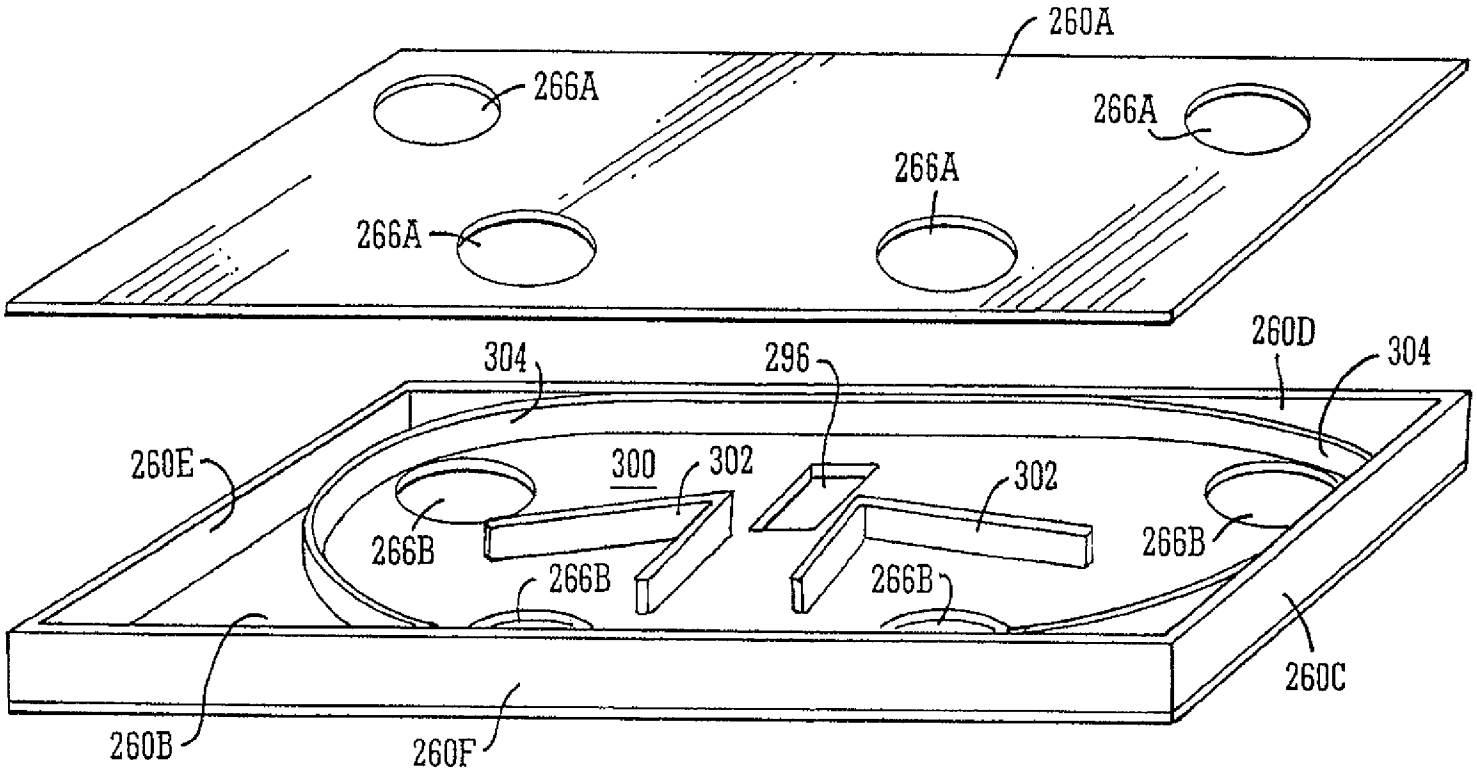
FIG. 46 is an exploded perspective view of a vapour distributing component of the flame effect generator of FIGS. 40 to 45.
Figure 47:
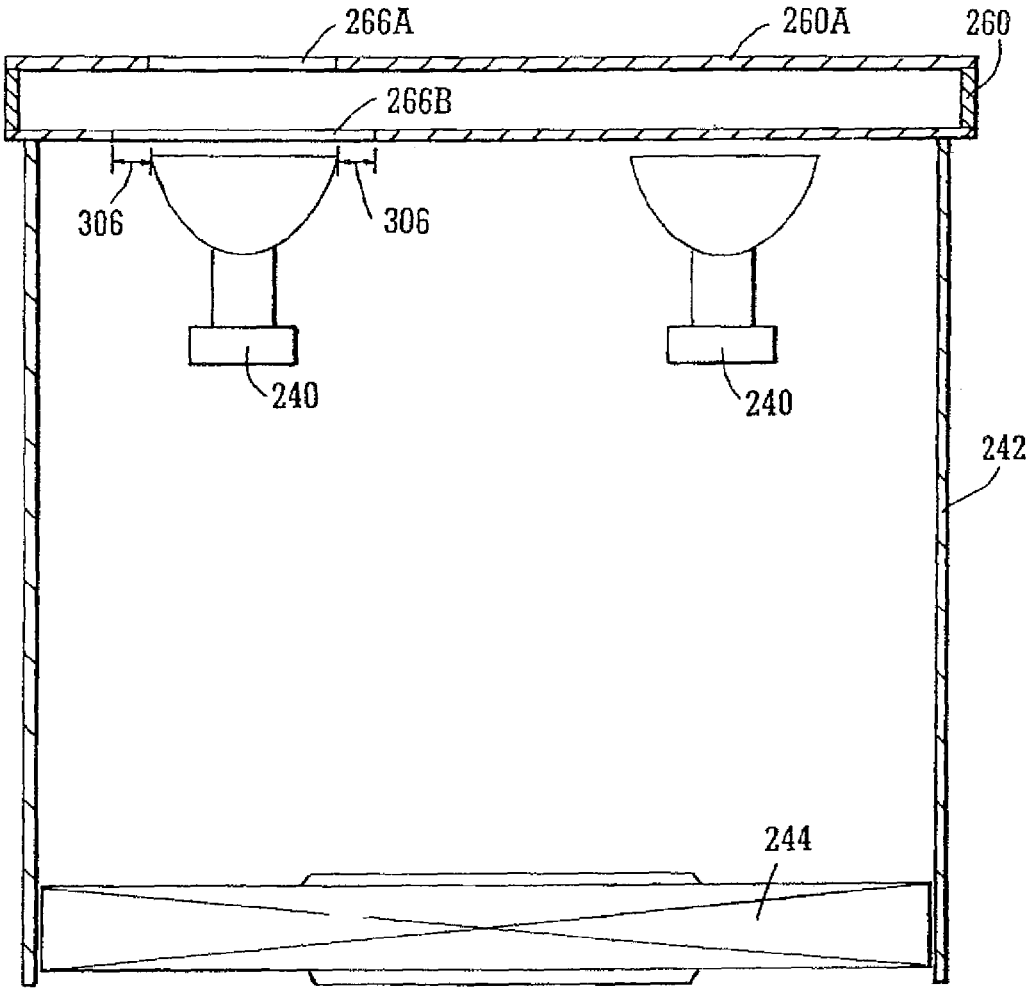
FIG. 47 is a schematic cross section on an enlarged scale of along the line A-A of FIG. 41.

Further details of the construction of the vapour distributing component 260 are shown in FIGS. 45 and 46. Vapour distributing component 260 comprises an upper wall 260A, a lower wall 260B and side walls 260C, 260D, 260E and 260F which together define a chamber 300. Lower wall 260B includes air inlet apertures 266B and upper wall 260A defines air and vapour outlet apertures 266A. The upper and lower walls of the vapour distributing component 260 are most preferably translucent, and may be coloured in a suitable fire like colour, in particular red or orange. Each inlet aperture 266B is aligned with a corresponding outlet aperture 266A. Air enters the vapour distributing component 260 from the air flow guides 242 through inlet apertures 266B. A mixture of air and vapour enters the vapour distributing component 260 from the vapour generating unit 254 through inlet 296. Vapour distributing component 260 includes internal walls or baffles 302, 304 which are positioned to achieve a desired distribution of vapour to each outlet 266A. The construction of the baffles 302, 304 may be selected to achieve an equal distribution of vapour to each outlet 266A, or to achieve unequal distributions of vapour to the respective outlets 266A, depending on the particular nature of the desired flame effect.

FIGS. 47, 48, 50, 51 and 52 illustrate the relationship between the light sources 240, the vapour distributing component 260 and the flow through passages 266. Each flow through passage 266 is defined by an inlet 266B and an outlet 266A. Each flow through passage 266 has an associated light source 240. The light source 240 is disposed in an air flow guide 242 and is located immediately below inlet 266B. A gap 306 is arranged between the light source 240 and the margin of wall 260B which defines inlet 266B which provides a pathway for the flow of air around the light source and into the vapour distributing component 260. Heat from the light sources 240 causes an updraft which draws air through the air flow guides 242 and through inlets 266B. The air warmed by the light sources continues to rise and exits the vapour distributing component through outlets 266A. In passing through the vapour distributing component 260, the rising air warmed by the light sources 240 entrains vapour within the vapour distributing component 260 and carries the entrained vapour out through outlets 266A. The upward movement of air may be assisted by fans 244 if necessary, but it is preferred that the light sources 240 constitute the sole means of providing an upward flow of air. Air and entrained vapour exiting outlets 266A pass through gaps provided in the fuel bed 232, such as between individual pieces of simulated fuel, and rise above the fuel bed. Because the vapour entrained in the rising air is somewhat opaque it can resemble wisps of smoke rising from the fuel bed 232. However, and more importantly, the illumination of the rising vapour by the light sources 240 gives the vapour a definite colour (depending on the colour of the light source) which causes the illuminated vapour to resemble flames rising from the fuel bed. The natural movement of the illuminated vapour is very reminiscent of flames and an excellent flame simulation is achieved. As the vapour disperses, the effect of the illumination by the light sources 240 ceases, so that the flames appear to have an entirely natural height.

In order to achieve an optimum up flow of air from the light sources 240, the inventor has found that the inlet 266B should be sized so that it is somewhat bigger than the size of the associated light source. Typically a gap 306 of about 5 mm to 25 mm, preferably about 10 mm to 20 mm and especially about 15 mm is effective. Thus in a preferred arrangement in which the inlet 266B and the light source 240 are both circular in shape, the diameter of the inlet 266B is about 30 mm greater than that of the light source 240. The size of the outlet 266A is preferably selected to be smaller than the inlet 266B. Outlet 266A is typically approximately the same size as, or slightly larger than the light source 240. For example, the outlet 266A may have a diameter which is about 5 mm larger than that of the light source 240. In this way, the rising vapour remains largely confined to the area illuminated by the light source and the flame simulation is improved.

Figure 55A:
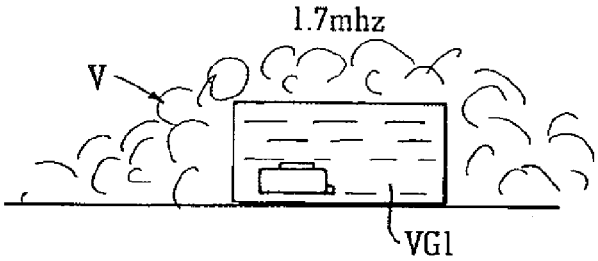
FIGS. 55A, 55B and 55C show typical vapour flow paths from vapour generators.
Figure 55B:
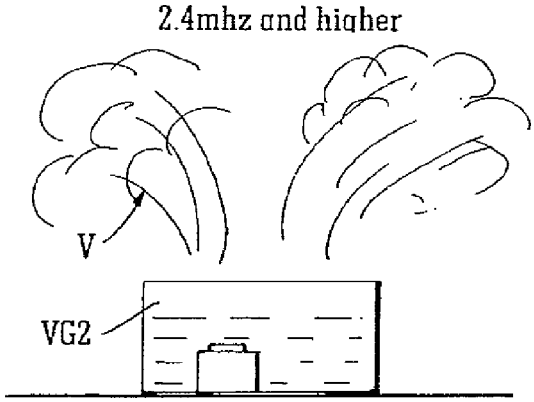
Figure 55C:
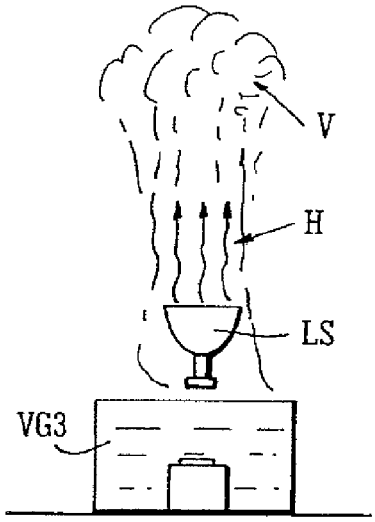

Referring now to FIGS. 55A, 55B and 55C, vapour patterns for various configurations of vapour generator are illustrated. In FIG. 55A, a typical vapour pattern for a vapour generator operating at a frequency of about 1.7 MHz is illustrated. It can be seen that the vapour V has a tendency to fall downwardly almost immediately after it exits the vapour generator VG1, since the droplet size of the particles of vapour is relatively large and the droplets are therefore relatively heavy. Thus the simulation of flames with vapour generated at this frequency is less effective and usually a fan arranged above the vapour generator is required to provide a significant upward flow of air which carries the entrained vapour upwardly. In FIG. 55B, a typical vapour pattern for a vapour generator operating at 2.4 MHz and higher is shown. It can be seen that the vapour V is much "lighter" since the droplet size is much smaller and so the vapour rises much more readily and does not fall immediately on exiting the vapour generator VG2. FIG. 55C shows schematically a further arrangement in which a vapour generator VG3 operating at a frequency of 2.4 MHz or higher is combined with a light source LS. The light source LS produces heat and causes a rising current of warmed air indicated by arrows H. The vapour V is entrained in the rising air and is carried upwardly and remains within the beam of light emitted by light source LS. Thus the arrangement in FIG. 55C shows in general terms a preferred arrangement according to the present disclosure.

Figure 48:
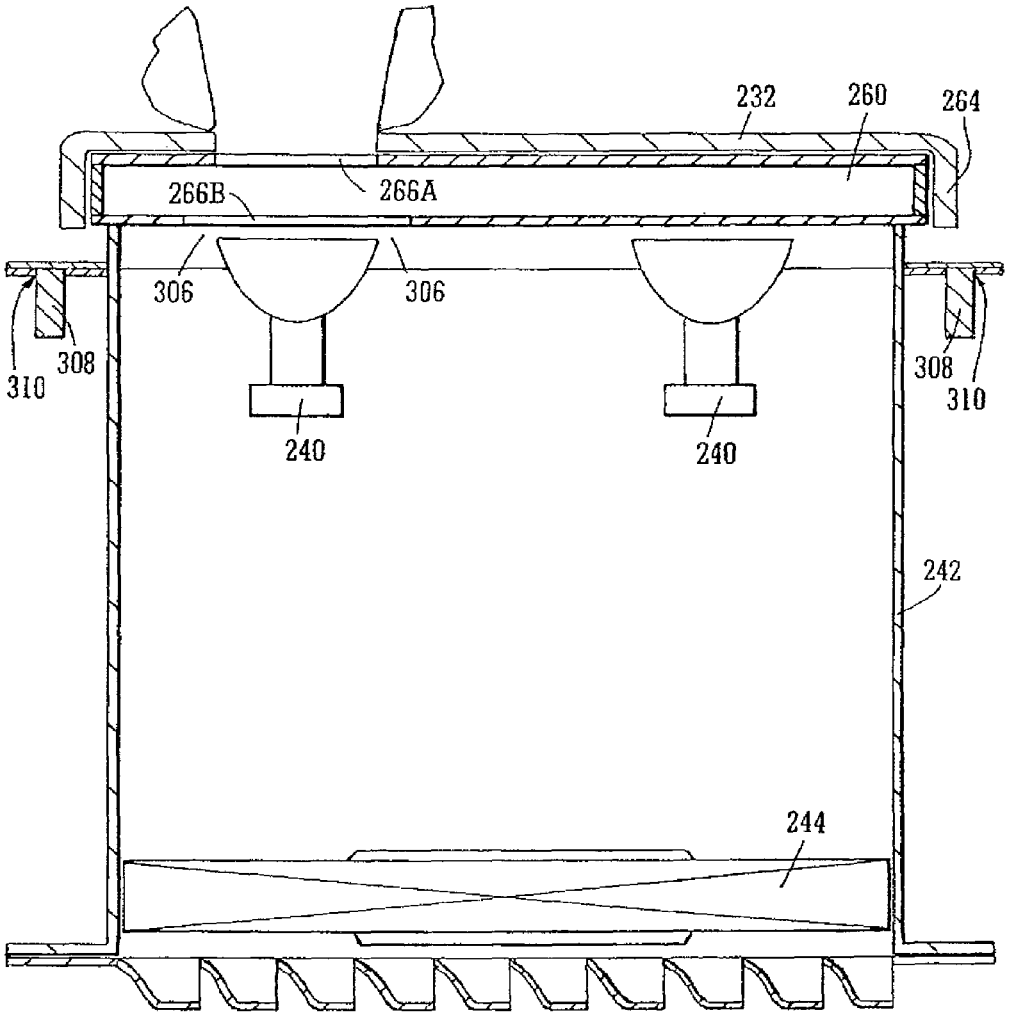
FIG. 48 is similar to FIG. 46 and shows additional features.
Figure 49:
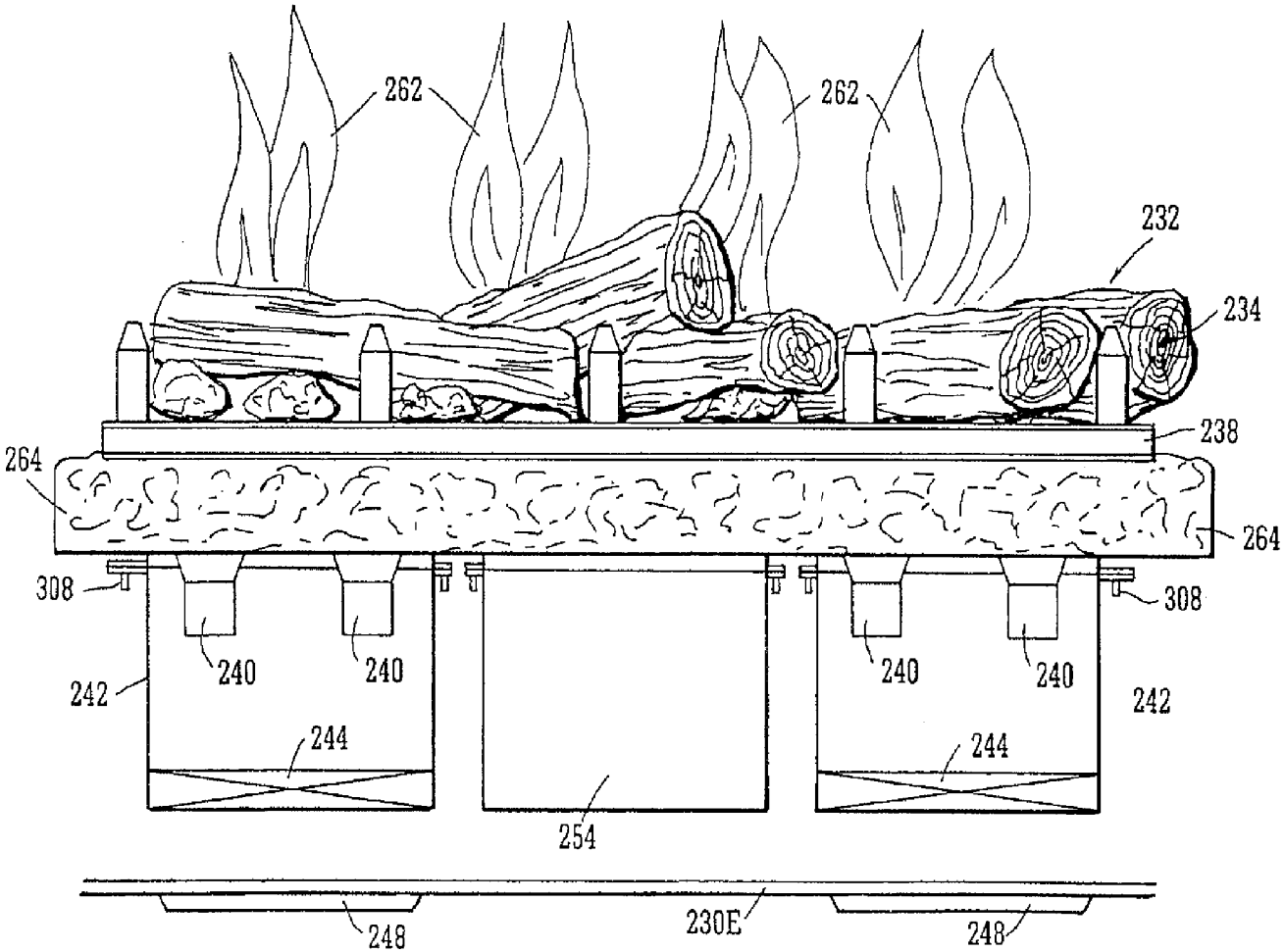
FIG. 49 is similar to FIG. 41 and illustrates additional features of the apparatus.
Figure 50:
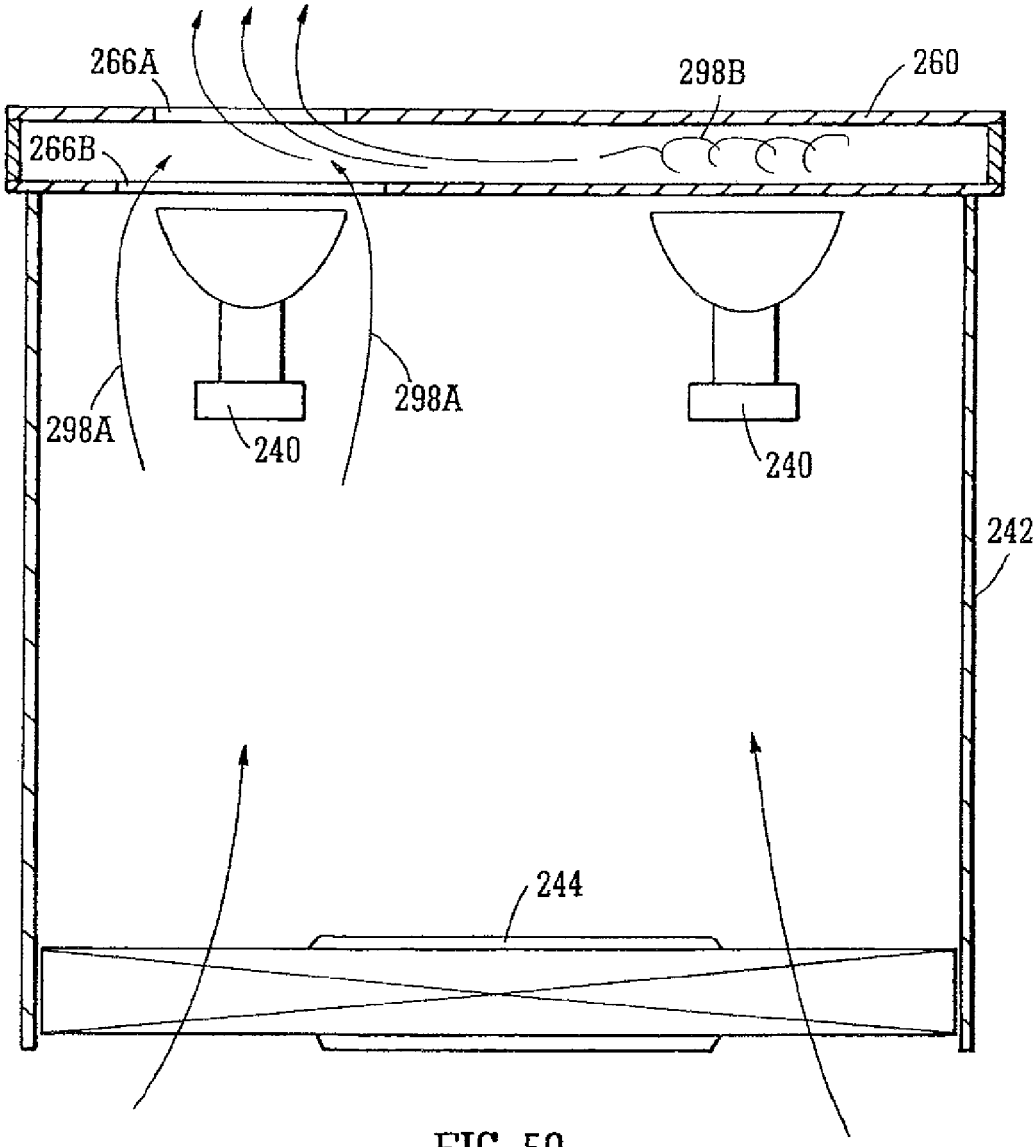
FIG. 50 is similar to FIG. 47 and shows details of the air and vapour flow paths.
Figure 51:
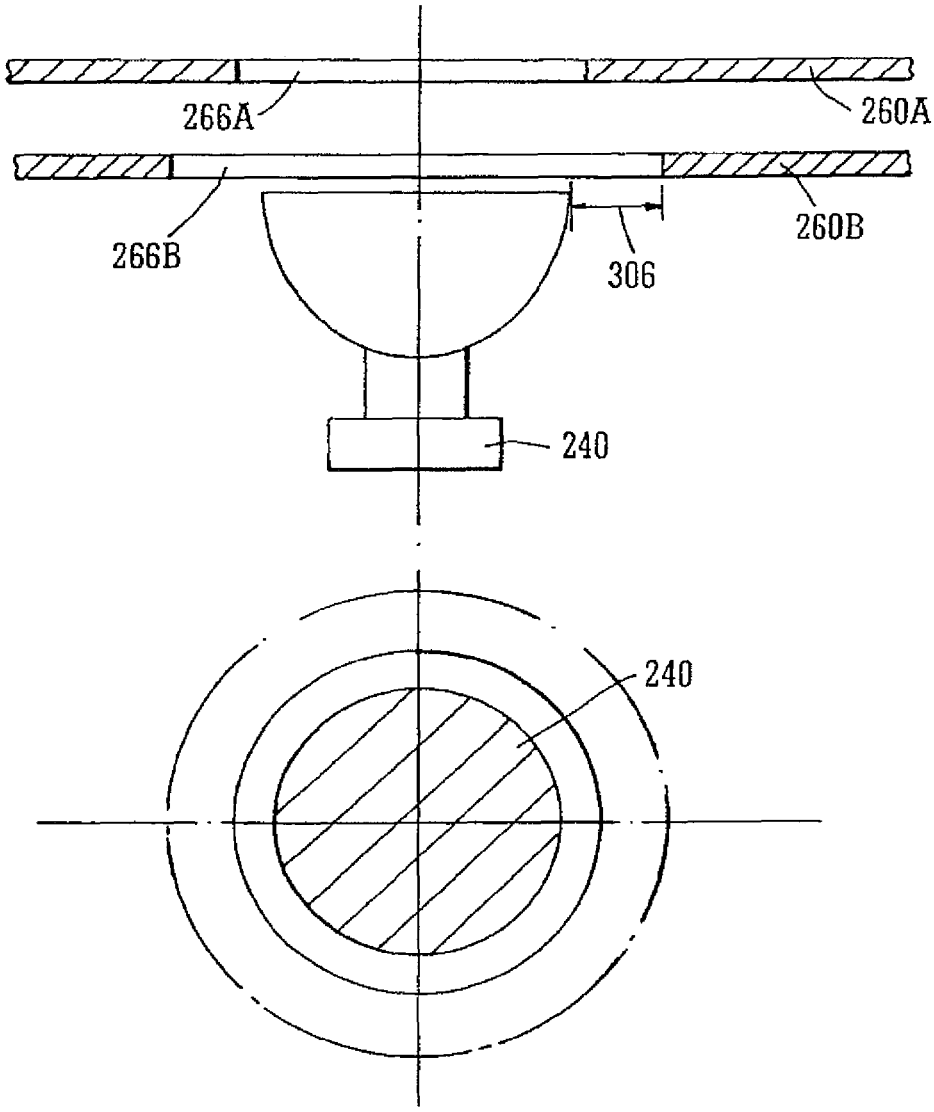
FIG. 51 shows in more detail an arrangement of the light sources and the vapour distributing component.
Figure 52:
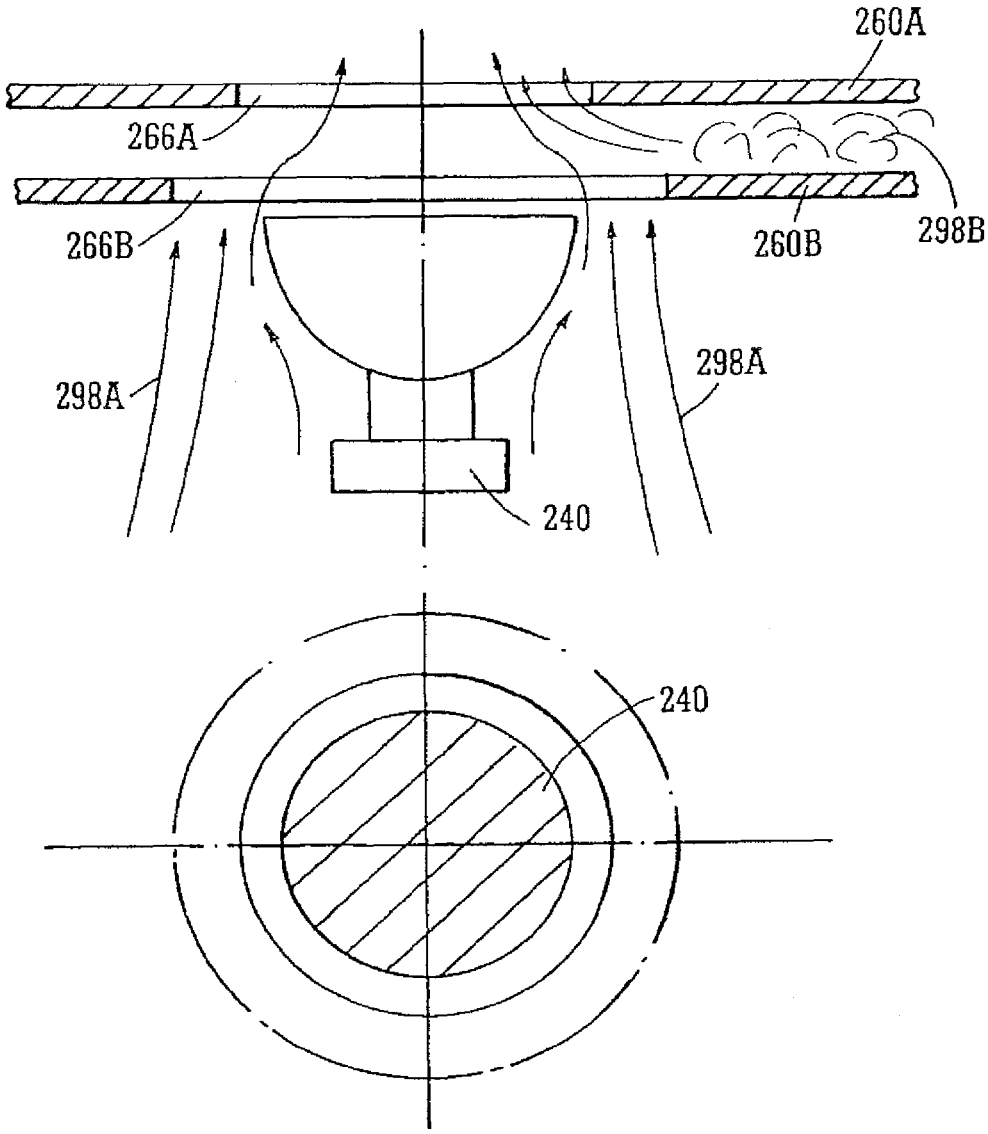
FIG. 52 is similar to FIG. 51 and includes details of air and vapour flow paths.

As noted above in relation to FIG. 40, fuel bed 232 may be extended, or have an additional zone 264 which lies in use over and/or around marginal portion of the vapour distributing component 260, whereby the vapour distributing component 260 is shielded from a user's view. This arrangement is also shown in FIGS. 48 and 49. FIG. 48 further shows that the fuel bed 232 may include relatively raised portions, simulating, for example, burnt or burning embers or ash, which raised portions surround the outlets 266A of the vapour distributing component 260 and which may overlap the outlets 266A slightly. The edges of the outlets 266A (and preferably the whole of the outlets 266A) are thereby shielded from a user's view.

From time to time in operation of the apparatus as shown in FIGS. 38 to 54 it will be necessary to replace the light bulbs 240, since such bulbs have a limited life. A halogen bulb has a life typically of about 2000 hours. To allow the bulbs 240 to be replaced, access is provided. In the arrangement illustrated in FIGS. 48 and 49 the fuel bed 232 is attached to, or mounted on, the vapour distributing component 260 so that in effect the two form a single unit. The vapour generating component is located in position on the housing forming the air flow guides 242 by means of co-operating formations provided on the housing 242 and the vapour distributing component 260. In the example illustrated, the vapour generating component 260 is provided with a plurality of downwardly directed pegs 308 which are received in holes 310 provided in part of air flow guide housing 242. The vapour distributing component 260 is thus securely and accurately located in position, but can easily be lifted off together with the fuel bed 232 to gain access to the light bulbs 240 should a bulb 240 fail and need replacing.

Figure 53:
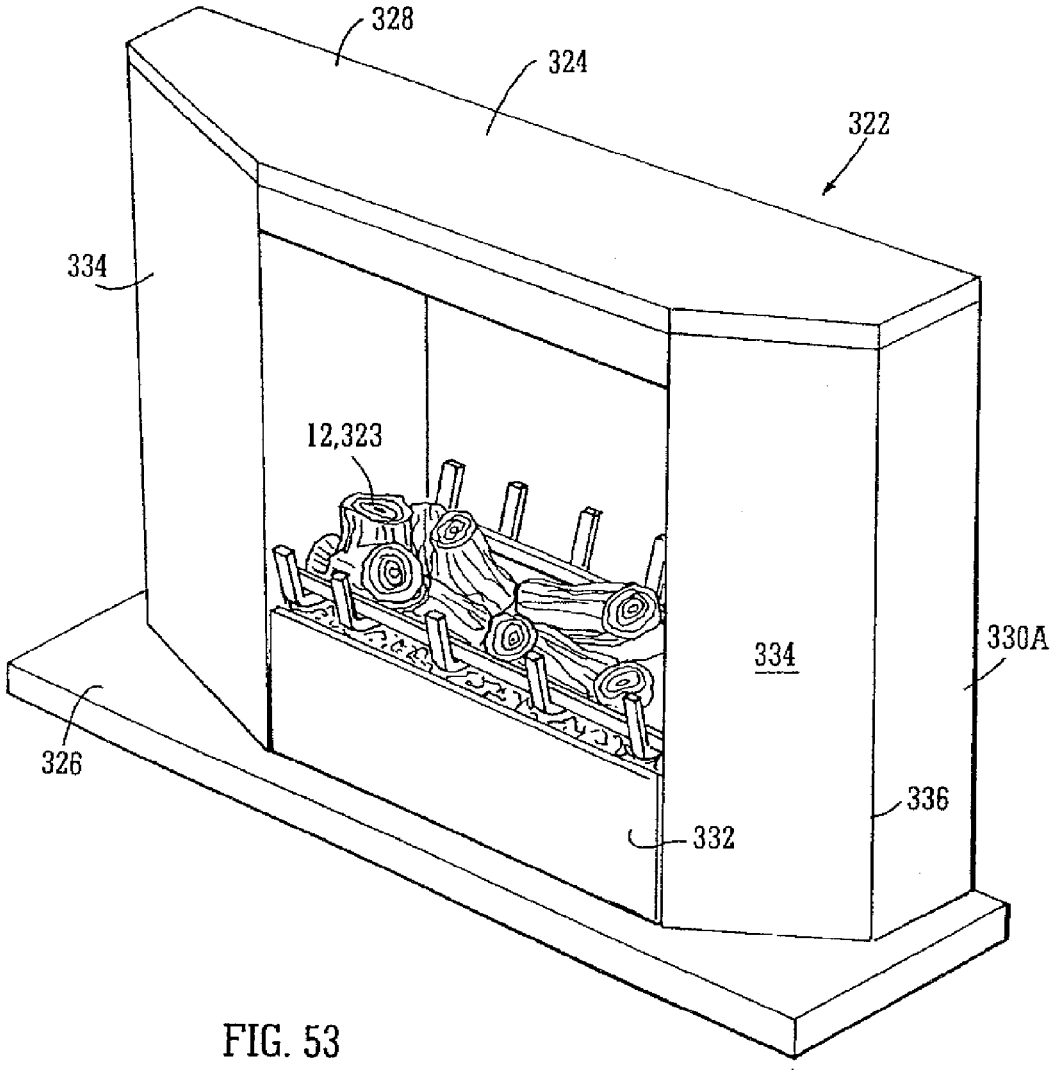
FIG. 53 shows a flame effect generator of the disclosure configured as a free-standing fire unit.
Figure 54:
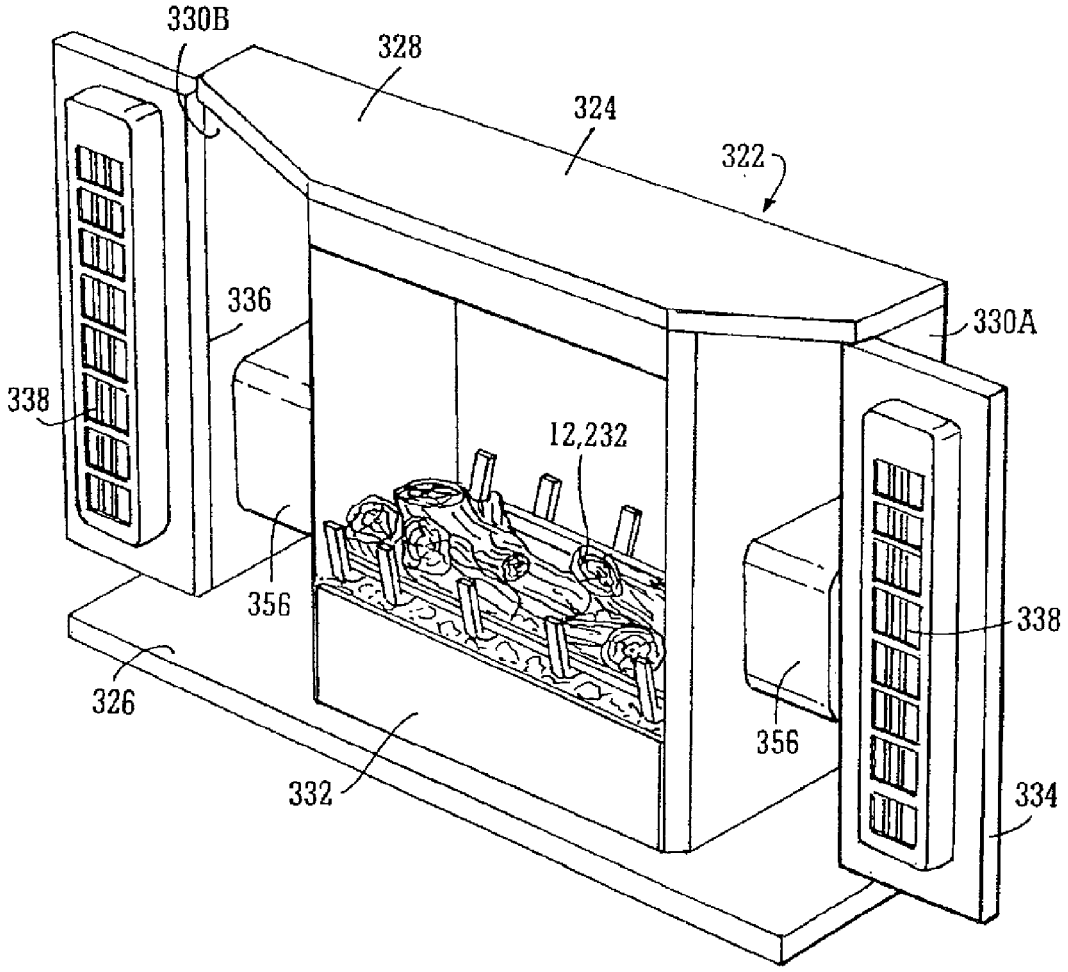
FIG. 54 shows the unit of FIG. 52 in an opened condition.

FIGS. 53 and 54 illustrate an example of a simulated fire including a flame simulating apparatus according to the disclosure. The simulated fire 322 comprises a housing 324 which in the illustrated embodiment sits on a plinth 326. The housing 324 comprises a top wall 328, side walls 330A and 330B and a front 332. Fuel bed 12, 232 is arranged within housing 324 and operative components of the flame effect generator such as the light sources and vapour generator are disposed below the fuel bed 12, 232, hidden from a user's view. Housing 328 further comprises obliquely oriented front panels 334 which are hinged at side 336 so that they can be opened manually or automatically to the position illustrated in FIG. 54. Other configurations of panels 334 are equally possible. For example they might be arranged parallel to front 332. Panels 334 carry radiant heat sources 338. Any suitable radiant heat source can be used, examples of which include infra red radiant elements and silica tube radiant elements. Opening of the panels 334 also gives access to reservoir or reservoirs 356 which contain liquid for the vapour generator. The reservoirs can thus easily be refilled as necessary. In a variation of this arrangement, the panels 334 have pivots at the centre of their top and bottom edges about which they can rotate. Thus, when the panels are rotated to reveal the radiant heat sources 338, the reservoirs 356 are screened from a user's view. However, the reservoirs 356 may still be accessed by turning the panels 334 through about 90 degrees. The construction of the housing 324 with the panels 334 configured to conceal the radiant heat sources when not in use is, of course, equally applicable to other constructions of simulated fire and not only those described in the present application. Equally, the simulated fires of the present application may be provided with different heat sources, such as conventional fan heaters.

Referring now in particular to FIGS. 56 and 57, another preferred embodiment of the apparatus 450 according to the present disclosure is illustrated.

The apparatus includes a simulated fuel bed 232 which in the illustrated example comprises a plurality of simulated logs 234 resting on a simulated ember bed 236 and supported by a simulated grate 238. The fuel bed 232 may alternatively be formed with other sorts of simulated fuel such as simulated coal. In other arrangements, different materials can be employed to achieve a different effect. For example, for a more contemporary effect, the fuel bed may consist primarily of stones such as pebbles, or glass beads, plastic or resin beads or the like. The fuel bed 232 is arranged in a position in which it is visible to a user of the stove apparatus. The fuel bed 232 is mounted above a lighting and vapour generating assembly, as described below, and conceals the latter from a user's view.

The apparatus 450 comprises a reservoir or tank 476 which operatively contains a supply of liquid to be vapourised. The reservoir 476 is connected to vapour generator 478 by means of an arrangement 480 similar to valve arrangement 280 (FIG. 42B). Vapour generator 478 comprises container 452 and ultrasonic transducer 458 as previously described. Thus, liquid is supplied from reservoir 476 to container 452 through valve arrangement 280, so that an at least approximately constant volume of liquid is maintained in the container 452. Preferably the volume of liquid in the container is maintained within about +/−10 mm of the desired depth. Ultrasonic transducer 458 acts on body of liquid 32 in the container 452 to generate vapour as previously described. The container 452 includes an outlet port 482 which communicates with inlet 486 of a vapour distribution component 484. The vapour distributing component 484 is broadly similar to the vapour distributing component 260 described above. Container 452 includes an inlet port 488 which communicates with a sub-housing 490 which houses a fan 492 and motor 494. Fan 492 is driven by motor 494 and is configured to draw air into the sub-housing 490 and to expel the air into container 452 through inlet port 488. Thus, a flow of air is provided from the inlet port 488 of container 452 to the outlet port 482 of the container 452 and into the vapour distributing component 484 through inlet 486. The flow of air entrains vapour in the head space 496 of the container 452 above the liquid and carries the entrained vapour into the vapour distributing component 484.

Vapour distributing component 484 differs from vapour distributing component 260 in including one or more inlets 486 for vapour arranged in a side or end wall thereof (whereas vapour distributing component 260 has the inlet 296 in a bottom wall). Vapour distributing component 484 includes one or more internal walls or baffles 498 which act in a similar manner to baffles 302, 304 (FIG. 46) to achieve a desired distribution of vapour within the vapour distributing component 484. Vapour distributing component 484 further includes apertures 500A defined in an upper wall portion 484A and lower apertures 500B defined in a lower wall portion 484B. The apertures 500A, 500B are preferably (but not essentially) vertically aligned and are preferably (but not essentially) substantially circular. In preferred constructions, aperture 500A is of smaller dimension than aperture 500B. A source of heat, most preferably in the form of a light source 502 is arranged below the lower aperture 500B, or, in the case of a plurality of apertures 500B, is arranged below at least some, and preferably all, of the apertures 500B.

A gap 504 preferably is arranged between the light source 502 and the margin of wall 484B which defines aperture 500B. The gap 504 may provide a pathway for the flow of air around the light source and into the vapour distributing component 260. Heat from the light source(s) 502 causes an updraft. The air warmed by the light sources rises and exits the vapour distributing component 484 through outlet apertures 500A. The rising air warmed by the light source(s) 502 entrains vapour which is within the vapour distributing component 484 and carries the entrained vapour out through outlet apertures 500A. The upward movement of air may be (but preferably is not) assisted by one or more fans (not shown). It is, however, preferred that the light source(s) 502 constitute the sole means of providing an upward flow of air. Air and entrained vapour exiting outlet apertures 500A pass through gaps provided in the fuel bed 232, such as between individual pieces of simulated fuel, and rise above the fuel bed. Because the vapour entrained in the rising air is somewhat opaque it can resemble wisps of smoke rising from the fuel bed 232. However, and more importantly, the localised illumination of the rising vapour by the light sources 240 gives the vapour a definite colour (depending on the colour of the light source) which causes the illuminated vapour to resemble flames rising from the fuel bed. The natural movement of the illuminated vapour is very reminiscent of flames and an excellent flame simulation is achieved. As the vapour disperses, the effect of the illumination by the light sources 502 ceases, so that the flames appear to have an entirely natural height. It is noted that in the absence of an upward movement of air generated by heat from the light sources 502, the vapour in the vapour distributing component 484 tend to fall downwardly through apertures 500B rather than rising through apertures 500A. This is so even for the relatively smaller droplet size vapours produced by ultrasonic transducers operating at a frequency in excess of 2 MHz.

Figure 58:
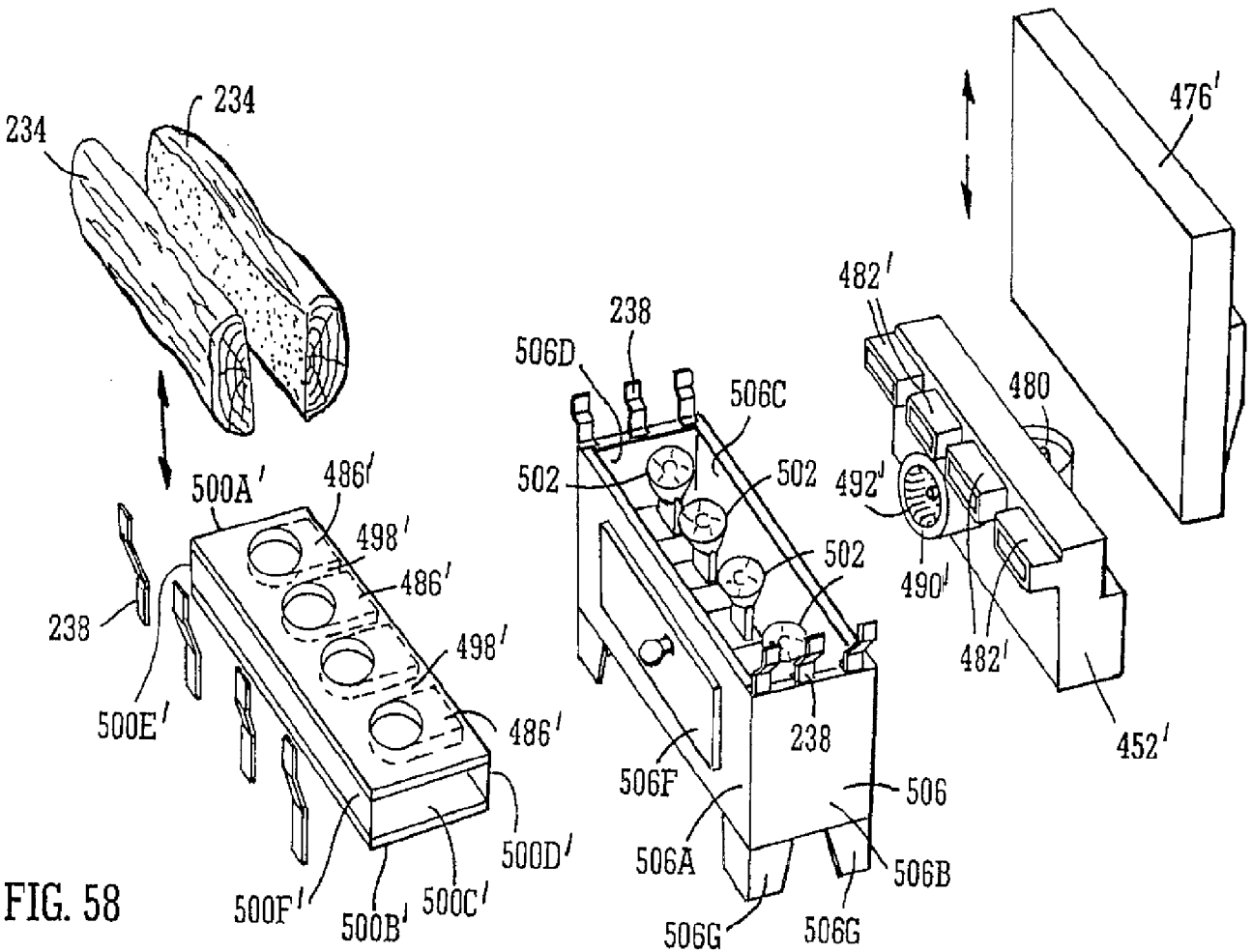
FIG. 58 is a schematic exploded view of an apparatus similar to that of FIG. 56

Referring now to FIG. 58, the illustrated apparatus comprises a reservoir 476' for liquid which is connected to a container 452' via a valve arrangement 480. Thus the reservoir 476' communicates with the container 452' via the valve arrangement 480 so that a substantially constant volume of liquid is maintained in the container. The reservoir 476' is removable from the apparatus for re-filling with liquid. Ultrasonic transducers are sealingly mounted at apertures of the container 452' in the same manner as described in connection with FIGS. 56 and 57, so that a transducing surface thereof is in contact with liquid in the container. Container 452' also comprises a sub-housing 490' which houses a motor (not shown in FIG. 58) and a fan 492' which operatively draws air into the headspace of the container above the body of liquid container 452'. Container 452' also comprises four vapour outlet ports 482' through which vapour entrained in the flow of air from fan 492' exits the container 452'. Each vapour outlet port communicates with a respective inlet 486' of a vapour distributing component 484'. Vapour distributing component 484' is similar to vapour distributing component 484 (FIG. 56) and includes upper wall 484A', lower wall 484B' and side walls 484C', 484D', 484E' and 484F' and may desirably include one or more internal walls or baffles 498' which act in a broadly similar manner to baffles 302, 304 (FIG. 46) to achieve a desired distribution of vapour within the vapour distributing component 484. Vapour distributing component 484' further includes apertures 500A' defined in an upper wall portion 484A' and lower apertures 500B' defined in a lower wall portion 484B'. The apertures 500A', 500B' are preferably (but not essentially) vertically aligned and are preferably (but not essentially) substantially circular. In preferred constructions, aperture 500A' is of smaller dimension than aperture 500B'. In one construction, vapour entering the vapour distribution component 484' through a given inlet 486' is directed by respective baffles 498' to a given aperture 500A'.

The apparatus shown in FIGS. 56 and 58 further comprises lower sub-assembly 506 which is conveniently defined by walls 506A, 506B, 506C and 506D (FIG. 58) and base 506E (FIG. 56). At least front wall 506A may include decorative features 506F styled to represent features of a real fire or stove. Sub-assembly 506 (and consequently the apparatus is a whole) is optionally supported by a plurality of legs 506G. A plurality of light sources 502 is mounted within sub-assembly 506. The light sources are mounted in alignment with, and most preferably in close proximity to, the apertures 500B (FIG. 56) and 500B' (FIG. 58). In the embodiment illustrated in FIG. 58, the apertures 500A' and 500B' and the light sources 502 are respectively shown as being configured in linear arrays. However, such an arrangement is not essential and the light sources and apertures may be positioned in any configuration suitable for achieving a desired smoke and/or flame effect. Further, the apparatus is not limited to four apertures and light sources and other numbers, such as six or eight respective apertures and light sources may be used. Light sources 502 are preferably halogen lights, typically of about 10 W to about 50 W, especially about 20 W to 35 W. Suitable halogen bulbs are well known and readily available.

Thus, with reference to FIG. 58, the vapour distributing component 484' is mounted in use on the sub-assembly 506 and the respective components are configured so that the light sources 502 are thus aligned with their respective apertures. When the apparatus of FIG. 58 is operational, vapour generated in container 452' is entrained in the flow of air generated by fan 492' and exits the container 452' through outlet ports 482'. Air and entrained vapour enter the vapour distributing component 484' through inlets 486'. As described in connection with FIG. 56, heat generated by light sources 502 causes an upward flow of air which carries the vapour through the apertures 500A' and through the fuel bed 234 so that the vapour rises above the fuel bed and provides a realistic simulation of smoke rising from the fuel bed. Furthermore because of the localised nature of the light sources, localised "beams" of light are directed through the apertures 500A', 500B' so that the rising vapour is locally illuminated, that is, only specific relatively closely confined or narrow regions of the space above the fuel bed 232 are directly illuminated by the light sources 502. This local illumination of the rising vapour gives the impression of flames and a very realistic simulation of flames is achieved. It is noted that a generalised illumination of the fuel bed 232 does not, of itself, result in a sufficiently realistic impression of flames.

It will be readily appreciated that in the embodiment illustrated in FIGS. 56 and 58, as compared with the embodiment of FIGS. 39 to 50, the container 452, 452' and associated ultrasonic transducers are mounted rearwardly of the fuel bed 232. This construction has the advantage of permitting a reduction in the depth of the apparatus directly below the fuel bed 232 and vapour distributing component 484, 484', which in the simulation of particular styles of real fire arrangements is advantageous in achieving a greater degree of realism.

Figure 59:
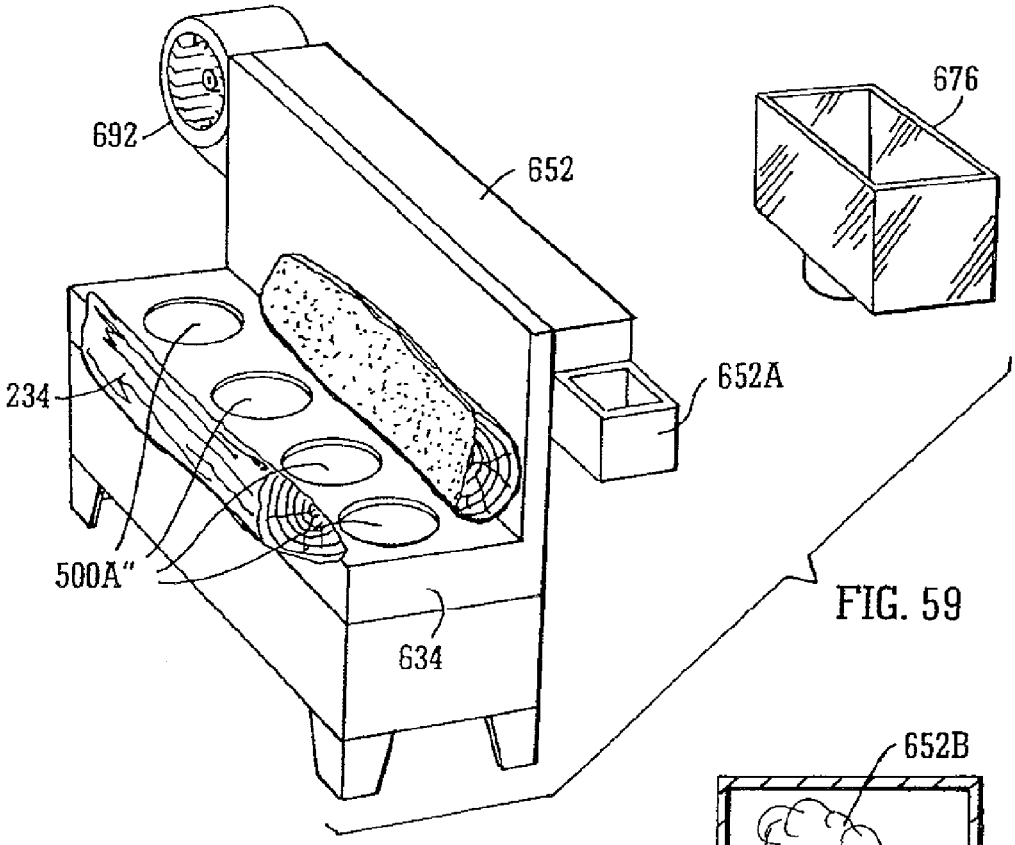
FIG. 59 is a schematic partially exploded view of a further embodiment of an apparatus according to the present disclosure.
Figure 60:
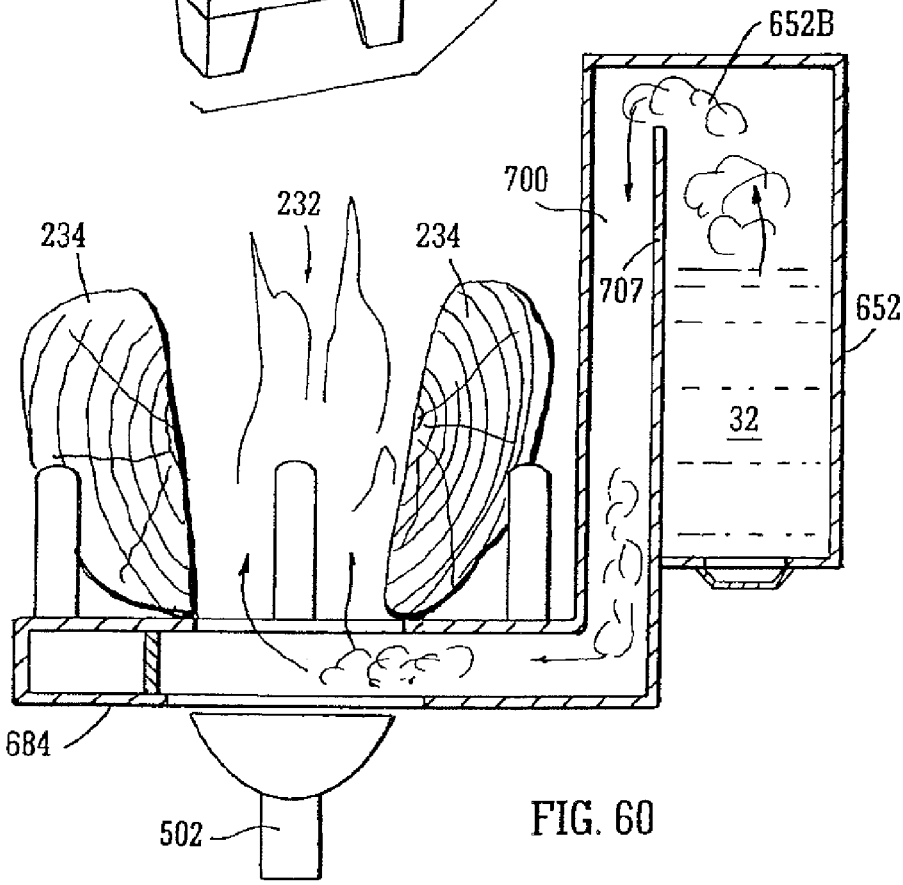
FIG. 60 is a schematic cross section through the apparatus of FIG. 59.
Figure 61:
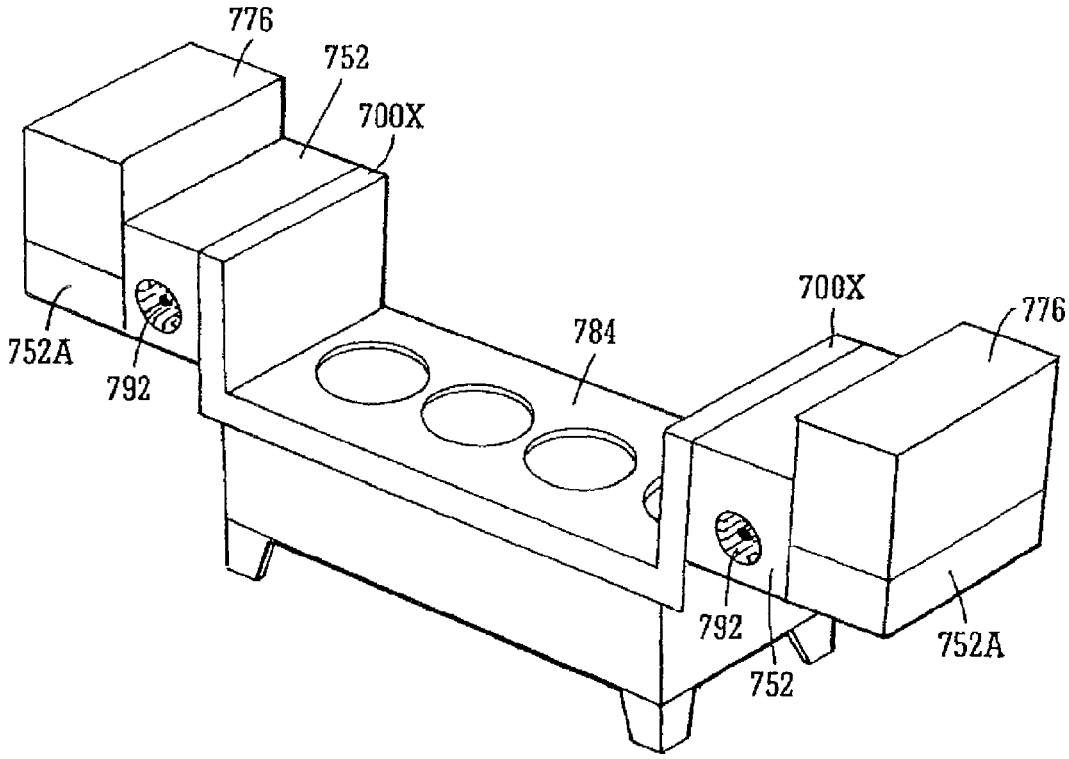
FIG. 61 is a view of a portion of a further embodiment of an apparatus according to the present disclosure.

A further embodiment of an apparatus according to the disclosure is illustrated in FIGS. 59, 60 and 61. With particular reference to FIGS. 59 and 60, it is noted that the principles of operation of this embodiment are substantially the same as those of the embodiments illustrated in FIGS. 56 to 58. The embodiment of FIGS. 59 and 60 includes a liquid container 652 and a vapour distributing component 684 which are conveniently formed as a single component. Vapour distributing component 684 is connected to the container 652 by means of a conduit (or at least one conduit) 700 which extends upwardly and behind the fuel bed 232 and is separated from the container 652 by a partition wall 702. Thus the container 652 is also arranged behind the fuel bed, with the (or each) ultrasonic transducer 658 thereby positioned not lower than (and preferably above) the lowermost parts of the fuel bed 232. A motor driven fan 692 is positioned at a suitable location to provide a supply of air into the container 652. In the embodiment illustrated in FIG. 59, the fan 692 is mounted at one end of the container 652, but other locations are possible. The container is also connected to a suitable liquid reservoir via a suitable valve assembly (not specifically illustrated) which acts to maintain an at least approximately constant volume of liquid in the container 652. The reservoir may, for example be connected to the container 652 at sump portion 652A.

Thus, in a similar manner to the above described embodiments, the vapour generated in the head space 652B is entrained by the flow of air generated by fan 692 and carried through conduit 700 to vapour distributing component 684. The vapour distributing component is proved with apertures 500A" and 500B" and the air-entrained vapour exits through apertures 500A" on a rising current of air generated by heat from light sources 502. The vapour rises though and above fuel bed 232 and generates a simulation of smoke and, by virtue of local illumination of the vapour by light sources 502, also generates a simulation of flames.

The embodiment shown in FIG. 61 differs from the embodiment of FIGS. 59 and 60 in that the vapour distribution chamber 784 has two conduits 700X located at its respective ends. The conduits 700X each communicate with a liquid container 752 and each container includes at least one ultrasonic transducer to generate vapour in the head space above liquid in the container. Each container is provided with a fan 792 to provide a flow of air through the container to entrain the vapour and convey it to the vapour distribution component 784. A removable reservoir 776 communicates with each container 752 via respective sumps 752A. The embodiment of FIG. 61 includes light sources and apertures analogous to those of the embodiments of FIGS. 56, 58, 59 and 60 and functions in an analogous manner.

Various embodiments of the present disclosure as described above illustrate the advantages of using heat generated by a light source to provide an upward flow of air which entrains the vapour and causes it to rise above the fuel bed. However, in terms of producing advantageously localised beams of light, other suitable light sources are available which do not generate appreciable amounts of heat. An example of such light sources is LEDs, especially so-called ultra-bright LEDs which are available in various colours. In constructions employing such light sources, a separate heating means such as a resistance heating means, an infra-red heating means or a halogen heating means may be used in conjunction with the light source to provide the required upward air flow. The separate heating means is preferably arranged below a vapour distributing component. In alternative embodiments using such non-heating light sources, a fan arranged below the vapour distributing component may be used as an alternative to, or in addition to, such separate heating means.

As used herein, the term "vapour" or "vapor" should not be confined to the strict scientific definition, that is, "a gas phase in a state of equilibrium with identical matter in a liquid or solid state below its boiling point, or at least capable of forming solid or liquid at the temperature of the vapor". Rather, "vapour" or "vapor" should be taken to refer to airborne liquid particles or droplets generated by the action of an ultrasonic transducer or the like on a liquid, and more especially to clouds or streams of such particles or droplets.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the disclosure are to be understood to be applicable to any other aspect, embodiment or example described herein unless incompatible therewith.

Having described the invention, the following is claimed:

1. A simulated flame effect apparatus comprising a housing, the flame effect apparatus being configured to operatively generate an illuminated mist to provide a flame effect within said housing, the generated flame effect being viewable through two or more sides of the housing;

a container adapted to contain a body of liquid;

an ultrasonic transducer device having a transducing surface operatively in liquid contacting relation with the body of liquid and operable to produce the mist for use in provision of the flame effect; and a fuel bed, the container being located below the fuel bed.

2. The apparatus of claim 1 comprising two or more glass panels located in two or more sides of the housing, the generated flame effect being viewable through the two or more glass panels.

3. The apparatus of claim 2, wherein the two or more sides are substantially perpendicular to one another.

4. The apparatus of claim 3, wherein a first side of the two or more sides is a front wall of the housing and a second side of the two or more sides is a side wall of the housing.

5. The apparatus of claim 2 comprising four glass panels located in four sides of the housing.

6. The apparatus of claim 1 comprising a heat source whereby heated air is operably emitted to the room in which the flame effect apparatus is located.

7. The apparatus of claim 6, wherein the heat source comprises a fan heater.

8. The apparatus of claim 1 comprising means for providing a current of air directed upwardly from the fuel bed.

9. The apparatus of claim 8, wherein the means for providing a current of air directed upwardly from the fuel bed comprises a light source.

10. The apparatus of claim 1 comprising:

an apertured bed;

the container providing a head space above the liquid and including a vapor outlet port;

the ultrasonic transducer device being operable to produce the mist in said head space;

means for providing a flow of air along a path extending into the head space and out of the vapor outlet port, wherein the outlet port is so disposed that the air flow path exits the container below the apertured bed; and means for providing a current of air directed upwardly from the apertured bed.

11. The apparatus of claim 10, wherein the vapor generator is located below the aperture bed.

12. The apparatus of claim 11 comprising one or more light sources for illuminating the mist.

13. The apparatus of claim 12, wherein operably the heat emitted by the one or more light sources provides a rising air current which assists in carrying the vapor upwardly through the housing.

14. The apparatus of claim 1, wherein the housing comprises a front wall at least partially defined by a glass panel.

15. The apparatus of claim 1, wherein the housing comprises a side wall at least partially defined by a glass panel.

16. The apparatus of claim 1 being configured to rest against a wall.

17. The apparatus of claim 1 being configured to be free standing.

18. The apparatus of claim 1 further comprising a liquid supply reservoir which operatively communicates with the container to supply liquid to the container.

19. The apparatus as claimed in claim 18 further comprising control means operative to control the flow of liquid from the reservoir to the container such that a substantially constant volume of liquid is maintained in the container.

20. A simulated flame effect apparatus comprising:

a housing comprising a front wall at least partially defined by a glass panel and a side wall at least partially defined by a glass panel;

an apertured bed located within the housing;

a container adapted to contain a body of liquid the container providing a head space above the liquid and including a vapor outlet port;

an ultrasonic transducer device having a transducing surface operatively in liquid contacting relation with the body of liquid and operable to produce a mist;

means for providing a flow of air along a path extending into the head space and out of the vapor outlet port, wherein the outlet port is so disposed that the air flow path exits the container below the apertured bed;

means for providing a current of air directed upwardly from the apertured bed to carry the mist produced from the transducer device above the apertured bed; and a light source arranged below the aperture bed and directed onto the mist to illuminate the mist to generate a flame effect which is visible through the front and side walls.

* * * * *